US012158299B2

(12) United States Patent
Jung et al.

(10) Patent No.: US 12,158,299 B2
(45) Date of Patent: Dec. 3, 2024

(54) REFRIGERATOR

(71) Applicant: LG Electronics Inc., Seoul (KR)

(72) Inventors: Yong Rak Jung, Seoul (KR); Jae Koo Kang, Seoul (KR); Doo Hee Goh, Seoul (KR); Yong Bum Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 17/776,917

(22) PCT Filed: Nov. 13, 2020

(86) PCT No.: PCT/KR2020/015994
§ 371 (c)(1),
(2) Date: May 13, 2022

(87) PCT Pub. No.: WO2021/096289
PCT Pub. Date: May 20, 2021

(65) Prior Publication Data

US 2022/0404086 A1 Dec. 22, 2022

(30) Foreign Application Priority Data

Nov. 13, 2019 (KR) ..... 10-2019-0145420
Mar. 4, 2020 (KR) ..... 10-2020-0027411

(51) Int. Cl.
*F25D 17/06* (2006.01)
*F25D 11/02* (2006.01)
*F25D 17/08* (2006.01)

(52) U.S. Cl.
CPC ..... *F25D 17/067* (2013.01); *F25D 11/02* (2013.01); *F25D 17/08* (2013.01); *F25D 2317/067* (2013.01); *F25D 2317/0681* (2013.01)

(58) Field of Classification Search
CPC ..... F25D 17/067; F25D 11/02; F25D 17/08; F25D 2317/067; F25D 2317/0681; F25D 2700/12; F25D 17/065; F25D 25/025
See application file for complete search history.

(56) References Cited

U.S. PATENT DOCUMENTS 5,819,552 A 10/1998 Lee
2017/0343269 A1* 11/2017 Kim ..... F25D 23/068

FOREIGN PATENT DOCUMENTS

| | | | |
|---|---|---|---|
| EP | 2975341 | A1 | 1/2016 |
| JP | 2001091127 | A | 4/2001 |
| JP | 2002267319 | A | 9/2002 |
| JP | 4139506 | B2 | 8/2008 |
| KR | 20070016539 | A | 2/2007 |
| KR | 101006783 | B1 | 1/2011 |
| KR | 20130107636 | A | 10/2013 |
| KR | 101852677 | B1 | 4/2018 |
| WO | WO 2021/096289 | A1 | 5/2021 |

OTHER PUBLICATIONS

Office Action in Australian Appln. No. 2020384836, mailed on May 30, 2023, 4 pages.
Extended European Search Report in European Appln. No. 20887199.6, mailed on Oct. 27, 2023, 8 pages.

* cited by examiner

*Primary Examiner* — Ana M Vazquez
(74) *Attorney, Agent, or Firm* — Fish & Richardson P.C.

(57) ABSTRACT

A refrigerator is designed compactly and includes an evaporator installed inside a cool air generation part and a grille fan module lined up with the evaporator, where the installation area of the cool air generation part is minimized.

18 Claims, 35 Drawing Sheets

REFRIGERATOR

CROSS-REFERENCE TO RELATED APPLICATIONS

This application is a National Stage application under 35 U.S.C. § 371 of International Application No. PCT/KR2020/015994, filed on Nov. 13, 2020, which claims the benefit of Korean Patent Application No. 10-2019-0145420, filed on Nov. 13, 2019 and Korean Patent Application No. 10-2020-0027411, filed on Mar. 4, 2020. The disclosures of the prior applications are incorporated by reference in their entirety.

TECHNICAL FIELD

The present disclosure relates to a refrigerator and, more particularly, to a refrigerator that can be designed compactly since an evaporator and a grille fan module are lined up with each other inside a cool air generation part so that the evaporator and the grille fan module are efficiently arranged in the cool air generation part.

BACKGROUND ART

In general, a refrigerator is a home appliance that can store food at a low temperature in an internal storage space that is shielded by a door, and is configured so that the stored food can be stored in a low temperature state by cooling the inside of the storage space using cool air generated by heat exchange with a refrigerant circulated through the refrigeration cycle.

Refrigerators are on the trend of enlargement and multifunctionality due to changes in eating habits and diversification of user preferences, and various storage units such as drawers, shelves, and baskets are provided in the storage space.

In addition, the refrigerator compartment may be divided into a refrigerating compartment and a freezer compartment according to the temperature of the food stored in the refrigerator. Typically, it is common to maintain a temperature of 3 to 4 degrees Celsius in the refrigerating compartment, and it is common to maintain a temperature in the freezer compartment at around −20 degrees Celsius.

As a method of venting cool air into the storage compartment space of the refrigerator, the method in which cool air is vented into the storage compartment side through vent holes of a grille plate installed in the rear of the storage compartment is mainly applied.

A structure in which a grille fan is installed directly on the rear surface of the grille plate to vent cool air, or a duct forming a flow path of cool air is attached to the grille plate to vent cool air is mainly used.

Such a grille plate and grille fan installation structure for venting cool air into the storage compartment are disclosed in Korean Patent Application Publication No. 10-2003-0065905, Korean Patent Notification No. 10-1852677, and Korean Patent Notification No. 10-0821711.

Korean Patent Application Publication No. 10-2003-0065905 discloses a refrigerator provided with a refrigerator body having at least one cooling compartment formed therein and a circulation passage to circulate air in the cooling compartment; and a blower fan disposed in the circulation passage to promote air flow. The refrigerator includes: a grille body disposed to partition the inside of the cooling compartment on a downstream side of the blowing fan with respect to the flow direction of the air; and a plurality of vent outlets provided with side walls inclined outwardly with respect to the thickness direction of the grille body and spaced apart from each other along the circumferential direction.

As the conventional refrigerator has the above structure, air may be uniformly and evenly vented into the cooling compartment to achieve a uniform temperature distribution.

However, in the conventional refrigerator, the cool air blown from the blower fan is directly vented toward a vent outlet member without a separate shroud or duct, thus the cool air blown from the blower fan is not concentrated at the vent outlet member but is dispersed to the surrounding area and vented, and as a result, a cool air transfer efficiency of the cool air blown from the blower fan is significantly decreased.

Korean Patent Notification No. 10-1852677 discloses a refrigerator including: a cabinet; a refrigerating compartment provided at one side of the cabinet; a switching compartment provided at another side of the cabinet, and capable of changing temperature to a refrigerating or freezing temperature; an evaporator provided at the switching compartment; and a grille fan assembly for partitioning the inside of the switching compartment to form a space in which the evaporator is provided. The grille fan assembly includes: an insulation member including a switching compartment flow path part for supplying cool air to the switching compartment, and including a refrigerating compartment flow path part for supplying cool air to the refrigerating compartment at an opposite surface of the switching compartment flow path part; a switching compartment fan mounted at an opening of the switching compartment flow path part, and forcibly making the cool air of the evaporator flow to the switching compartment flow path part; a refrigerating compartment fan mounted at an opening of the refrigerating compartment flow path part, and forcibly making the cool air of the evaporator flow to the refrigerating compartment flow path part; and an opening formed to penetrate the insulation member from the switching compartment flow path part to the refrigerating compartment flow path part, and allowing a portion of the air vented during the operation of the switching compartment fan to flow into the refrigerating compartment flow path part to prevent the air of the refrigerating compartment from flowing backward.

Such a conventional refrigerator has a structure capable of supplying cool air to the switching compartment and the refrigerating compartment without using a damper, so that production costs may be reduced and productivity may be improved.

However, the conventional refrigerator has problems such as a complicated assembly process, deteriorated assemblability, and a long assembly time required since the grille fan assembly is composed of a large number of parts such as a grille fan, an insulating sheet, an insulating member, an insulating duct, and a shroud.

In addition, as the refrigerating compartment fan is installed in the shroud, a path through which the cool air is transferred to each refrigerating compartment through the insulating duct is formed rather long, cooling performance and cooling efficiency are inferior compared to the method in which cool air is directly vented to the storage compartment through the refrigerating compartment fan.

Korean Patent Notification No. 10-0821711 discloses a fan assembly mounting structure characterized by the reduction of the number of product components and the work man-hours for manufacturing the product since the fan assembly is substantially directly fixed to the grille fan and thus a configuration such as a support plate for fixing the fan assembly is deleted.

However, as the conventional refrigerator is configured such that the cool air blown by the fan assembly is vented to the storage space through a cool air vent outlet and a cool air duct communicating with the shroud, the cool air blown by the fan assembly may not be directly vented to the storage space side, so the temperature of the cool air rises during circulation, which causes the fan assembly to operate additionally, reducing the power consumption efficiency of the refrigerator.

DISCLOSURE

Technical Problem

The present disclosure has been made keeping in mind the problems occurring in the related art. An objective of the present disclosure is to provide a refrigerator that can be designed compactly since an evaporator that generates cool air and a grille fan module that sprays cool air are lined up with each other inside a cool air generation part.

In addition, an objective of the present disclosure is to provide a refrigerator in which the grille fan module is disposed on the upper portion of the cool air generation part, and the evaporator is placed on the lower portion of the cool air generation part so as to reduce the installation area of first and second cool air generation parts in the front and rear width direction.

Moreover, an objective of the present disclosure is to provide a refrigerator characterized in that uniform cool air is vented through vent holes disposed on the left and right sides of a shroud as, based on a grille fan member installed in the shroud, the volume of the venting space of the shroud located in the rotation direction of the grille fan member is larger than the volume of the venting space of the shroud located on the opposite side to the rotation direction of the grille fan member.

Furthermore, an objective of the present disclosure is to provide a refrigerator in which the venting space of a shroud is composed of a first venting space, a second venting space, and a third venting space so that the cool air vented to the storage compartment through a vent part is simultaneously vented to the front side and the left and right sides of the first and second storage parts through a grille plate.

In addition, an objective of the present disclosure is to provide a refrigerator in which the cool air in the left and right venting spaces is guided to the vent holes disposed on the left and right sides of the vent part as the third guide wall and the fourth guide wall made of curved surfaces are formed on the left and right sides of a grille fan installation part.

Moreover, an objective of the present disclosure is to provide a refrigerator in which cool air is simultaneously vented into the upper space and the central space of the storage compartment as a first vent part is formed in the front upper part of the grille plate and a second vent part is formed in the front central part of the grille plate.

Furthermore, an objective of the present disclosure is to provide a refrigerator in which a vent guide rib is installed between the vent holes of the vent part to guide the spray direction of the cool air vented to the storage compartment through the vent holes.

In addition, an objective of the present disclosure is to provide a refrigerator in which a first guide rib is installed at the center of the vent part, and second and third guide ribs are installed on the left and right sides of the vent part, respectively, so that cool air blown to the first and second storage parts through the vent part is dispersed and sprayed in the front side and left and right directions.

Moreover, an objective of the present disclosure is to provide a refrigerator configured to prevent the concentration of the cool air spray to the central side of the vent part since a blocking part is formed in the center of a second row vent part of the first vent part, so that a portion of the cool air vented by the grille fan member to the front center side is blocked.

Furthermore, an objective of the present disclosure is to provide a refrigerator configured to enable easy assembly of the grille fan module on the grille plate as a shroud fixing part is formed on each side of the rear surface of the shroud so as to be assembled to a fastening boss formed on the rear surface of the grille plate.

In addition, an objective of the present disclosure is to provide a refrigerator in which a vent guide is provided on each side of the vent part formed on the front surface of the grille plate, so that the vented cool air flows evenly throughout the first and second storage parts.

Furthermore, an objective of the present disclosure is to provide a refrigerator configured such that the effect of the cool air directly sprayed on a temperature sensor by the vent part may be minimized as blocking ribs are installed around an internal sensor module provided on the grille plate.

Technical Solution

In order to achieve the above mentioned objective, according to an embodiment of the present disclosure, there is provided a refrigerator that can be designed compactly since an evaporator and a grille fan module installed in a cool air generation part are lined up with each other so that the parts are efficiently arranged.

In addition, a refrigerator according to the present disclosure suggests that the grille fan module is disposed on the upper portion of the cool air generation part, and the evaporator is placed on the lower portion of the cool air generation part, thereby reducing the size in the front and rear width direction of the installation area.

Moreover, a refrigerator according to the present disclosure suggests that, based on a grille fan member installed in a shroud, the volume of the venting space of the shroud located in the rotation direction of the grille fan member is larger than the volume of the venting space of the shroud located on the opposite side to the rotation direction of the grille fan member, thereby improving the cool air circulation efficiency of the first and second storage parts as uniform cool air is vented through vent holes disposed on the left and right sides of the shroud.

Furthermore, a refrigerator according to the present disclosure suggests that the venting space of a shroud is composed of a first venting space, a second venting space, and a third venting space so that the cool air vented to the storage compartment through a vent part is simultaneously vented to the front side and the left and right sides of the first and second storage parts through a grille plate, and thus, cool air is evenly delivered to the first and second storage parts.

In addition, a refrigerator according to the present disclosure suggests that the third guide wall and the fourth guide wall made of curved surfaces are formed on the left and right sides of a grille fan installation part, so that the cool air in the left and right venting spaces is guided to the vent holes disposed on the left and right sides of the vent part.

Moreover, a refrigerator according to the present disclosure suggests that cool air is simultaneously vented to the upper space and the central space of the storage compartment as a first vent part is formed in the front upper part of the grille plate and a second vent part is formed in the front central part of the grille plate, so that the cool air vented to the first and second storage parts may be diffused to the storage compartment in a short time.

Furthermore, a refrigerator according to the present disclosure suggests that a vent guide rib installed between the vent holes of the vent part to guide the spray direction of the cool air vented to the storage compartment through the vent holes, so that the vent direction of the cool air blown into the storage compartment has a constant directionality.

In addition, a refrigerator according to the present disclosure suggests that a first guide rib is installed at the center of the vent part, and second and third guide ribs are installed on the left and right sides of the vent part, respectively, so that cool air blown to the first and second storage parts through the vent part is dispersed and sprayed in the front side and left and right directions, and thus, the cool air blown by the vent part is dispersed and sprayed.

Moreover, a refrigerator according to the present disclosure suggests that a blocking part is formed in the center of a second row vent part of the first vent part so that a portion of the cool air vented by the grille fan member to the front center side is blocked, thereby preventing the concentration of the cool air spray to the central side of the vent part.

Furthermore, a refrigerator according to the present disclosure suggests that a shroud fixing part is formed on each side of the rear surface of the shroud so as to be assembled to a fastening boss formed on the rear surface of the grille plate, thereby enabling easy assembly of the grille fan module on the grille plate.

In addition, a refrigerator according to the present disclosure suggests that a vent guide is provided on each side of the vent part formed on the front surface of the grille plate, so that the vented cool air flows evenly throughout the first and second storage parts.

Furthermore, a refrigerator according to the present disclosure suggests that blocking ribs are installed around an internal sensor module provided on the grille plate, so that the cool air of the vent part being directly delivered to a temperature sensor may be prevented.

Advantageous Effects

As described above, the refrigerator of the present disclosure has an advantage in that the overall size of the refrigerator can be manufactured compactly as the installation space of the cool air generation part is minimized by arranging the evaporator and grille fan module side by side on the same line in the cool air generation part.

In addition, by disposing the grille fan module on the upper portion of the cool air generation part and disposing the evaporator on the lower portion of the cool air generation part, it is possible to reduce the installation area of the first and second cool air generation parts in the front and rear width direction, thereby enabling a compact design.

Moreover, based on the grille fan member installed in the shroud, as the volume of the venting space of the shroud located in the rotation direction of the grille fan member is larger than the volume of the venting space of the shroud located on the opposite side to the rotation direction of the grille fan member, uniform cool air can be vented through vent holes disposed on the left and right sides of the shroud, and as a result, the cool air circulation efficiency of the first and second storage parts can be improved.

Furthermore, as the venting space of the shroud is composed of the first venting space, the second venting space, and the third venting space, the cool air vented to the storage compartment through the vent part is simultaneously vented to the front side and the left and right sides of the first and second storage parts through the grille plate, and as a result, the cool air circulation time of the first and second storage parts can be shortened, and the cooling efficiency can be improved due to the rapid cool air transfer.

In addition, as the first vent part is formed in the front upper part of the grille plate and the second vent part is formed in the front central part of the grille plate, cool air is simultaneously vented into the upper space and the central space of the storage compartment, so that the cool air vented to the first and second storage parts can be diffused to the storage compartment in a short time.

Moreover, as the vent guide rib is installed between the vent holes of the vent part to guide the spray direction of the cool air vented into the first and second storage parts through the vent holes, the spray direction of the cool air vented into the first and second storage parts has a constant directionality, and thus, uniform cool air can be vented to the first and second storage parts.

Furthermore, as the first guide rib is installed at the center of the vent part, and second and third guide ribs are installed on the left and right sides of the vent part, respectively, cool air blown to the first and second storage parts through the vent part is dispersed and sprayed in the front side and left and right directions, and thus, cool air blown by the vent part can be diffused and sprayed in multiple directions.

In addition, as a blocking part is formed in the center of the second row vent part of the first vent part, a portion of the cool air vented to the front center side by the grille fan member is blocked, and thus, the concentration of the cool air spray to the central side of the vent part can be prevented.

Moreover, as the shroud fixing part is formed on each side of the rear surface of the shroud so as to be assembled to the fastening boss formed on the rear surface of the grille plate, the assembly efficiency of the grille fan module installed on the grille plate can be improved.

Furthermore, as the vent guide is additionally installed on each side of the vent part formed on the front surface of the grille plate, the cool air vented to the first and second storage parts can flow evenly throughout the first and second storage parts, and thus, rapid cool air transfer can be achieved.

In addition, as blocking ribs are provided around the internal sensor module to prevent the cool air blown by the vent part from being directly transferred to the temperature sensor, sensing accuracy of the temperature sensor is improved, and thus, more effective refrigerator control can be achieved.

MODE FOR INVENTION

Hereinafter, a preferred embodiment of a refrigerator according to the present disclosure will be described in detail with reference to the accompanying drawings.

Figure 1:
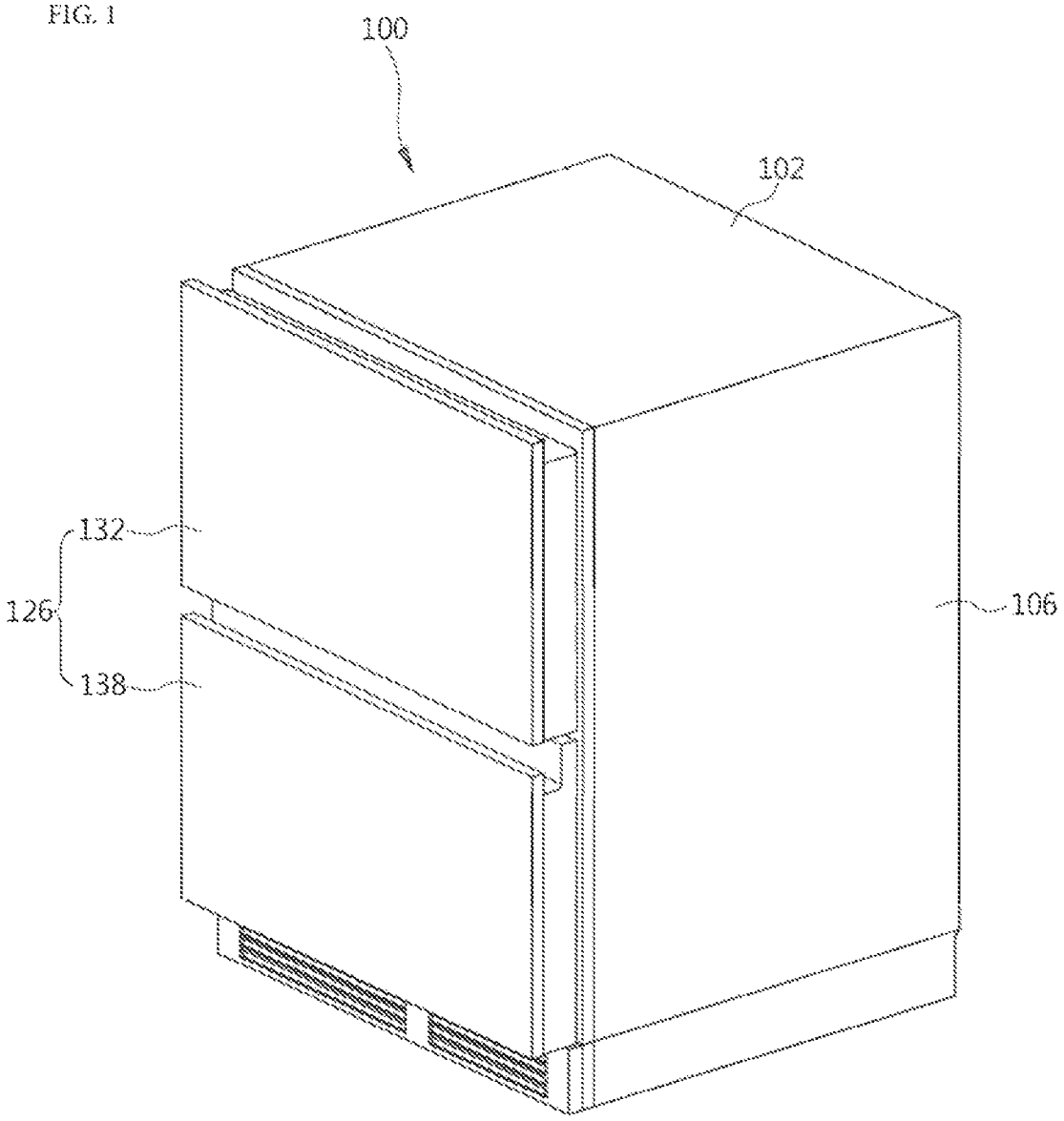
FIG. 1 is a perspective view showing the configuration of a preferred embodiment of a refrigerator according to the present disclosure.
Figure 2:
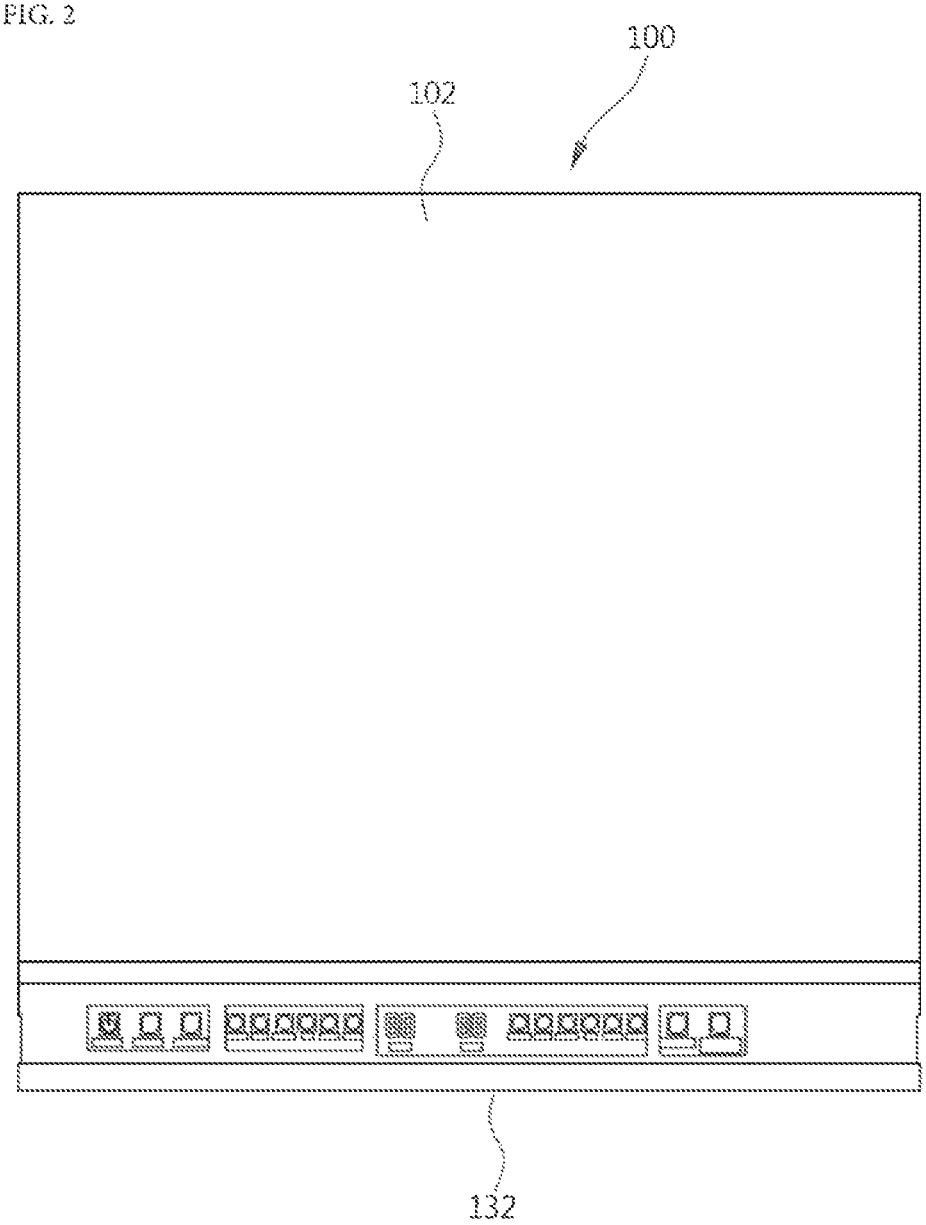
FIG. 2 is a plan view showing the configuration of the preferred embodiment of the refrigerator according to the present disclosure.
Figure 3:
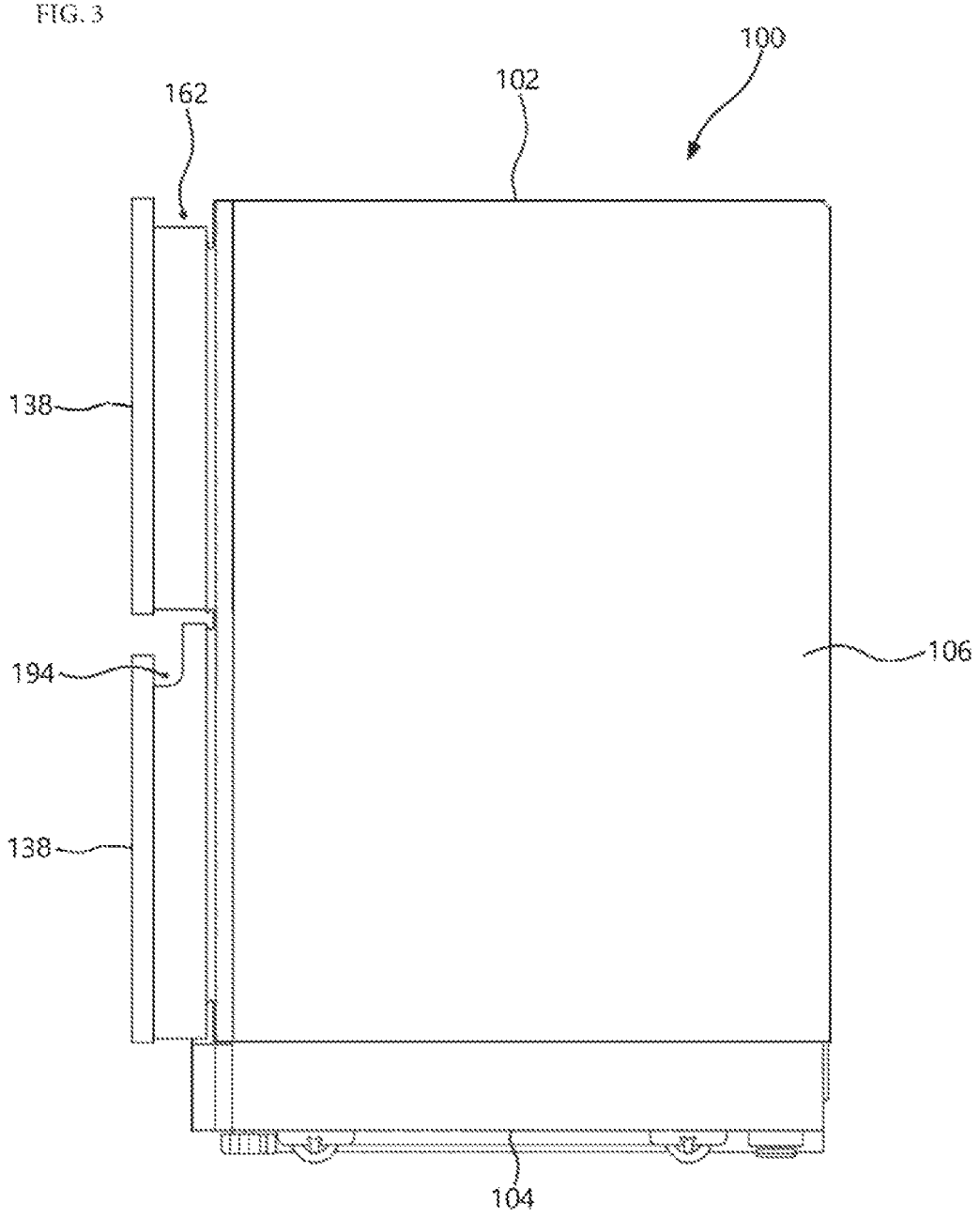
FIG. 3 is a side view showing the configuration of the preferred embodiment of the refrigerator according to the present disclosure.
Figure 4:
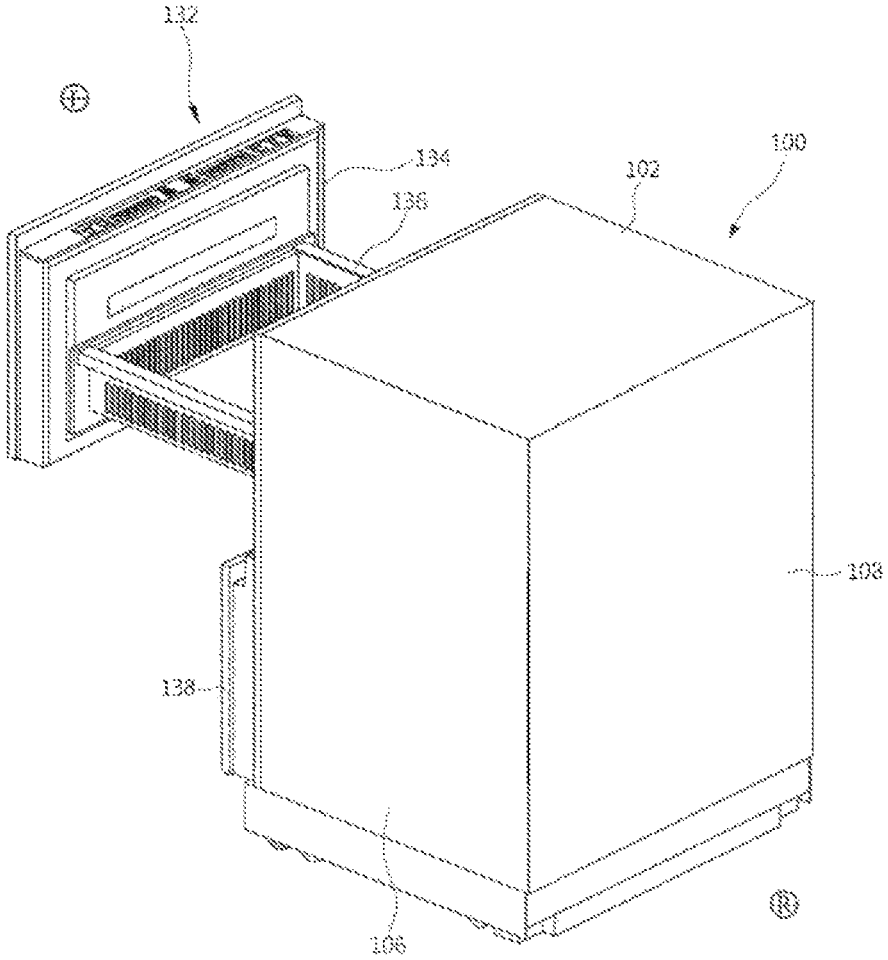
FIG. 4 is a rear perspective view showing an opened state of a first drawer constituting the embodiment of the present disclosure.
Figure 5:
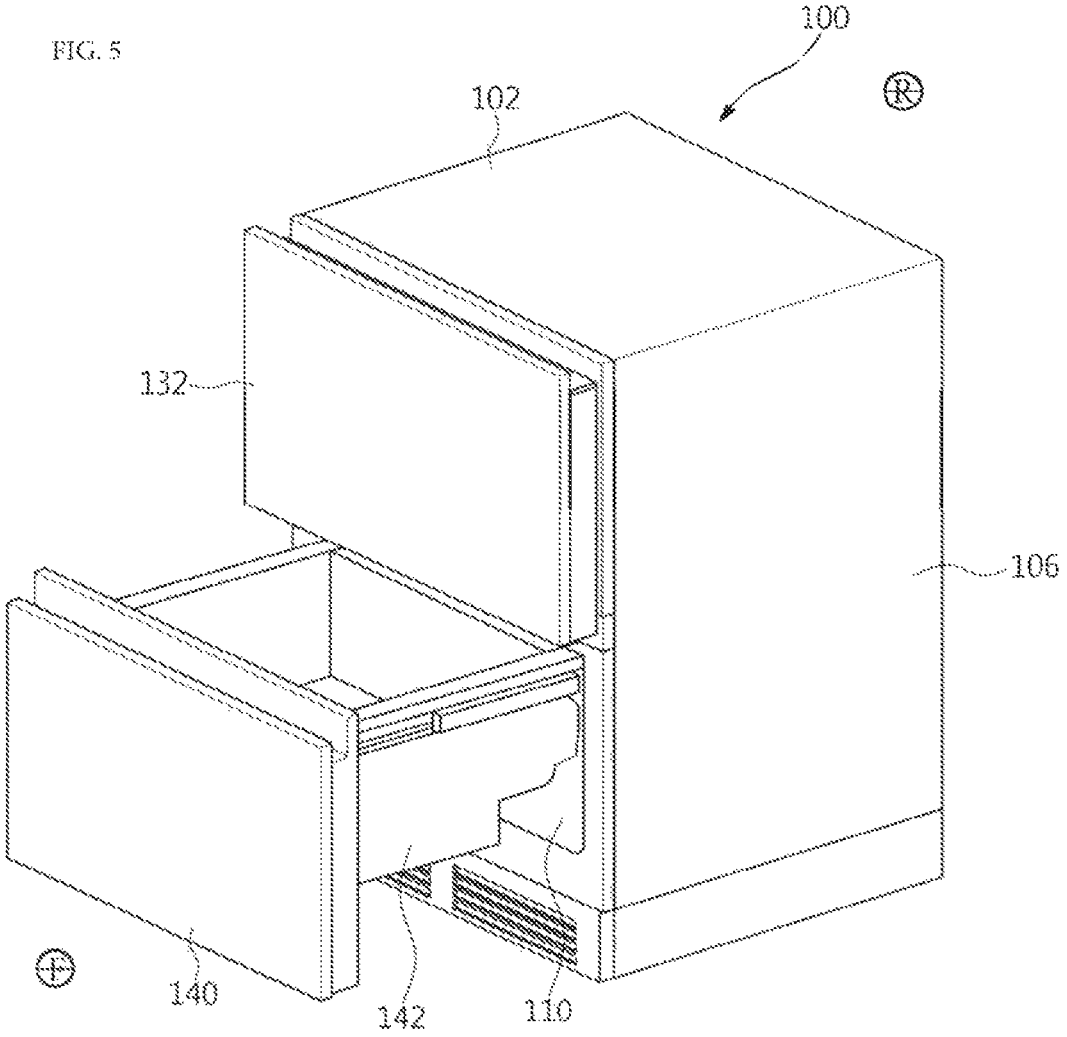
FIG. 5 is a front perspective view showing an opened state of a second drawer constituting the embodiment of the present disclosure.
Figure 6:
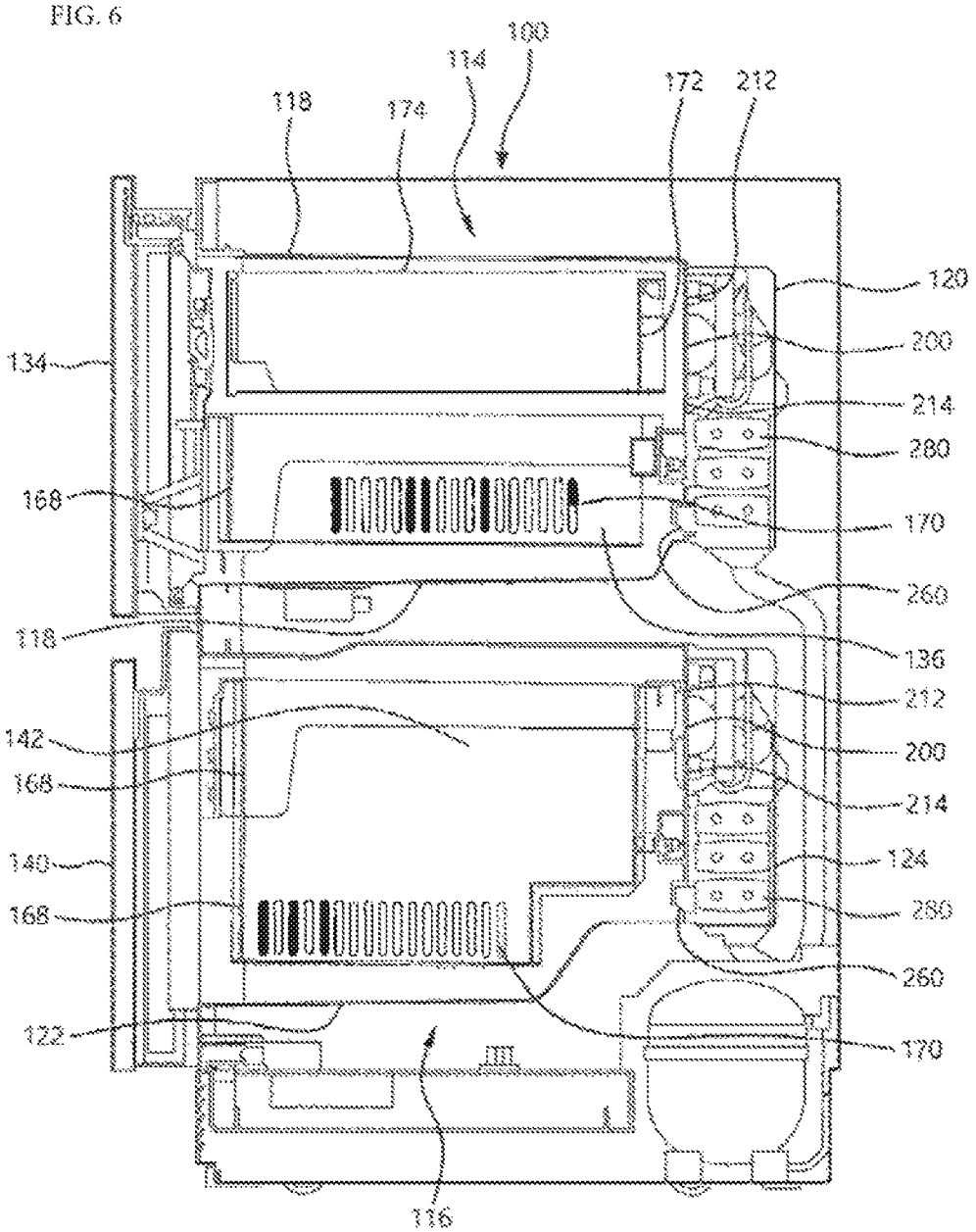
FIG. 6 is a cross-sectional view showing the configuration of the preferred embodiment of the refrigerator according to the present disclosure.

FIG. 1 is a perspective view showing the configuration of a preferred embodiment of a refrigerator according to the present disclosure; FIG. 2 is a plan view showing the configuration of the preferred embodiment of the refrigerator according to the present disclosure; FIG. 3 is a side view showing the configuration of the preferred embodiment of the refrigerator according to the present disclosure; FIG. 4 is a rear perspective view showing an opened state of a first drawer constituting the embodiment of the present disclosure; FIG. 5 is a front perspective view showing an opened state of a second drawer constituting the embodiment of the present disclosure; and FIG. 6 is a cross-sectional view showing the configuration of the preferred embodiment of the refrigerator according to the present disclosure.

As shown in FIGS. 1 to 6, a refrigerator according to the present disclosure includes: an inner casing 111 with a storage space; an outer casing 100 installed on an outside of the inner casing 111; doors 134 and 140 that open and close the storage space; a grille plate 200 installed inside the inner casing and dividing the storage space into a storage part and a cool air generation part 113; and a vent part 210 formed on the grille plate and venting cool air to the storage part 112, wherein in the cool air generation part 113, an evaporator 280 for generating cool air and a grille fan module 400 for supplying cool air to the storage part 112 are provided.

The refrigerator according to the embodiment of the present disclosure will be described for each of the above-described components.

First, the outer casing 100 of the refrigerator according to the embodiment of the present disclosure will be described.

The outer casing 100 is a portion that forms the exterior of the refrigerator.

The outer casing 100 has a ceiling portion 102 forming an upper wall, a bottom portion 104 forming a lower wall, two side wall portions 106 forming both side walls, and a rear wall 108 foaming a rear wall.

In addition, the outer casing 100 is composed of a box body open to the front. At this time, the inner space of the outer casing 100 is provided as an installation space 110.

An inner casing 111 is installed inside the installation space 110 of the outer casing 100. One or more of the inner casing 111 may be installed in the installation space 110 of the outer casing 100, and a structure in which two inner casings 111 are installed will be described.

The inner casing 111 largely includes a storage part 112 and a cool air generation part 113. A grille plate 200 to be described later is installed inside the inner casing 111 so that the space is divided into the storage part 112 for storing food and food containers and the cool air generation part 113 where a grille fan module 400 and an evaporator 280 to be described later are installed.

The inner casing 111 may include a first inner casing 114 and a second inner casing 116 respectively installed in the upper and lower spaces of the outer casing 100.

The first inner casing 114 has a chamber shape with an open front, and is installed in the upper portion the installation space 110 of the outer casing 100. Cool air is generated and circulated inside the first inner casing 114, and food or food containers are stored therein.

The second inner casing 116 is installed under the first inner casing 114. The second inner casing 116 has a chamber shape with an open front, and is installed in the lower portion the installation space 110 of the outer casing 100. Like the first inner casing 114, cool air is generated and circulated inside the second inner casing 116, and food or food containers are stored therein.

That is, the installation space 110 of the outer casing 100 is divided into the first inner casing 114 and the second inner casing 116, and the first inner casing 114 and the second inner casing 116 are independent spaces which may be used as a refrigerating compartment and a freezer compartment, respectively.

In addition, the first inner casing 114 is divided into a first storage part 118 and a first cool air generation part 120. The first storage part 118 is a portion where a first drawer part 132, which will be described later, is drawn in and out, and the first cool air generation part 120 is a portion where the evaporator 280, which will be described later, is installed to generate cool air.

The first storage part 118 and the first cool air generation part 120 are partitioned by the grille plate 200 to be described later.

The second inner casing 116 is divided into a second storage part 122 and a second cool air generation part 124. The second storage part 122 is a portion where a second drawer part 138, which will be described later, is drawn in and out, and the second cool air generation part 124 is a portion where the evaporator 280, which will be described later, is installed.

The second storage part 122 and the second cool air generation part 124 are partitioned by the grille plate 200 to be described later.

A drawer part 126 including doors 134 and 140 and drawer bodies 136 and 142 is installed inside the first and second storage parts 118 and 122. The drawer part 126 is installed inside each of the first and second storage parts 118 and 122. Here, the drawer part 126 installed in the first storage part 118 is described as a first drawer part 132, and the drawer part 126 installed in the second storage part 122 is described as a second drawer part 138.

The first drawer part 132 is installed inside the first storage part 118. The first drawer part 132 includes a first door 134 and a first drawer body 136.

The first drawer part 132 is formed in a drawer shape, and is installed inside the first storage part 118 to be drawn in and out. The inside of the first drawer part 132 is where food and food containers are stored and stored.

The second drawer part 138 is installed inside the second storage part 122. The second drawer part 138 includes a second door 140 and a second drawer body 142.

The second drawer part 138 is formed in a drawer shape, and is installed inside the second storage part 122 to be drawn in and out.

The inside of the second drawer part 138 is where food and food containers are stored and stored.

A drawer rail (not shown) is installed on each side of the first drawer part 132 and on each side of the second drawer part 138, respectively. The drawer rails installed on both sides of the first and second drawer parts 132 and 138 are typical drawer rails and a detailed description thereof will be omitted. By using the drawer rails, the first and second drawer parts 132 and 138 may be pulled in and pulled out.

The first drawer part 132 and the second drawer part 138 are disposed on the upper and lower sides of the installation space 110, respectively, and are installed to be drawn out of the first and second storage parts 118 and 122 according to a user's operation.

Figure 7:
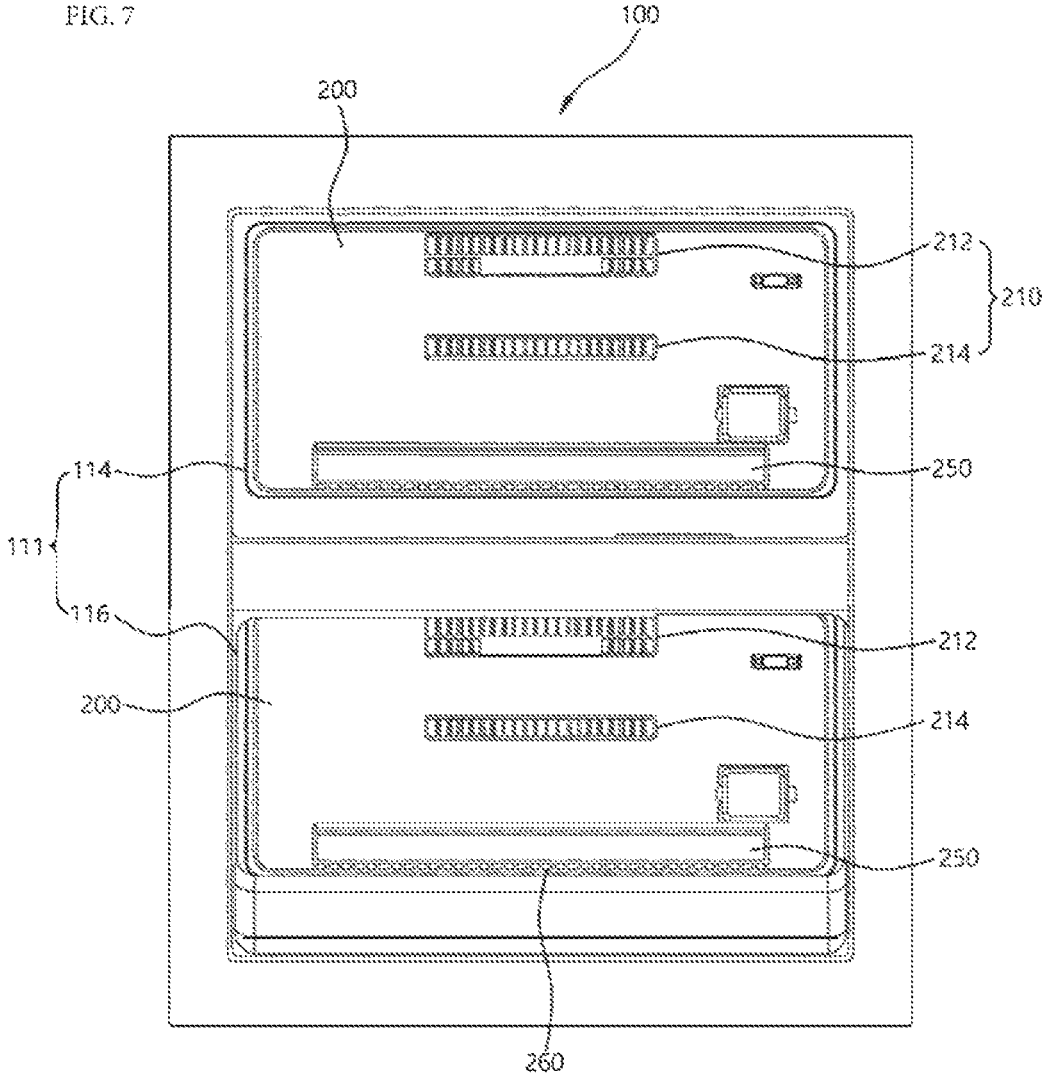
FIG. 7 is a front view showing a state in which a grille plate is installed inside a first inner casing and a second inner casing constituting the embodiment of the present disclosure.
Figure 8:
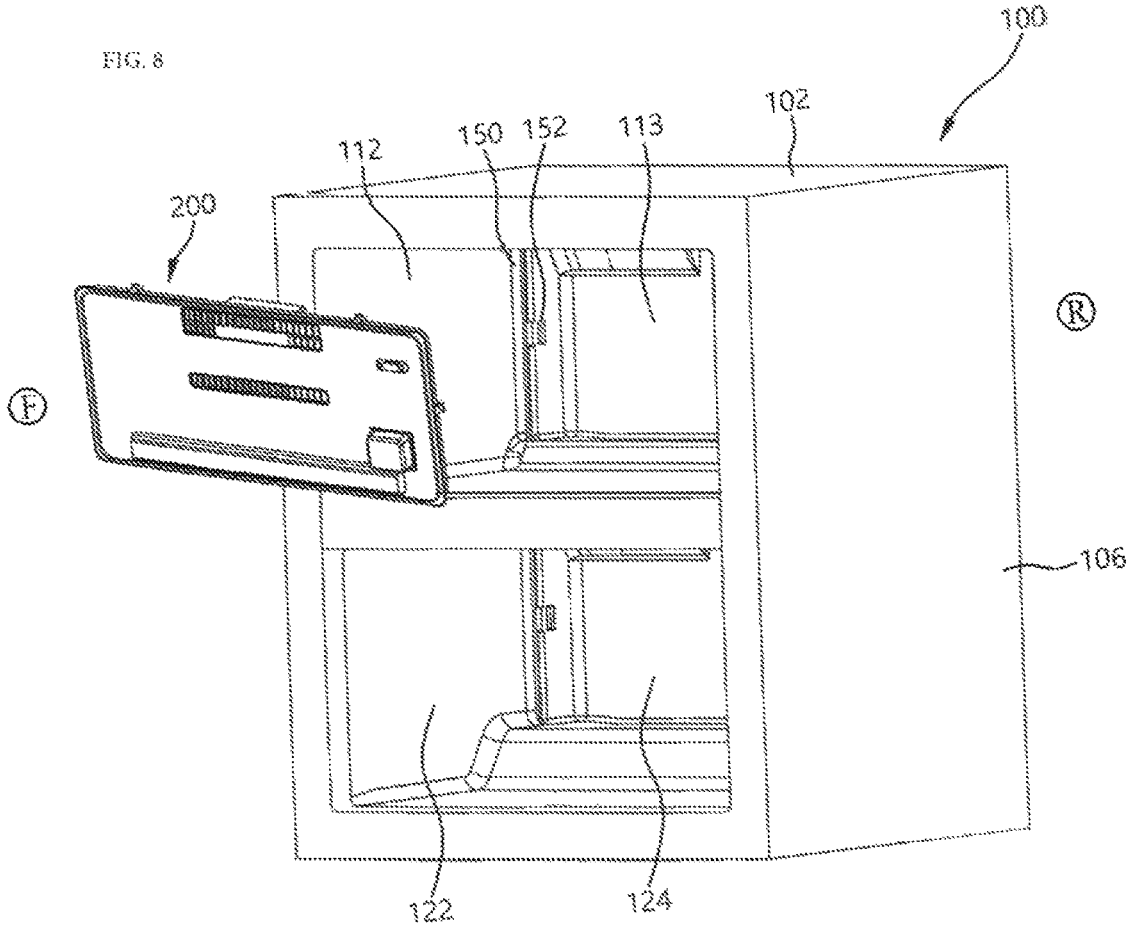
FIG. 8 is a perspective view showing a state in which the grille plate is separated from the outer side of the inner casing constituting the embodiment of the present disclosure.
Figure 9:
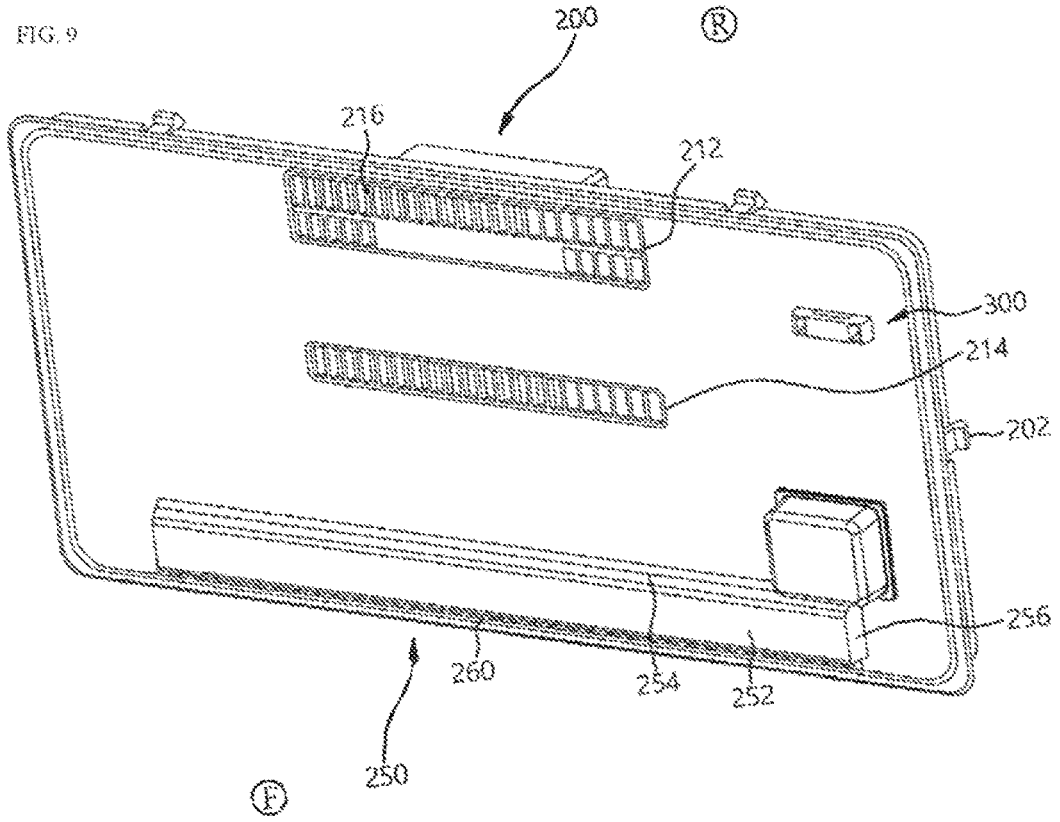
FIG. 9 is a front perspective view showing the grille plate constituting the embodiment of the present disclosure.
Figure 10:
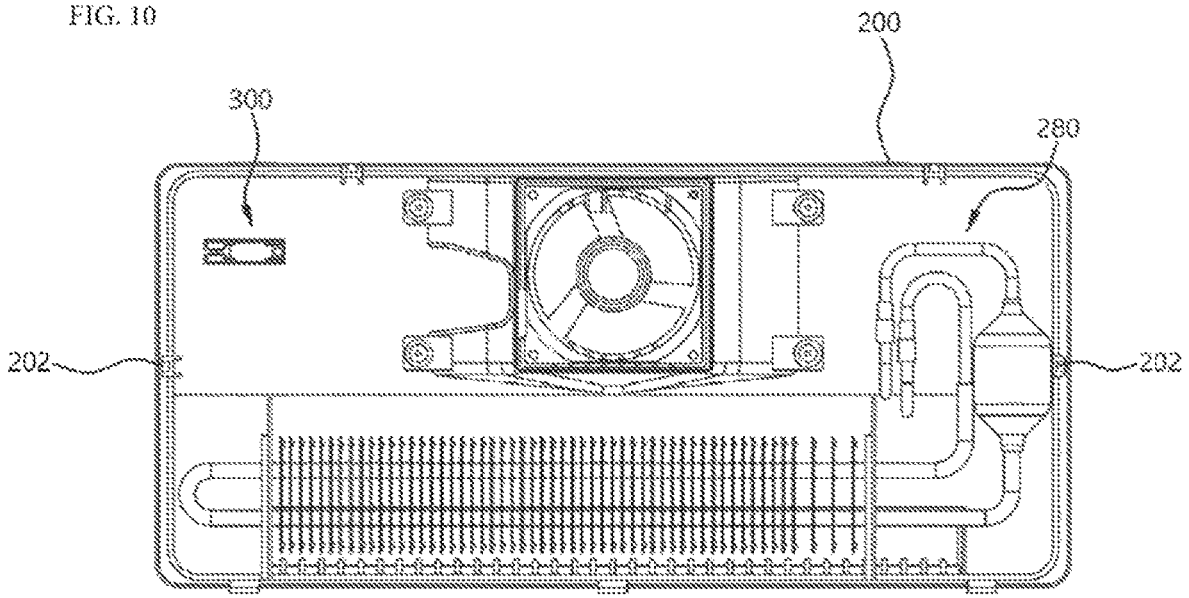
FIG. 10 is a rear view showing a state in which an evaporator is installed on the rear side of the grille plate constituting the embodiment of the present disclosure.
Figure 11:
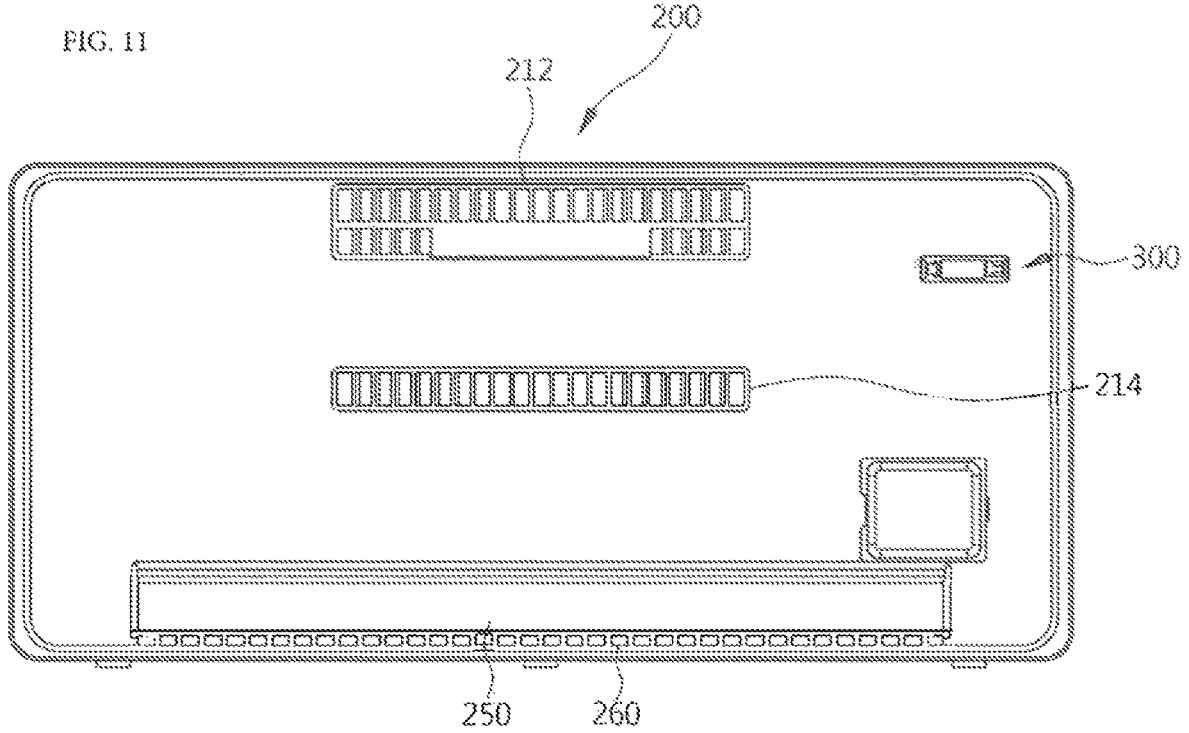
FIG. 11 is a front view showing the configuration of the grille plate constituting the embodiment of the present disclosure.
Figure 12:
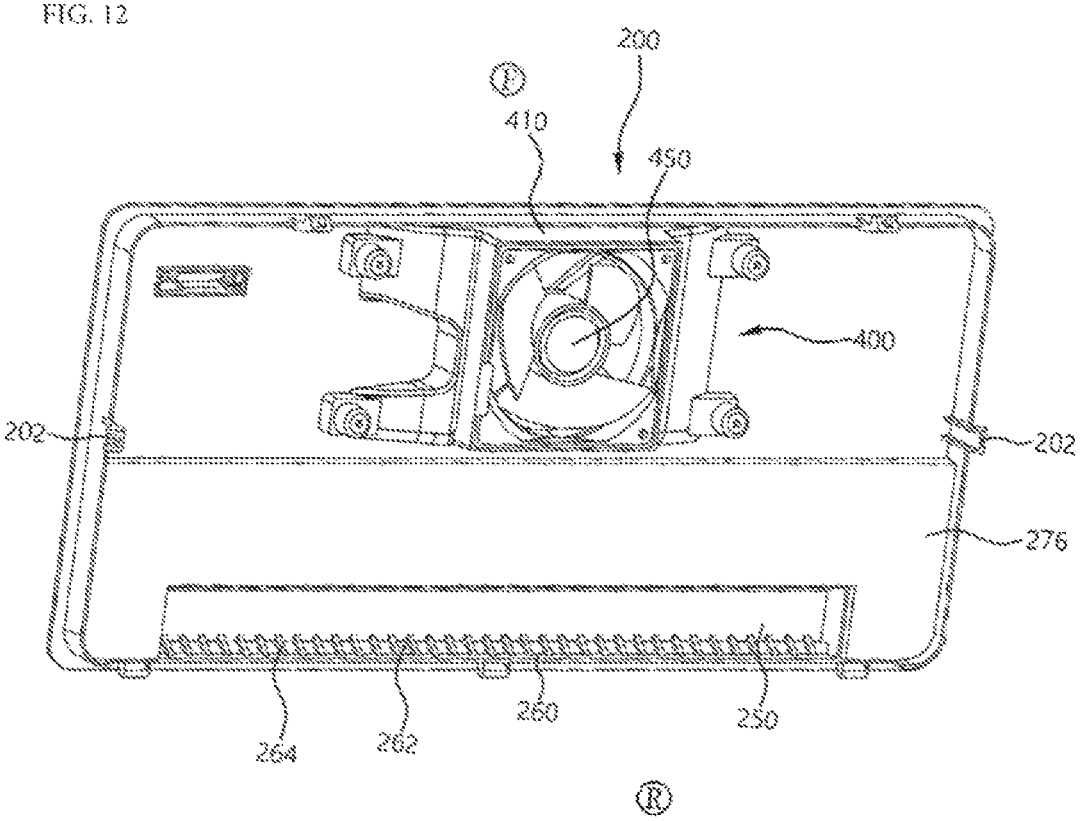
FIG. 12 is a rear perspective view showing a state in which a grille fan module is installed on the rear portion of the grille plate constituting the embodiment of the present disclosure.
Figure 13:
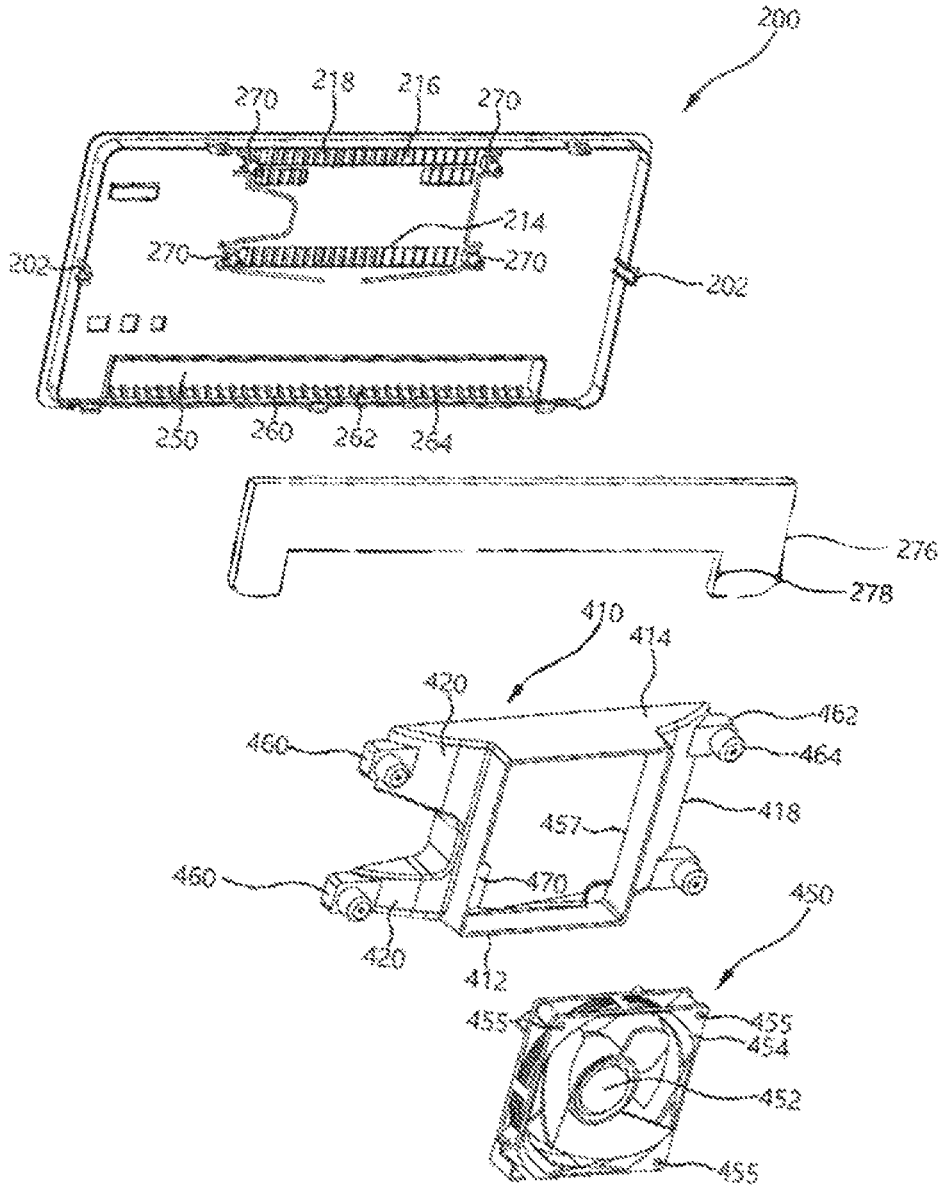
FIG. 13 is an exploded view showing a state in which the grille fan module and a heat insulation member are separated from the grille plate constituting the embodiment of the present disclosure.
Figure 14:
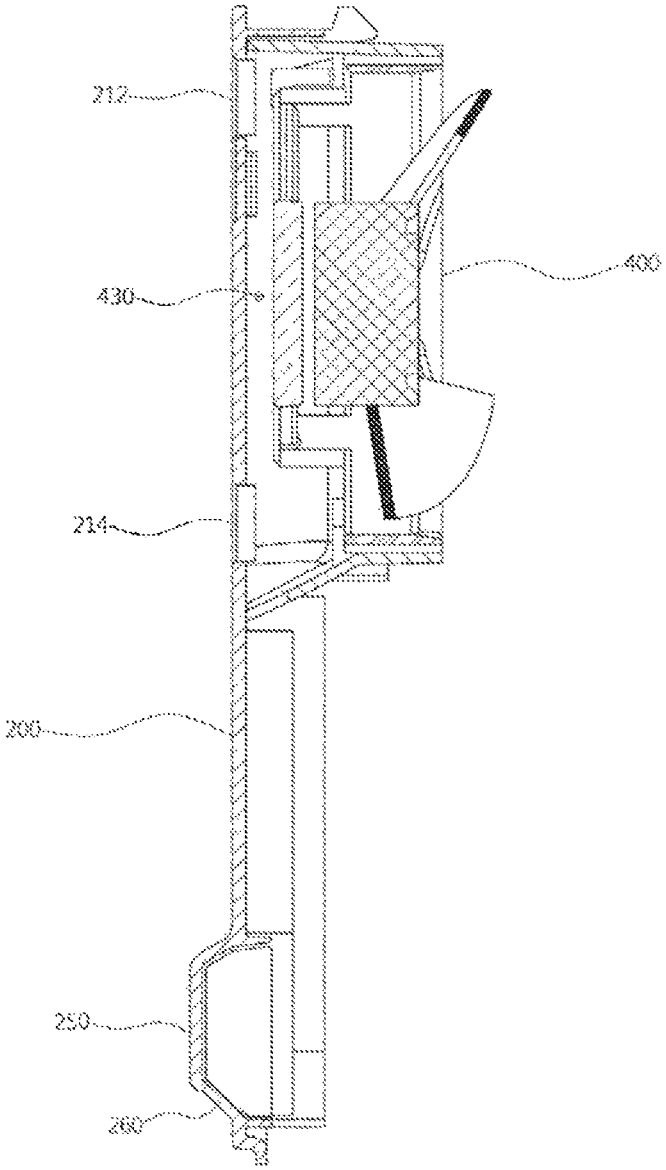
FIG. 14 is a cross-sectional view showing a state in which the grille fan module is coupled to the grille plate constituting the embodiment of the present disclosure.
Figure 15:
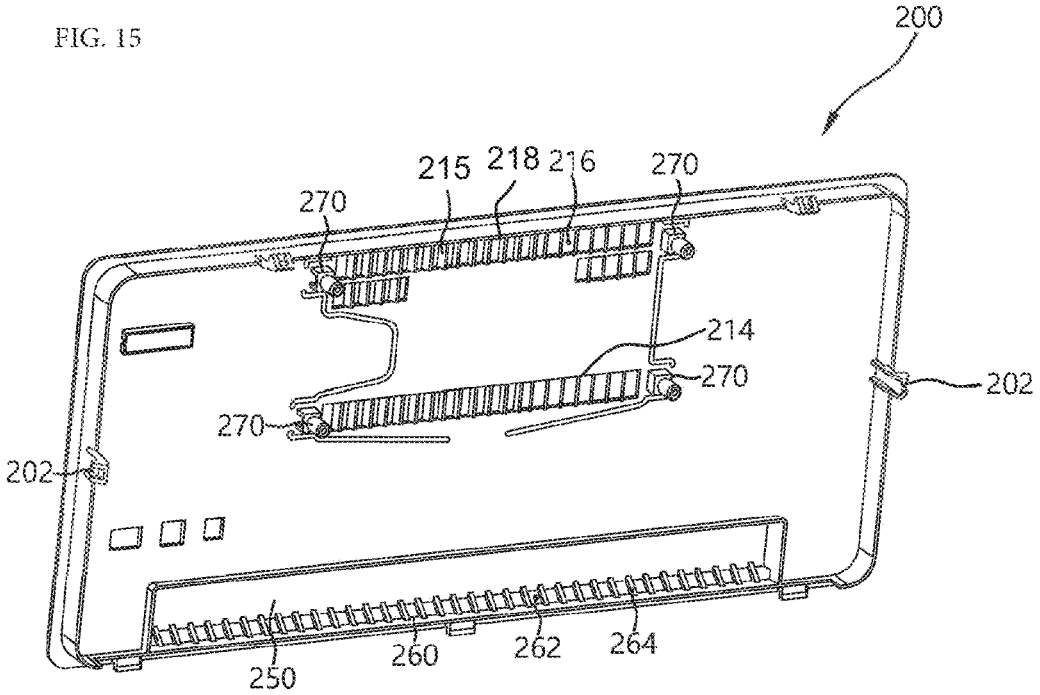
FIG. 15 is a rear perspective view showing the configuration of the grille plate constituting the embodiment of the present disclosure.
Figure 16:
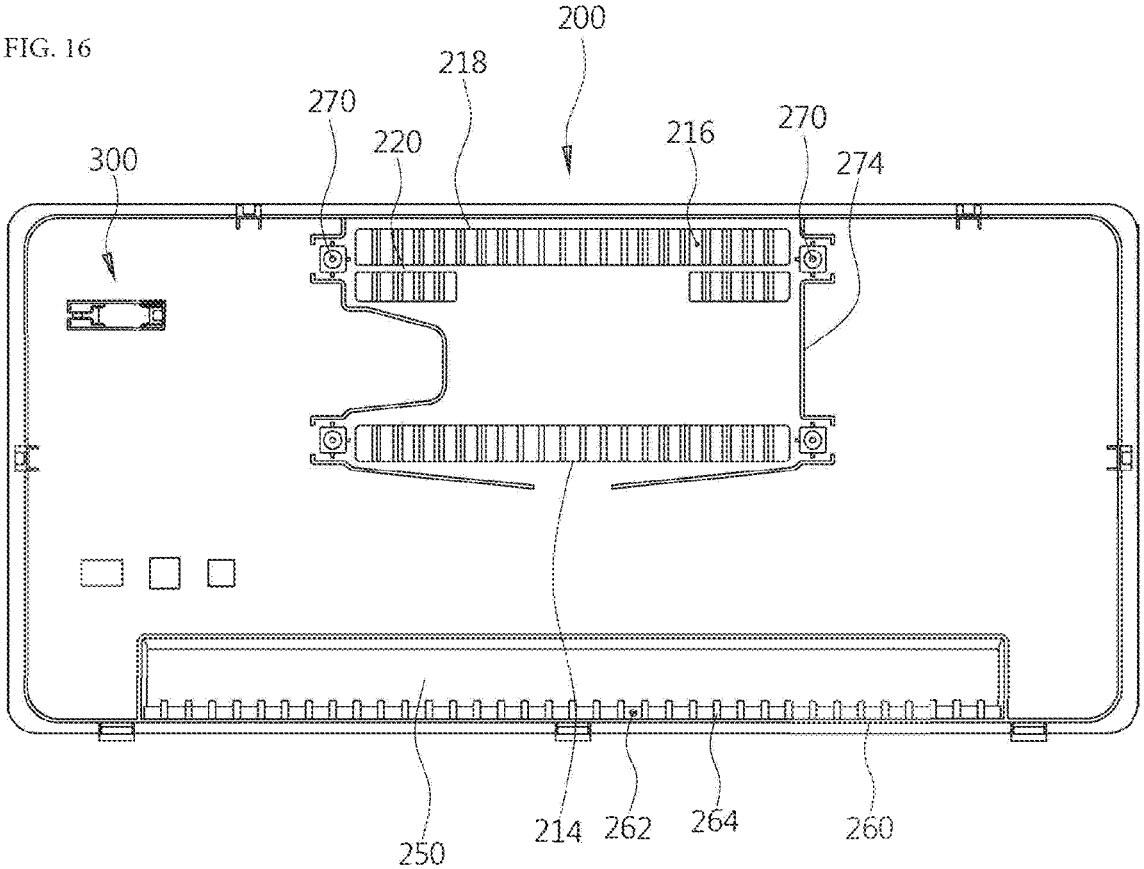
FIG. 16 is a rear view showing the configuration of the grille plate constituting the embodiment of the present disclosure.
Figure 17:
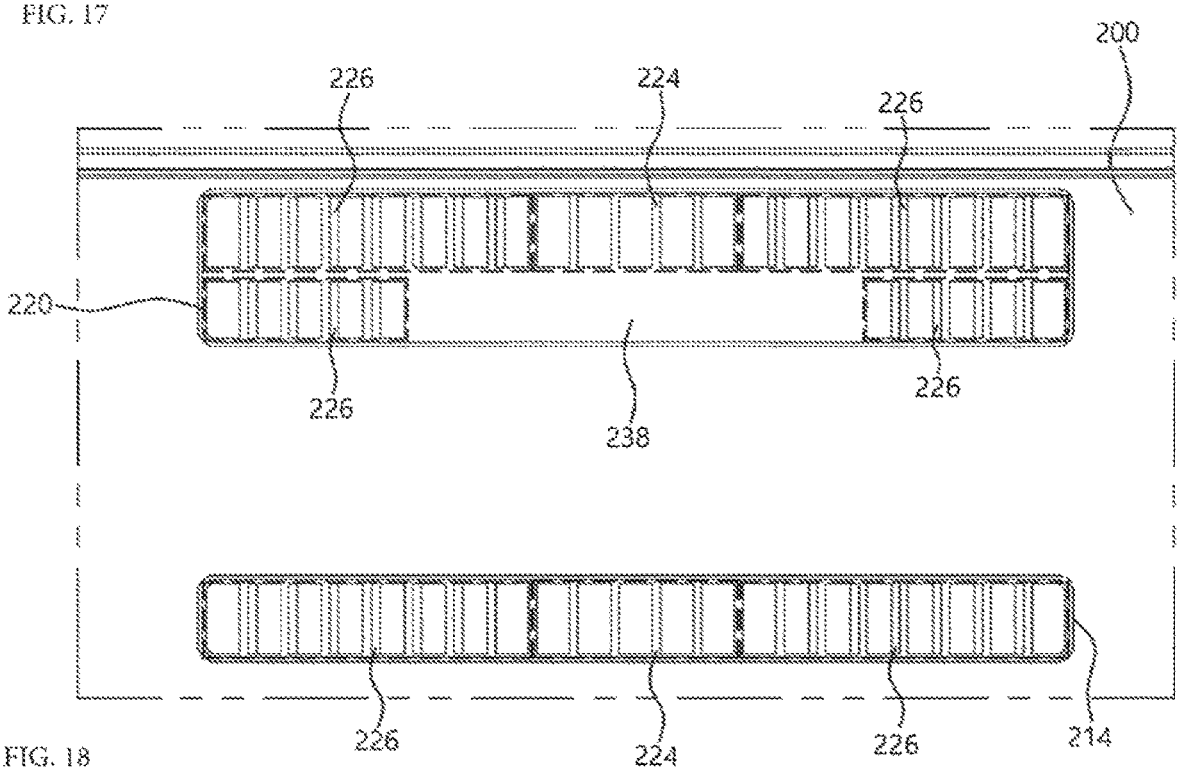
FIG. 17 is an enlarged front view showing the configuration of a vent part constituting the embodiment of the present disclosure.
Figure 18:
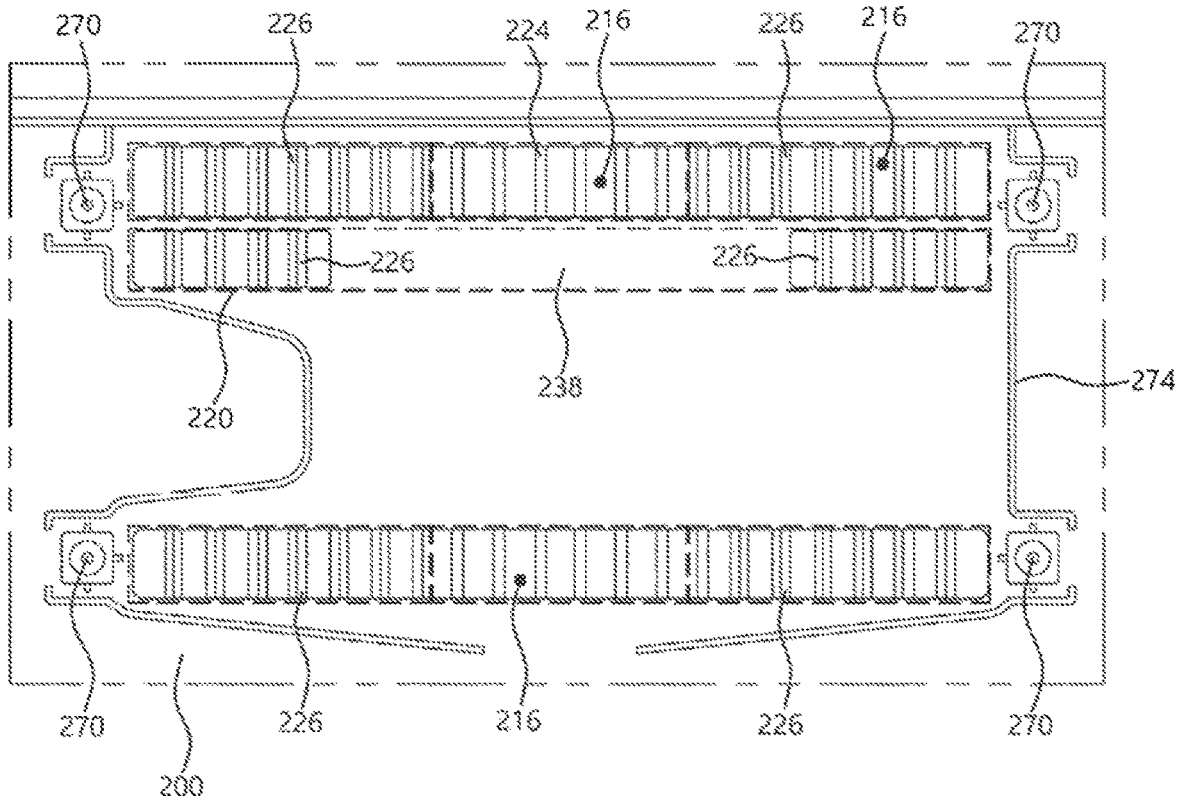
FIG. 18 is an enlarged rear view showing the configuration of the vent part constituting the embodiment of the present disclosure.
Figure 19:
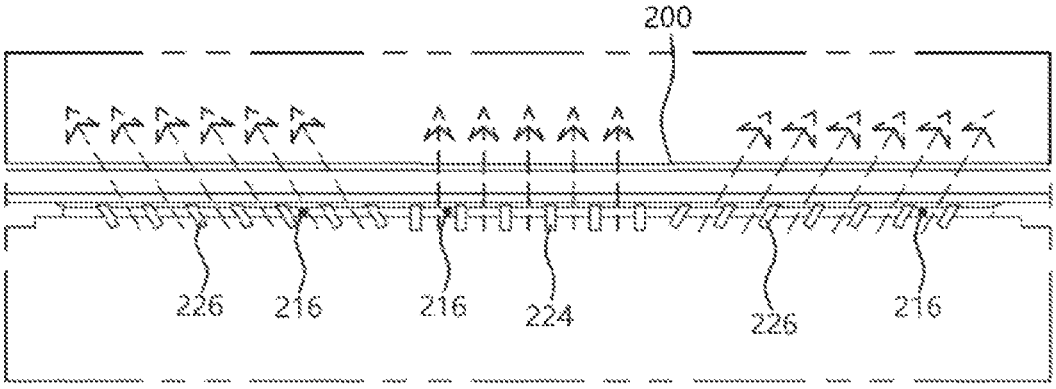
FIG. 19 is a cross-sectional view showing the configuration of a first row vent part constituting the embodiment of the present disclosure.
Figure 20:
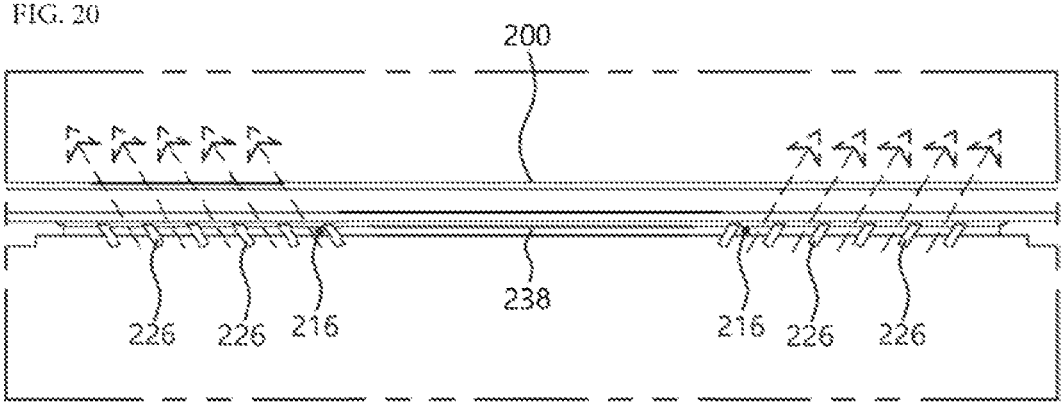
FIG. 20 is a cross-sectional view showing the configuration of a second row vent part constituting the embodiment of the present disclosure.
Figure 21:
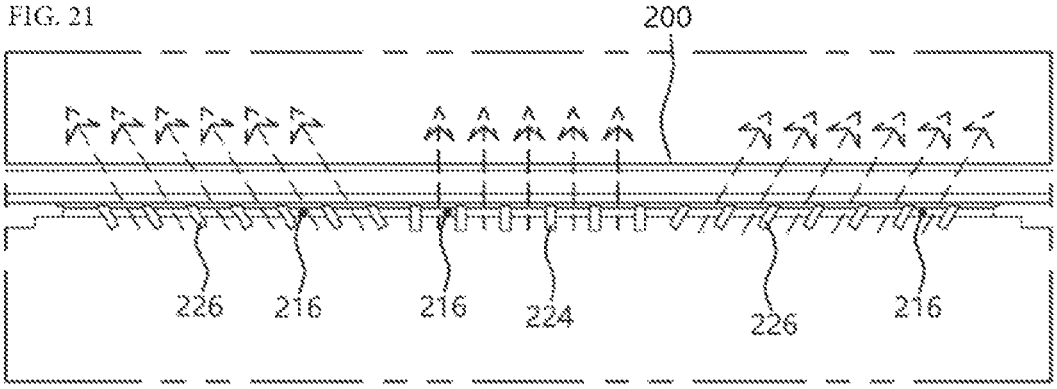
FIG. 21 is a cross-sectional view showing the configuration of a second vent part constituting the embodiment of the present disclosure.

FIG. 7 is a front view showing a state in which a grille plate is installed inside a first inner casing and a second inner casing constituting the embodiment of the present disclosure; FIG. 8 is a perspective view showing a state in which the grille plate is separated from the outer side of the inner casing constituting the embodiment of the present disclosure; FIG. 9 is a front perspective view showing the grille plate constituting the embodiment of the present disclosure; FIG. 10 is a rear view showing a state in which an evaporator is installed on the rear side of the grille plate constituting the embodiment of the present disclosure; FIG. 11 is a front view showing the configuration of the grille plate constituting the embodiment of the present disclosure; FIG. 12 is a rear perspective view showing a state in which a grille fan module is installed on the rear portion of the grille plate constituting the embodiment of the present disclosure; FIG. 13 is an exploded view showing a state in which the grille fan module and a heat insulation member are separated from the grille plate constituting the embodiment of the present disclosure; FIG. 14 is a cross-sectional view showing a state in which the grille fan module is coupled to the grille plate constituting the embodiment of the present disclosure; FIG. 15 is a rear perspective view showing the configuration of the grille plate constituting the embodiment of the present disclosure; FIG. 16 is a rear view showing the configuration of the grille plate constituting the embodiment of the present disclosure; FIG. 17 is an enlarged front view showing the configuration of a vent part constituting the embodiment of the present disclosure; FIG. 18 is an enlarged rear view showing the configuration of the vent part constituting the embodiment of the present disclosure; FIG. 19 is a cross-sectional view showing the configuration of a first row vent part constituting the embodiment of the present disclosure; FIG. 20 is a cross-sectional view showing the configuration of a second row vent part constituting the embodiment of the present disclosure; and FIG. 21 is a cross-sectional view showing the configuration of a second vent part constituting the embodiment of the present disclosure.

Next, a grille plate 200 of the refrigerator according to the embodiment of the present disclosure will be described in detail with reference to FIGS. 7 to 21.

A grille plate 200 is installed inside the first inner casing 114 and the second inner casing 116.

The grille plate 200 is installed in the first and second inner casings 114 and 116 in the same manner. Therefore, here, the description will be made based on the grille plate 200 installed in the first inner casing 114.

A grille mounting jaw 150 is formed on the circumferential surface of the rear side of the inner surface of the first inner casing 114. The grille mounting jaw 150 is formed to protrude by a predetermined height in the left or right direction on each side surface at the back of the first inner casing 114. The front of the grille mounting jaw 150 is where both ends of the grille plate 200, which will be described later, are coupled.

A grille fixing groove 152 is formed on each of left and right wall surfaces of the first inner casing 114 where the first cool air generation part 120 is located. The grille fixing groove 152 is formed to be recessed in the shape of a cuboid at each center of the left and right wall surfaces of the first inner casing 111. The inside of the grille fixing groove 152 is where a main grille fixing end 202 of the grille plate 200 to be described later is inserted and fixed.

The grille plate 200 is installed on the front of the grille mounting jaw 150. The grille plate 200 has a rectangular wall shape, and is installed on the grille mounting jaw 150 to partition the first inner casing 112 into the first storage part 118 and the first cool air generation part 120.

The main grille fixing end 202 is formed on each of the left and right sides of the rear center of the grille plate 200. The main grille fixing end 202 has a hook shape, and is formed to protrude backward from each of the left and right sides of the rear center of the grille plate 200. The main grille fixing end 202 is lock-fixed inside the grille fixing groove 152, so that the grille plate 200 may be firmly fixed to the first inner casing 112.

A vent part 210 and a suction part 260 are formed on the front surface of the grille plate 200. The vent part 210 includes a first vent part 212 and a second vent part 214.

A vent guide rib 215 is installed inside the vent part 210 to guide the venting direction of the cool air blown through the vent part 210.

The vent guide rib 215 includes a first guide rib 224 and a second guide rib 226.

The vent guide rib 215 will be described together with the detailed configuration of the first vent part 212 and the second vent part 214.

The first vent part 212 is formed on the front upper side of the grille plate 200. The first vent part 212 consists of a plurality of vent holes 216 passing through front and back in the front portion of the grille plate 200.

In addition, the first vent part 212 includes a first row vent part 218 and a second row vent part 220.

The first row vent part 218 and the second row vent part 220 are arranged in two rows on the upper front portion of the grille plate 200 in multiple stages. The first row vent part 218 is disposed above the front surface of the grille plate 200, and the second row vent part 220 is disposed under the first row vent part 218.

The first row vent part 218 consists of a plurality of vent holes 216, is formed through front and back in the upper front portion of the grille plate 200, and is arranged in a line on the upper front central portion of the grille plate 200.

The first row vent part 218 is formed through front and back of the grille plate 200 to serve as a passage for guiding the cool air generated by the first and second cool air generation parts 120 and 124 to the upper side of the first and second storage parts 118 and 122.

The vent guide rib 215 is installed between the vent holes 216 of the first row vent part 218. The vent guide rib 215 is made of a wall, is installed between the vent holes 216 and serves as a partition, and guides the spray direction of cool air passing through the first row vent part 218.

The vent guide rib 215 includes the first guide rib 224 and the second guide rib 226.

The first guide rib 224 is made of a wall, as shown in FIG. 17. A plurality of the first guide ribs 224 are arranged at regular intervals in the central portion of the first row vent part 218 to serve as a partition between the vent holes 216.

In addition, the first guide rib 224 is vertically installed in the center of the first row vent part 218 and serves to guide the cool air blown by the grille fan module 400 to the front side, which will be described later.

The second guide rib 226 is installed on the left and right sides of the first guide rib 224. The second guide rib 226 is made of a wall, and a plurality of the second guide ribs 226 are arranged at regular intervals on the left side or the right side of the first row vent part 218, and serve as a partition between the vent holes 216.

In addition, the second guide ribs 226 are installed to be inclined at a predetermined angle in the left or right direction on the left side of the first row vent part 218, and serve to guide the cool air blown by the grille fan module 400 to be described later in the left and right directions of the first storage part 114.

By the structure of the vent holes 216 and the vent guide rib 215 of the first row vent part 218 as described above, cool air vented through the upper front side of the grille plate 200 may be uniformly vented to the entire upper front area of the first and second storage parts 118 and 122.

The second row vent part 220 is formed under the first row vent part 218. The second row vent part 220 consists of a plurality of vent holes 216 and is disposed in a line under the first row vent part 218.

Since the second guide ribs 226 are installed on the left and right sides of the second row vent part 220 in the same manner as in the case of the first row vent part 218, a detailed description will be omitted. The second guide ribs 226 installed on the first row vent part 218 are disposed at the lower end of the first row vent part 218, and guide the cool air blown by the grille fan module 400 to be described later to be discharged in the upper left and right directions of the first and second storage parts 118 and 122.

In addition, a blocking part 238 is formed in the center of the second row vent part 220. The blocking part 238 is a portion where the vent holes 216 are not formed.

The blocking unit 238 is disposed at the lower center of the first row vent part 218 and serves to block cool air from being excessively sprayed to the upper center of the grille plate 200.

The second vent part 214 is formed in the central portion of the grille plate 200. The second vent part 214 is formed of a plurality of vent holes 216 penetrating forward and backward in the front central portion of the grille plate 200, and is arranged in a line in the front center of the grille plate 200.

The second vent part 214 is formed through the front and rear of the central portion of the grille plate 200 to vent cool air toward the center of the first and second storage parts 118 and 122.

The same vent guide rib 215 installed in the first vent part 212 is installed between the vent holes 216 of the second vent part 214. Since the structure of the vent guide rib 215 installed in the second vent part 214 is the same as that of the vent guide rib 215 installed in the first row vent part 218 of the first vent part 212, a detailed description thereof will be omitted.

The first guide rib 224 and the second guide rib 226 identical to those installed in the first row vent part 218 are installed between the plurality of vent holes 216 of the second vent part 214, and guide the cool air passing between the vent holes 216 in the front and left and right directions to the central portion of the first and second storage parts 118 and 122.

By the structure of the vent holes 216 and the vent guide rib 215 of the second vent part 214 as described above, cool air vented through the front center of the grille plate 200 is simultaneously vented in the front and left and right directions, so that cool air may be uniformly vented to the entire central area of the first and second storage parts 118 and 122.

A water droplet blocking part 250 is formed on the lower front surface of the grille plate 200. The water droplet blocking part 250 is made of a wall and is formed long left and right. The water droplet blocking part 250 includes: a front blocking wall 252 installed at a predetermined distance to the front of the grille plate 200 by a predetermined distance; a guide wall 254 formed to be inclined at a predetermined angle along the upper surface of the front blocking wall 252, with one end connected to the front blocking wall 252 and the other end connected to the front surface of the grille plate 200; and a side blocking wall 256 installed on each side of the front blocking wall 252, with one end thereof connected to the side of the front blocking wall 252 and the other end connected to the front side of the grille plate 200 to close both sides of the front blocking wall 252.

The front blocking wall 252 is made in the form of a rectangular plate, is formed long left and right, and is installed at a predetermined distance on the front side of the grille plate 200. The front blocking wall 252 is located in front of the suction unit 260 to be described later and blocks water droplets from flowing into the suction part 260 to be described later through the front side of the grille plate 200.

In addition, a discharge space through which cool air is discharged is formed between the front surface of the grille plate 200 and the front blocking wall 252 by being spaced apart from the front side of the front blocking wall 252 by a predetermined distance.

The guide wall 254 is formed on the upper side of the front blocking wall 252. The guide wall 254 is made of a wall and is installed to be inclined at a predetermined angle along the upper side of the front blocking wall 252. One end of the guide wall 254 is connected to the grille plate 200, and the other end is connected to the upper end of the front blocking wall 252.

The guide wall 254 closes the upper end of the front blocking wall 252, and serves to prevent water droplets generated due to a temperature difference on the front portion of the grille plate 200 from falling downward and flowing into the suction part 260, which will be described later.

The guide wall 254 is made of an inclined surface, and guides water droplets flowing down along the front portion of the grille plate 200 toward the front blocking wall 252.

The side blocking wall 256 is formed on each side of the guide wall 254. The side blocking wall 256 is made of a wall, and is formed at opposite ends of the front blocking wall 252. One end of the side blocking wall 256 is connected to the side of the front blocking wall 252, and the other end is connected to the front side of the grille plate 200. The side blocking wall 256 is formed between the front blocking wall 252 and the grille plate 200, and serves to close the open space between the front blocking wall 252 and the front portion of the grille plate 200.

By the structure of the water droplet blocking part 250 as described above, water droplets are prevented from flowing into the suction part 260 to be described later by the water droplet blocking part 250 even if water droplets generated on the front part of the grille plate 200 fall downward along the front part of the grille plate 200.

The suction part 260 is formed inside the water droplet blocking part 250. The suction part 260 includes a plurality of discharge holes 262 that are vertically penetrating inside the water droplet blocking part 250.

The suction part 260 is formed inside the water droplet blocking part 250, so that the cool air circulated in the first and second storage parts 118 and 122 is moved to the lower portion of the first and second storage parts 118 and 122, and is guided toward the first and second cool air generation parts 120 and 124 through the suction part 260.

A discharge guide rib 264 is installed between the discharge holes 262 of the suction part 260. The discharge guide rib 264 is formed in the shape of a bar having a rectangular cross section, and is formed long front and back. The discharge guide rib 264 is installed to be inclined upward at a predetermined angle between the discharge holes 262. One end of the discharge guide rib 264 is connected to the lower end of the rear surface of the front blocking wall 252, and the other end is connected to the lower front of the grille plate 200.

The discharge guide rib 264 guides the cool air flowing into the suction part 260 in the diagonal direction of the upper side of the first and second cool air generation parts 120 and 124, so that the moving distance through which the cool air is discharged is shortened, and thus, the time for discharging the cool air may be shortened and the cooling air discharge efficiency may be improved.

It is preferable that the vent area of the vent part 210 and the discharge area of the suction part 260 have the same area. This is because when either the vent area for venting cool air to the first and second storage parts 118 and 122 or the discharge area for discharging cool air to the outside of the first and second storage parts 118 and 122 is formed to be relatively larger, various problems arise.

For example, when the vent area of the vent part 210 is formed to be larger than the discharge area of the suction part 260, the venting amount of cool air increases and the internal pressure of the first and second storage parts 118 and 122 increases, and as a result, the first and second storage parts 118 and 122 are deformed and cooling efficiency is lowered because cool air is not smoothly generated by the evaporator 280.

In addition, when the discharge area of the suction part 260 is larger than the vent area of the vent part 210, the discharge amount of cool air is increased compared to the venting amount of cool air, and the grille fan member 450 to be described later for supplying cool air continuously operates. Accordingly, the energy efficiency of the refrigerator decreases, and the cooling efficiency of the first and second storage parts 118 and 122 decreases.

In order to solve the above problems, it is suggested that the vent area of the vent part 210 and the discharge area of the suction part 260 of the refrigerator according to the present disclosure are formed in the same ratio.

A fastening boss 270 is formed on the rear surface of the grille plate 200. The fastening boss 270 has a cylindrical shape and is formed to protrude backward from the rear surface of the grille plate 200. The fastening boss 270 is formed in each corner of the rear portion of the grille plate 200 where the grille fan module 400 to be described later is installed.

A fastening screw hole 272 is formed inside the fastening boss 270. A shroud fixing part 460 of the grille fan module 400 to be described later is mounted on the outer peripheral surface of the fastening boss 270 and is fixed by a fastening screw (not shown).

A grille fan installation guide rib 274 is formed on the rear surface of the grille plate 200. The grille fan installation guide rib 274 is formed to protrude toward the rear side of the grille plate 200 by a predetermined height along the outside of the vent part 210.

The grille fan installation guide rib 274 is formed to protrude along the front edge of the shroud 410 to be described later, and is a portion on which the front part of the shroud 410 to be described later is mounted.

A thermal insulation foam 276 is attached to the rear surface of the grille plate 200. As shown in FIG. 13, the thermal insulation foam 276 is made of a PU foam material, and is formed in the shape of a rectangular plate having a predetermined thickness. The thermal insulation foam 276 is attached to the lower rear surface of the grille plate 200 to prevent the cool air of the evaporator 280 from being directly transferred to the grille plate 200, which will be described later.

A discharge guide groove 278 is formed in the lower part of the thermal insulation foam 276. The discharge guide groove 278 is a portion that is long cut left and right along the lower back of the thermal insulation foam 276. When the thermal insulation foam 276 is attached to the lower rear surface of the grille plate 200, the discharge guide groove 278 guides the cool air flowing into the cool air generation parts 120 and 124 through the suction part 260 toward the evaporator 280 to be described later.

The evaporator 280 is installed on the rear surface of the thermal insulation foam 276. The evaporator 280 is a typical evaporator (EVA) and a detailed description thereof will be omitted. The evaporator 280 serves to cool the cool air flowing into the first and second cool air generation parts 120 and 124.

Figure 22:
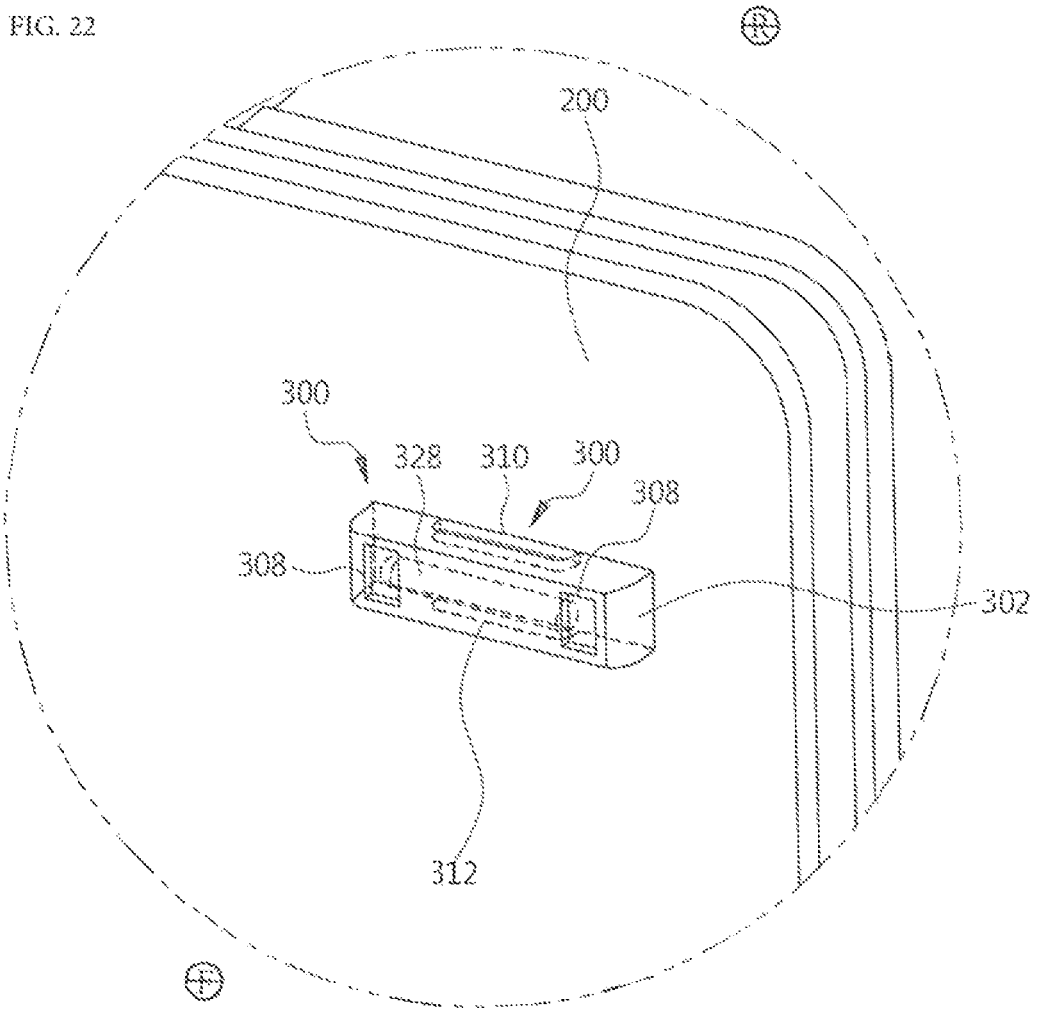
FIG. 22 is a front enlarged perspective view showing the configuration of an internal sensor module constituting the embodiment of the present disclosure.
Figure 23:
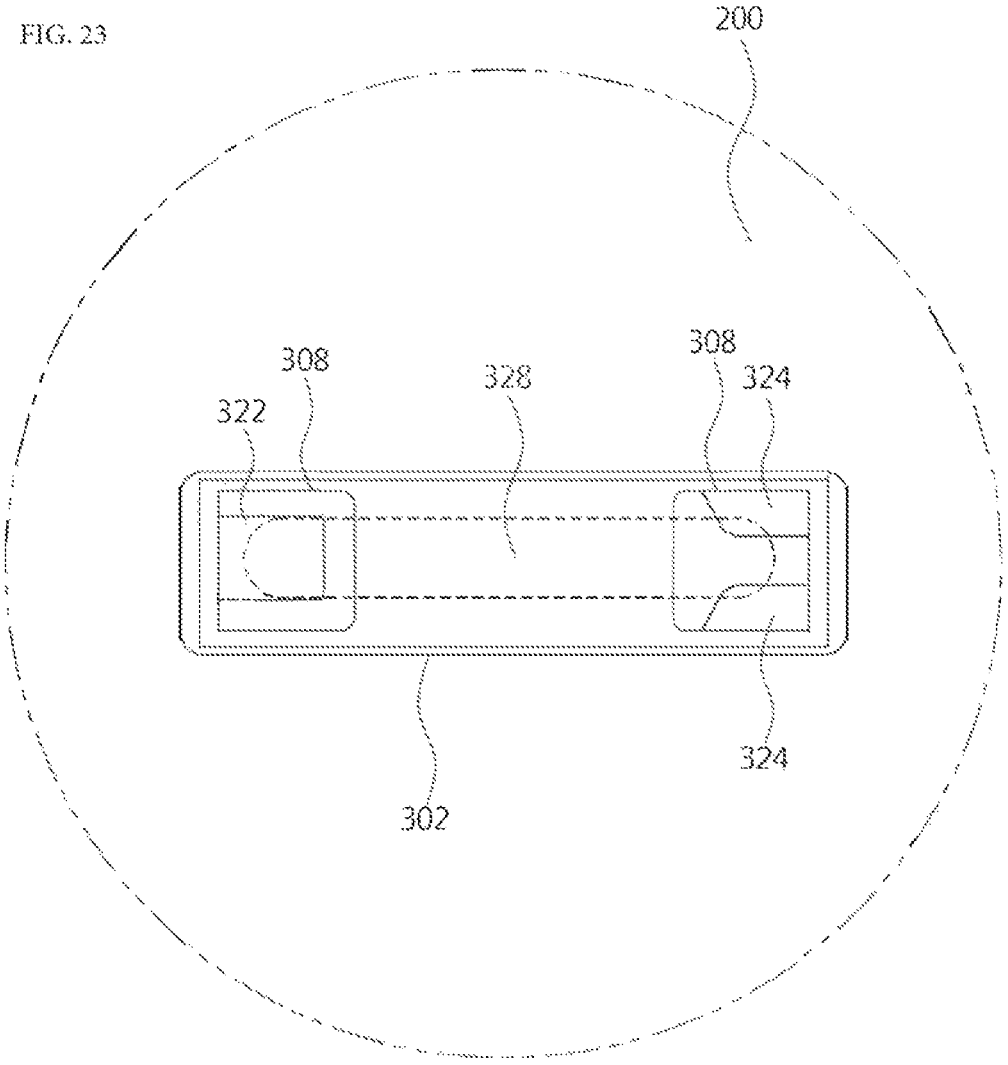
FIG. 23 is a front view showing the configuration of the internal sensor module constituting the embodiment of the present disclosure.
Figure 24:
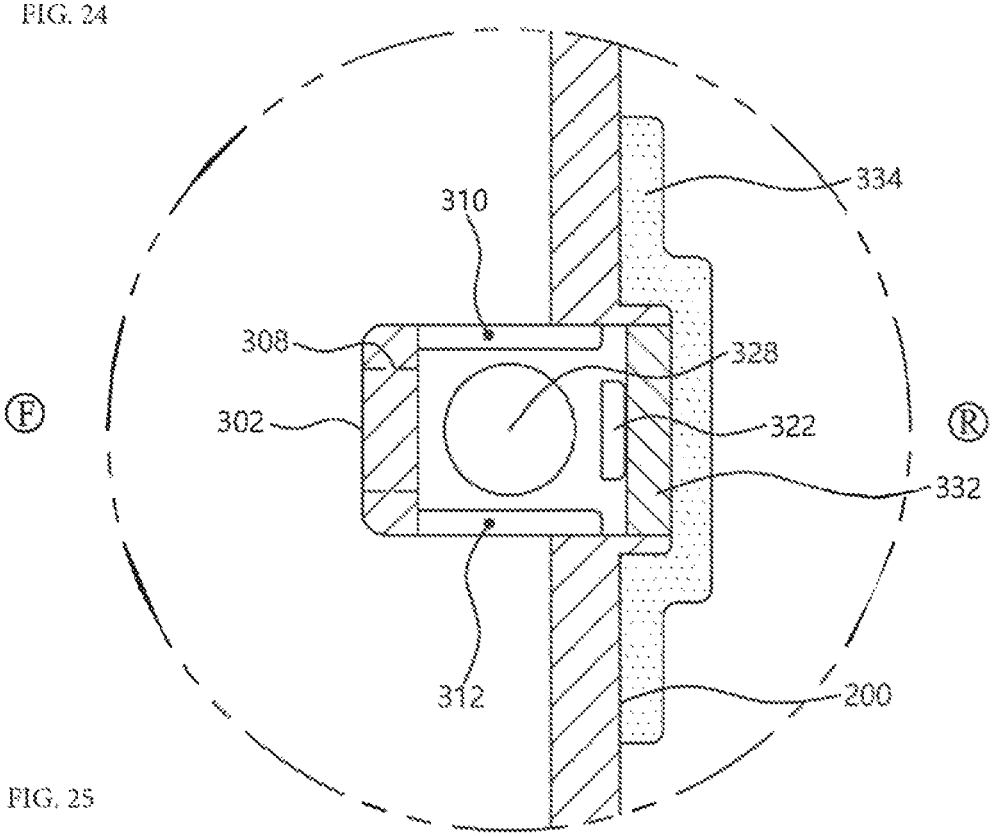
FIG. 24 is a cross-sectional view showing the configuration of the internal sensor module constituting the embodiment of the present disclosure.
Figure 25:
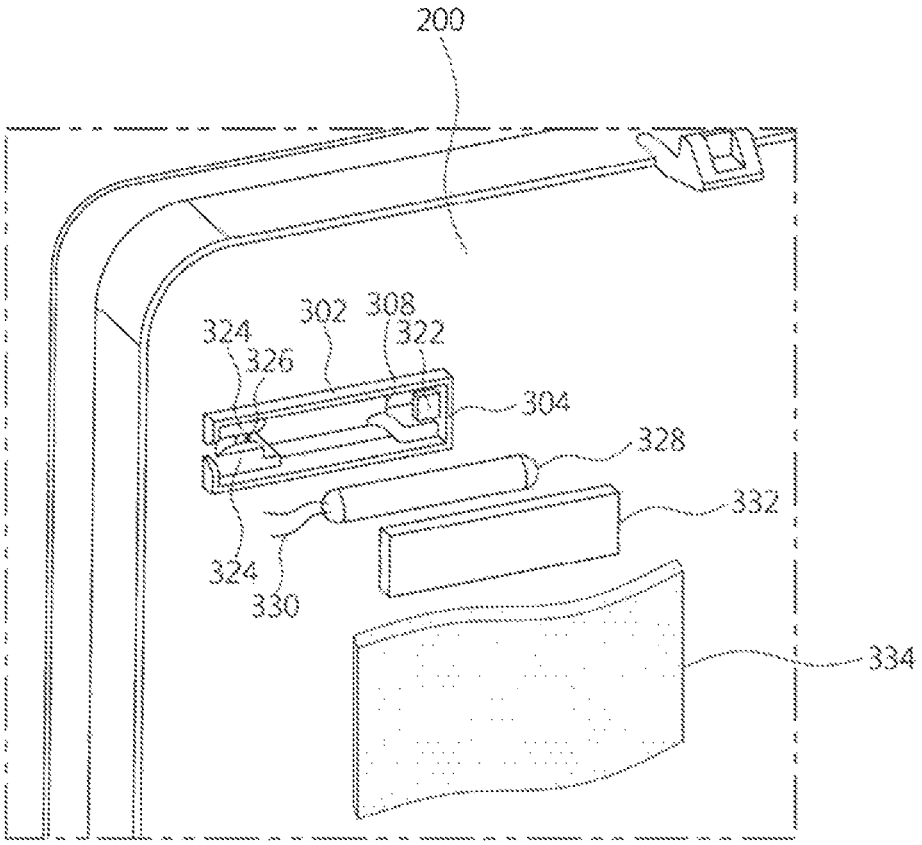
FIG. 25 is an exploded perspective view showing the configuration of the internal sensor module constituting the embodiment of the present disclosure.
Figure 26:
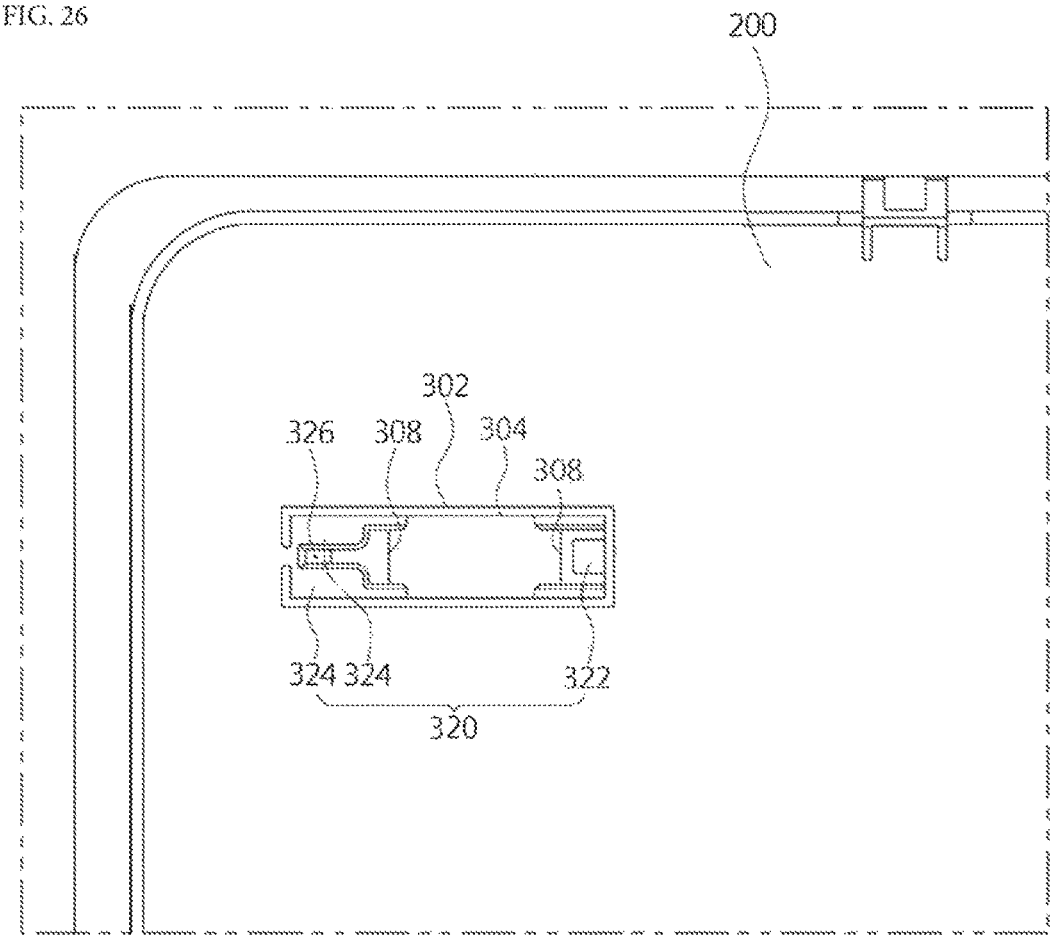
FIG. 26 is a rear view showing the configuration of a sensor mounting part constituting the embodiment of the present disclosure.

FIG. 22 is a front enlarged perspective view showing the configuration of an internal sensor module constituting the embodiment of the present disclosure; FIG. 23 is a front view showing the configuration of the internal sensor module constituting the embodiment of the present disclosure; FIG. 24 is a cross-sectional view showing the configuration of the internal sensor module constituting the embodiment of the present disclosure; FIG. 25 is an exploded perspective view showing the configuration of the internal sensor module constituting the embodiment of the present disclosure; and FIG. 26 is a rear view showing the configuration of a sensor mounting part constituting the embodiment of the present disclosure.

Next, an internal sensor module 300 of the refrigerator according to the embodiment of the present disclosure will be described in detail with reference to FIGS. 22 to 26.

An internal sensor module 300 is installed on the front of the grille plate 200. The internal sensor module 300 includes a sensor mounting part 302, a temperature sensing hole 306, and a temperature sensor 328.

The sensor mounting part 302 is integrally formed with the grille plate 200, is formed in the shape of a cuboid with a hollow inside, and is formed long left and right on the upper right side of the front side of the grille plate 200 (see FIG. 22). The sensor mounting part 302 is formed to protrude toward the front side of the grille plate 200, and is a portion in which the temperature sensor 328 to be described later is mounted (see FIGS. 22 and 24).

A sensor mounting groove 304 is formed on the rear surface of the sensor mounting part 302. The sensor mounting groove 304 is formed in the shape of a cuboid, is formed long left and right, and is recessed toward the front side of the sensor mounting part 302. The temperature sensor 328 to be described later is inserted into the sensor mounting groove 304, and is a portion fixed to the grille plate 200.

That is, the temperature sensor 328 to be described later may be installed inside the sensor mounting part 302 through the opening of the sensor mounting groove 304.

The sensor mounting part 302 and the grille plate 200 are not formed integrally, but may be manufactured and assembled as separate parts. However, here, a structure in which the sensor mounting part 302 and the grille plate 200 are integrally formed is applied in order to reduce the number of assembly parts and simplify the manufacturing process.

Temperature sensing holes 306 are formed in the front and upper and lower sides of the sensor mounting part 302. The temperature sensing hole 306 includes a front temperature sensing hole 308 and upper and lower side temperature sensing holes 310 and 312.

The front temperature sensing hole 308 is formed on the front surface of the sensor mounting part 302. The front temperature sensing hole 308 is formed in the shape of a square box as shown in FIG. 22, and is formed through both front and rear sides of the sensor mounting part 302, respectively. The front temperature sensing hole 308 communicates with the sensor mounting groove 304 to guide the cool air of the first and second storage parts 118 and 122 into the sensor mounting part 302.

Upper and lower surface temperature sensing holes 310 and 312 are formed in upper and lower surfaces of the sensor mounting part 302. The upper and lower surface temperature sensing holes 310 and 312 have a rectangular shape, are formed long left and right, and are formed vertically through the upper and lower surfaces of the sensor mounting part 302. The upper and lower surface temperature sensing holes 310 and 312 communicate with the sensor mounting groove 304 to guide the cool air of the first and second storage parts 118 and 122 into the sensor mounting part 302 through the upper and lower surfaces of the sensor mounting part 302.

A temperature sensor fixing end 320 is formed inside the sensor mounting groove 304. The temperature sensor fixing end 320 includes a first temperature sensor fixing end 322 and a second temperature sensor fixing end 324.

As shown in FIG. 25, the first temperature sensor fixing end 322 is made of a square plate, and is formed to protrude in the left direction on the inner right side of the sensor mounting groove 304. The first temperature sensor fixing end 322 is formed to be spaced apart from the inner front surface of the sensor mounting groove 304 by a predetermined distance. When the temperature sensor 328 to be described later is inserted into the sensor mounting groove 304, the first temperature sensor fixing end 322 is a portion lock fixed to the right end of the temperature sensor 328 to be described later.

The second temperature sensor fixing end 324 is made of a rectangular plate, and is formed to protrude upward or downward, respectively, on the upper and lower sides of the inner left side surface of the sensor mounting groove 304. The second temperature sensor fixing end 324 is formed to be spaced apart by a predetermined distance from the inner front and rear sides of the sensor mounting groove 304, and when the temperature sensor 328 to be described later is inserted into the sensor mounting groove 304, the second temperature sensor fixing end 324 is a portion lock fixed to the left end of the temperature sensor 328 to be described later.

A wire hole 326 is formed between the second temperature sensor fixing ends 324. The wire hole 326 is an empty space between the different second temperature sensor fixing ends 324, and is a portion for guiding a sensor connection wire 330 to the outside of the sensor mounting groove 304 when the temperature sensor 328 to be described later is inserted into the sensor mounting groove 304.

The temperature sensor 328 is installed inside the sensor mounting groove 304. The temperature sensor 328 is a typical temperature sensor and a detailed description thereof will be omitted. The temperature sensor 328 is formed in a cylindrical shape and is formed long left and right. The temperature sensor 328 is installed long left and right inside the sensor mounting groove 304. The temperature sensor 328 is installed in the sensor mounting part 302 protruding toward the front side of the grille plate 200, so that the internal temperature of the first and second storage parts 118 and 122 may be detected more accurately.

In the method of mounting the temperature sensor 328 inside the sensor mounting groove 304, first, one end of the temperature sensor 328 is inserted into the front side of the first temperature sensor fixing end 322 or the second temperature sensor fixing end 324. In a state in which one end of the temperature sensor 328 is positioned in front of the first temperature sensor fixing end 322 or the second temperature sensor fixing end 324, the temperature sensor 328 may be inserted and fixed inside the sensor mounting groove 304 by sliding the temperature sensor 328 in the left or right direction.

The sensor connection wire 330 is installed at one end of the temperature sensor 328. The sensor connection wire 330 is a typical wire and a detailed description thereof will be omitted. The sensor connection wire 330 is installed at the end of the temperature sensor 328, and is discharged to the outside of the sensor mounting groove 304 through the wire hole 326.

The sensor connection wire 330 is connected to a controller (not shown) of the refrigerator, supplies power to the temperature sensor 328, and transmits a detection value of the temperature sensor 328 to the controller.

A blocking plate 332 is installed in the open portion of the sensor mounting groove 304. The blocking plate 332 is formed in a shape corresponding to the open portion of the sensor mounting groove 304, and is inserted into the sensor mounting groove 304. The blocking plate 332 closes the opening portion of the sensor mounting groove 304, and serves to block the cool air flowing into the temperature sensor 328 side through the opening portion of the sensor mounting groove 304.

That is, by closing the opening portion of the sensor mounting groove 304, the blocking plate 332 prevents the cool air of the first and second cool air generation parts 120 and 124 disposed on the rear side of the grille plate 200 from flowing into the temperature sensor 328 side.

Due to this blocking structure of the blocking plate 332, it is possible to prevent a malfunction of the temperature sensor 328 and a decrease in temperature sensing accuracy as the cool air of the evaporator 280 disposed on the rear side of the grille plate 200 flows into the temperature sensor 328 side.

A heat insulation member 334 is installed on the rear surface of the blocking plate 332. The heat insulation member 334 is made of a PU foam material, and is formed of a flexible material. The heat insulation member 334 is formed to have a larger area than that of the sensor mounting groove 304. A double-sided adhesive tape (not shown) is attached to the front surface of the heat insulation member 334 so that the heat insulation member 334 is attached to the grille plate 200 to cover the open portion of the sensor mounting groove 304.

The heat insulation member 334 fixes the blocking plate 332 to the sensor mounting groove 304 and at the same time, additionally blocks the inflow of cool air of the evaporator 280 from the rear side of the grille plate 200 through the opening portion of the sensor mounting groove 304.

In the internal sensor module 300, more accurate temperature sensing of the first and second storage parts 118 and 122 may be achieved since the temperature sensor 328 is installed inside the sensor mounting part 302 protruding toward the front side of the grille plate.

In addition, the internal sensor module 300 widens the distance to the evaporator 280 installed on the rear side (the cool air generation part side) of the grille plate 200 as far as possible since the internal sensor module 300 is installed in the horizontal direction on the front side of the grille plate 200, and thus, it is possible to prevent a malfunction of the temperature sensor 328 generated by the evaporator 280 and a decrease in sensing accuracy.

In addition, as the internal sensor module 300 is installed on the rear left upper part of the grille plate 200, the internal sensor module 300 is positioned as far away from the installation position of the evaporator 280 as possible, and thus, it is possible to minimize a sensing error according to the external environment of the temperature sensor 328 caused by the cool air of the evaporator 280.

Figure 27:
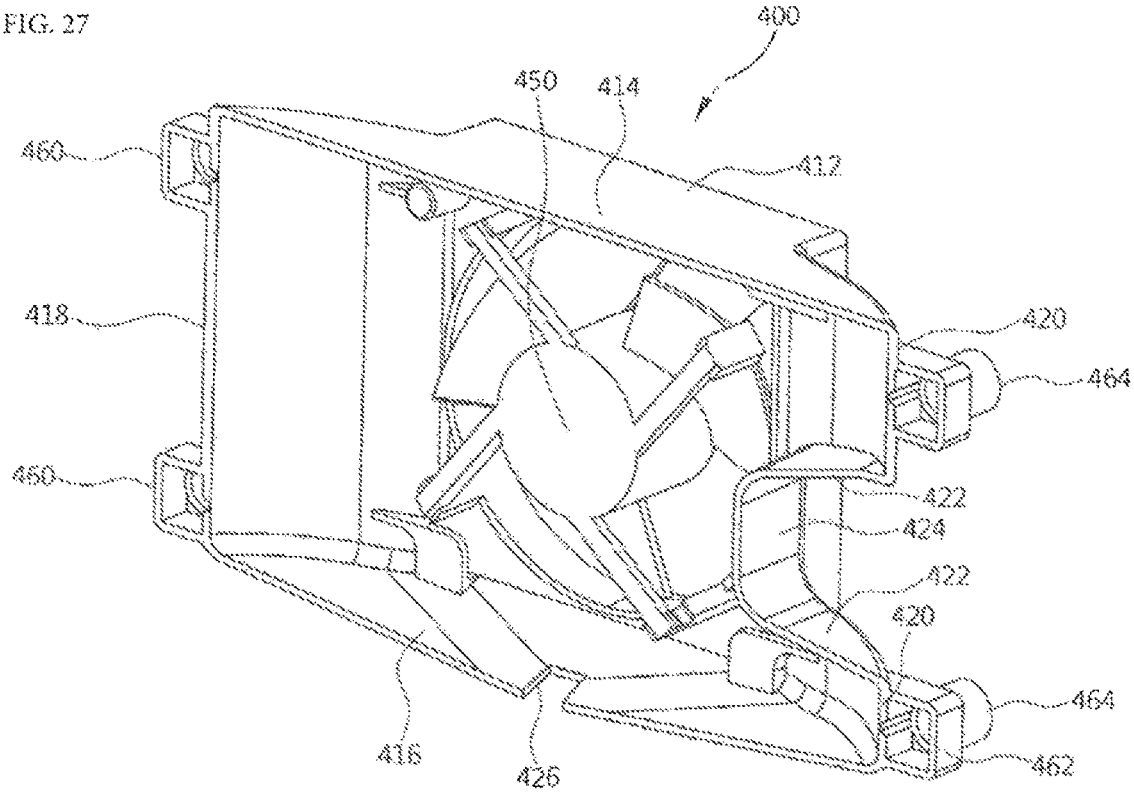
FIG. 27 is a front perspective view showing the configuration of the grille fan module constituting the embodiment of the present disclosure.
Figure 28:
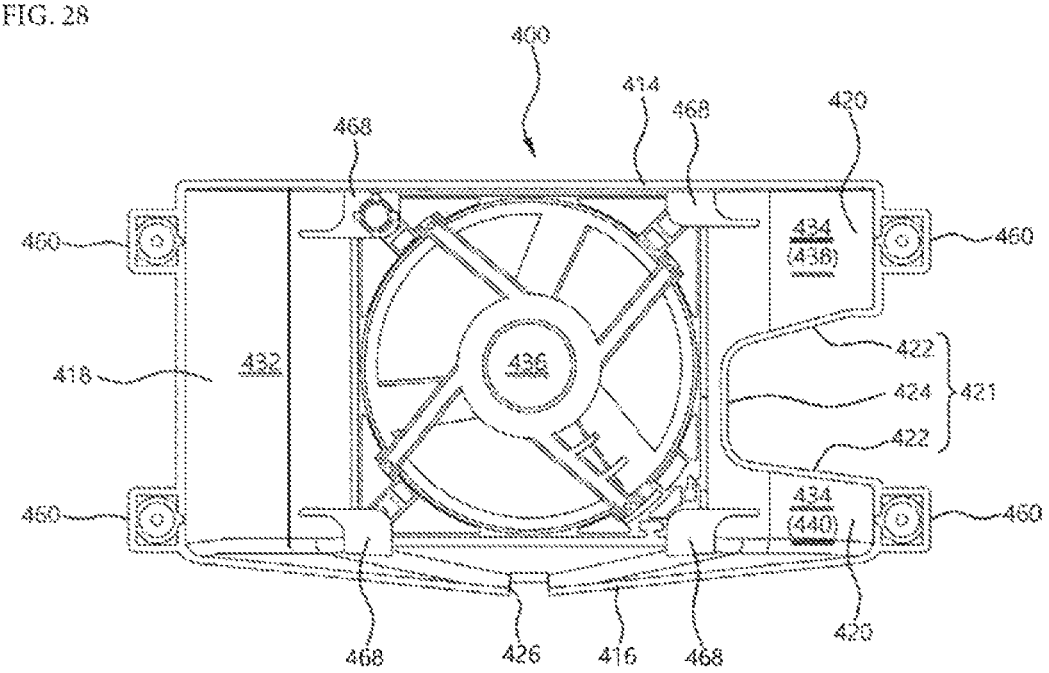
FIG. 28 is a front view showing the configuration of the grille fan module constituting the embodiment of the present disclosure.
Figure 29:
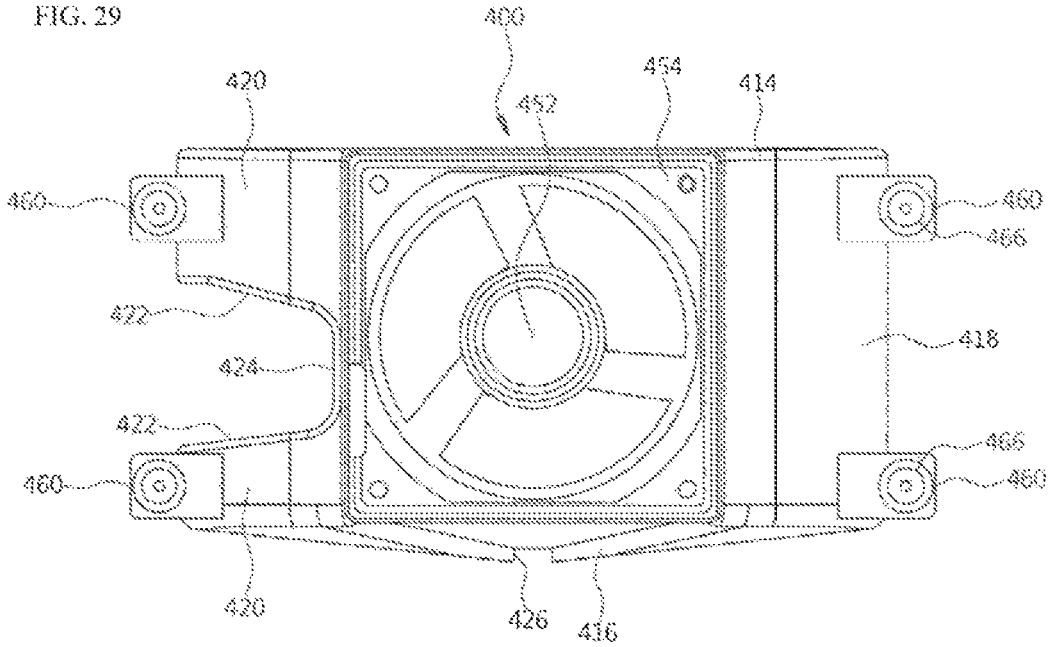
FIG. 29 is a rear view showing the configuration of the grille fan module constituting the embodiment of the present disclosure.
Figure 30:
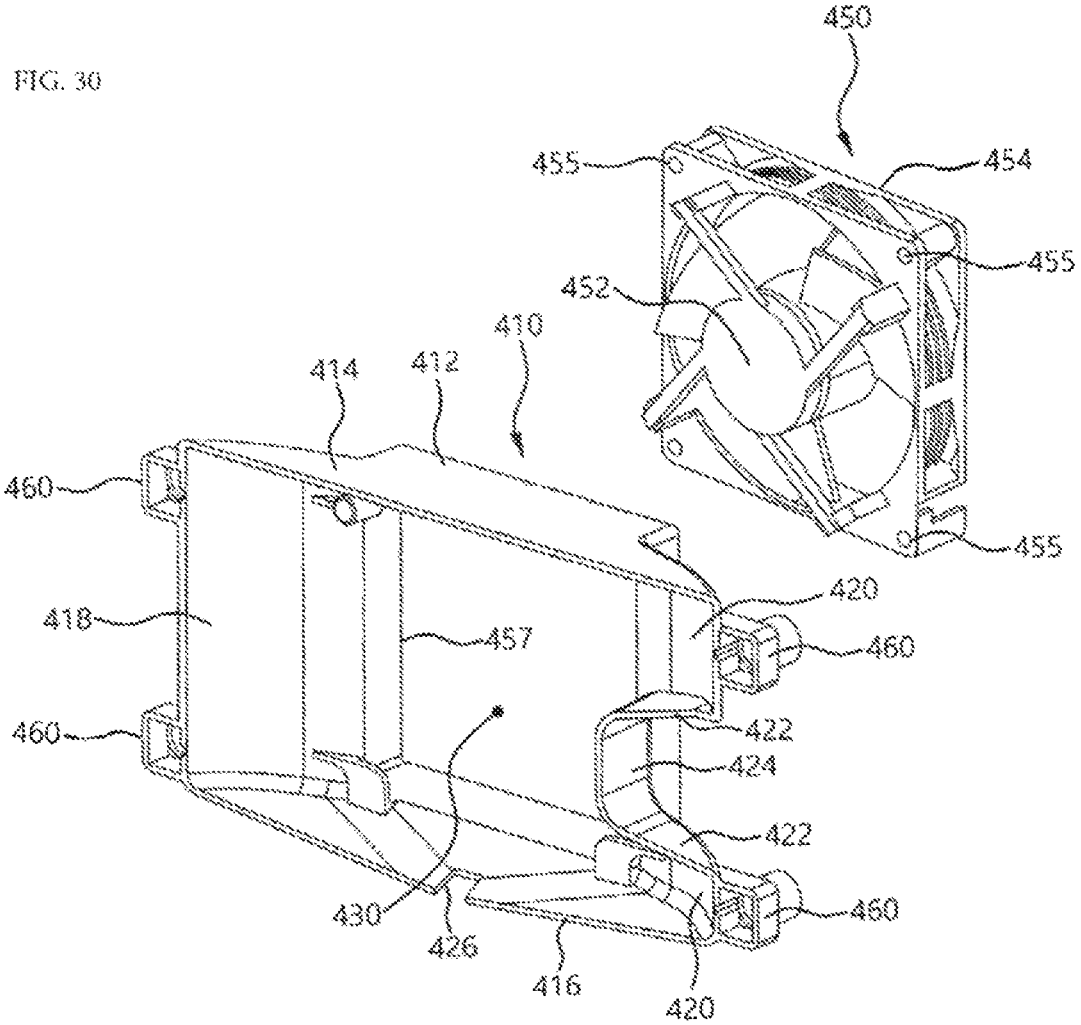
FIG. 30 is a front exploded perspective view showing the configuration of the grille fan module constituting the embodiment of the present disclosure.
Figure 31:
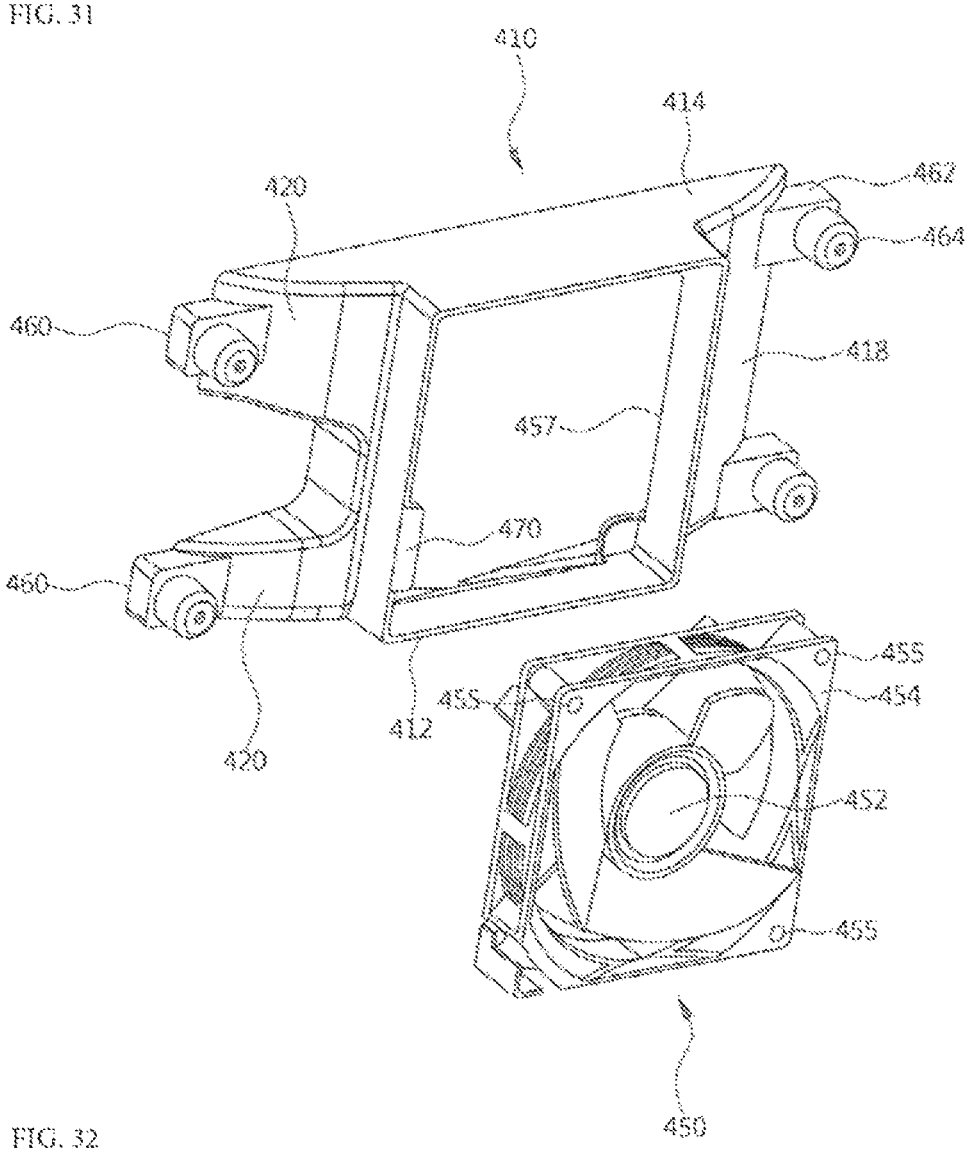
FIG. 31 is a rear exploded perspective view showing the configuration of the grille fan module constituting the embodiment of the present disclosure.

FIG. 27 is a front perspective view showing the configuration of the grille fan module constituting the embodiment of the present disclosure; FIG. 28 is a front view showing the configuration of the grille fan module constituting the embodiment of the present disclosure; FIG. 29 is a rear view showing the configuration of the grille fan module constituting the embodiment of the present disclosure; FIG. 30 is a front exploded perspective view showing the configuration of the grille fan module constituting the embodiment of the present disclosure; and FIG. 31 is a rear exploded perspective view showing the configuration of the grille fan module constituting the embodiment of the present disclosure.

Next, a grille fan module 400 of the refrigerator according to the embodiment of the present disclosure will be described in detail with reference to FIGS. 27 to 31.

A grille fan module 400 is installed on the rear surface of the grille plate 200. The grille fan module 400 includes a shroud 410 and a grille fan member 450.

The shroud 410 is made in the form of a box with a hollow inside, and the front and rear sides are open. The shroud 410 includes: a grille fan installation part 412 in which the grille fan member 450 is installed therein; a first guide wall 414 extending on the upper front side of the grille fan installation part 412, closing the front upper side of the grille fan installation part 412, and expanding left and right toward the front side; a second guide wall 416 extending on the lower front side of the grille fan installation part 412, closing the front lower side of the grille fan installation part 412, and expanding left and right toward the front side; a third guide wall 418 extending along the left end of the grille fan installation part 412, and having a curved surface that protrudes in the left direction toward the front side; and a fourth guide wall 420 extending along the respective right ends on the upper and lower right ends of the grille fan installation part 412, and having a curved surface that protrudes in the right direction toward the front side.

As shown in FIG. 31, the grille fan installation part 412 is formed in a square hexahedral shape with a hollow inside, and the front and rear sides are open. The grille fan installation part 412 is a portion to which a grille fan member 450 to be described later is installed and fixed.

The first guide wall 414 is formed in front of the upper side of the grille fan installation part 412. The first guide wall 414 is made of a plate material, is formed long left and right, and extends forward along the upper end of the grille fan installation part 412. The first guide wall 414 is formed to expand left and right toward the front side of the grille plate 200. Both rear side surfaces of the first guide wall 414 have a round shape and are connected to the upper surfaces of the third guide wall 418 and the fourth guide wall 420 to be described later.

The first guide wall 414 is formed on the front upper side of the grille fan installation part 412 and serves to close the front upper side of the grille fan installation part 412.

The second guide wall 416 is formed on the front lower side of the grille fan installation part 412. The second guide wall 416 is made of a plate material, is formed long left and right, and extends forward along the lower end of the grille fan installation part 412. The second guide wall 416 is foamed to expand left and right toward the front side of the grille plate 200. Both rear side surfaces of the second guide wall 416 have a round shape and are connected to the lower surfaces of the third guide wall 418 and the fourth guide wall 420 to be described later.

In addition, the second guide wall 416 is inclined downward toward the center of the front end (see FIGS. 27 and 28).

The second guide wall 416 not only guides the cool air of the grille fan member 450 to be described later installed in the grille fan installation part 412 toward the second vent part 214 side, but also guides water droplets generated inside the shroud 410 toward the lower center of the shroud 410.

A water droplet discharge hole 426 is formed in the lower center of the second guide wall 416. The water droplet discharge hole 426 has a square shape and is formed vertically through the upper surface of the second guide wall 416.

The water droplet discharge hole 426 is formed through the center of the end of the second guide wall 416, and serves to discharge water droplets generated inside the shroud 410 to the outside of the shroud 410.

The third guide wall 418 is formed between the left side of the first guide wall 414 and the left side of the second guide wall 416. The third guide wall 418 is elongated vertically along the left end of the front side of the grille plate 200, is made of a curved wall, and the upper and lower ends thereof are respectively connected to the left rear surface of the first guide wall 414 and the left rear surface of the second guide wall 416.

The third guide wall 418 is expanded in the front left direction along the front left end of the grille plate 200, and serves to guide the cool air blown by the grille fan member 450 to be described later in the left direction.

The fourth guide wall 420 is formed between the right side of the first guide wall 414 and the right side of the second guide wall 416. The fourth guide wall 420 is elongated vertically along the right end of the front side of the grille fan installation part 412, is made of a curved wall, and is disposed on the upper right and lower sides of the front right end of the grille fan installation part 412.

The fourth guide wall 420 is installed on the upper right and lower sides of the front right end of the grille fan installation part 412, expands in the front right direction along the right end of the grille fan installation part 412, and serves to guide the cool air blown by the grille fan member 450 to the right side, which will be described later.

A blocking wall 421 is installed on the fourth guide wall 420. The blocking wall 421 includes a first blocking wall 422 and a second blocking wall 424.

The first blocking wall 422 is made of a plate material, and is formed to protrude forward along the upper end or lower end of the fourth guide wall 420.

The first blocking wall 422 is installed inclined at a predetermined angle to the upper end or lower end of the fourth guide wall 420 to close the upper end or lower end of the fourth guide wall 420, and guides the cool air vented by the grille fan member 450 to be described later toward the first vent part 212 or the second vent part 214 side.

The second blocking wall 424 is installed between the different first blocking walls 422. The second blocking wall 424 is made of a plate material, and is formed to vertically protrude forward from the center of the front right end of the grille fan installation part 412.

The upper and lower ends of the second blocking wall 424 are connected to the left ends of the different blocking walls 422, respectively, and guides the cool air vented by the grille fan member 450 to be described later to the front side.

In the structure of the shroud 410 as described above, the first guide wall 414, the second guide wall 416, the third guide wall 418, the fourth guide wall 420, the blocking wall 421, etc. are installed with the grille fan installation part 412 as a basis, a venting space 430 through which cool air is vented is formed on the front side of the grille fan installation part 412.

The venting space 430 includes a first venting space 432, a second venting space 434, and a third venting space 436.

The first venting space 432 is a cool air venting space created as the third guide wall 418 is installed between the left side of the first guide wall 414 and the left side of the second guide wall 416, and is a portion through which cool air vented by the grille fan member 450 to be described later is vented in the left direction.

In addition, the second venting space 434 is divided into an upper venting space 438 and a lower venting space 440.

The upper venting space 438 is a venting space created by the right side of the first guide wall 414 closing the upper right end of the front of the grille fan installation part 412, the fourth guide wall 420 extending along the upper right end of the front of the grille fan installation part 412, and the blocking wall 421 installed at the lower end of the fourth guide wall 420, and is a portion through which cool air vented by the grille fan member 450 to be described later is vented in the upper right direction.

The lower venting space 440 is a venting space created by the right side of the second guide wall 416 closing the lower right end of the front of the grille fan installation part 412, the fourth guide wall 420 extending along the lower right end of the front of the grille fan installation part 412, and the blocking wall 421 installed at the upper end of the fourth guide wall 420, and is a portion through which cool air vented by the grille fan member 450 to be described later is vented in the lower right direction.

The third venting space 436 is a venting space created as the first guide wall 414 and the second guide wall 416 are installed on the upper and lower ends of the front side of the grille fan installation part 412, and is a portion through which cool air vented by the grille fan member 450 to be described later is vented to the front side.

Here, the cool air venting direction according to the position of the vent part 210 formed in the venting space 430 and the grille plate 200 will be described in detail.

The first venting space 432 guides the cool air vented by the grille fan member 450 to be described later in the left direction, and the cool air is vented to the left side of the first and second storage parts 118 and 122 by the left part of the first vent part 212 and the left part of the second vent part 214.

The second venting space 434 guides the cool air vented by the grille fan member 450 to be described later in the right direction, and the cool air is vented to the right side of the first and second storage parts 118 and 122 by the right part of the first vent part 212 and the right part of the second vent part 214.

The third venting space 436 guides the cool air vented to the front side by the grille fan member 450 to be described later toward the center side of the first row vent part 218 of the first vent part 212 and the center side of the second vent part 214, so that the cool air is vented to the upper center and middle center of the grille plate 200.

In addition, the venting areas of the first venting space 432 and the second venting space 434 are formed to be different. This is because, when the grille fan member 450 to be described later rotates at a high speed, relatively strong wind pressure is generated in the rotation direction side (first venting space) rather than the side opposite to the rotation direction (second venting space).

Due to this, there arises a problem that the internal pressure of the first venting space 432 is greater than the internal pressure of the second venting space 434.

Therefore, to solve this, in the refrigerator of the present disclosure, the venting area of the first venting space 432 is formed to be larger than that of the second venting space 434, so that the internal pressures of the first venting space 432 and the second venting space 434 are equalized, and thus, the venting amounts of cool air vented through the first venting space 432 and the second venting space 434 become the same.

The grille fan member 450 is installed inside the grille fan installation part 412. Various grille fans may be applied to the grille fan member 450, but an axial flow fan type grille fan will be applied here.

The grille fan member 450 includes a blowing fan 452 and a fixed frame 454.

The fixed frame 454 is installed inside the grille fan installation part 412. The fixed frame 454 is made of a square frame, has a fan mounting hole 456 formed therein, and is inserted into the grille fan installation part 412. The inside of the fan mounting hole 456 of the fixed frame 454 is a portion in which the blowing fan 452, which will be described later, is installed and fixed.

The blowing fan 452 is installed inside the fixed frame 454. The blowing fan 452 is a typical fan, and a detailed description thereof will be omitted. The blowing fan 452 is rotatably installed inside the fan mounting hole 456, and vents the cool air toward the venting space 430 after sucking in the cool air from the cool air generation parts 120 and 124 according to a control signal from the controller.

A grille fan fastening hole 455 is formed at the edge of the fixed frame 454. The grille fan fastening hole 455 is formed through the fixed frame 454 front and back, and a screw thread is formed therein. A fastening screw (not shown) is installed inside the grille fan fastening hole 455, which is a portion where the grille fan member 450 is fixed to a front separation prevention rib 468 to be described later.

A shroud fixing part 460 is formed on each side of the rear surface of the shroud 410. The shroud fixing part 460 includes a shroud fixing frame 462 and a fastening boss mounting protrusion 464.

The shroud fixing frame 462 is formed in a square box shape with a hollow inside, so that the front side thereof is opened. The shroud fixing frame 462 is formed to protrude in the left or right direction, respectively, from opposite sides of the rear surface of the shroud 410.

The inside of the shroud fixing frame 462 is a portion into which the fastening boss 270 is inserted and fixed.

The fastening boss mounting protrusion 464 is formed on the rear surface of the shroud fixing frame 462. The fastening boss mounting protrusion 464 has a cylindrical shape, has a fastening boss mounting groove 466 formed therein, and is formed to vertically protrude backward from the rear surface of the shroud fixing frame 462.

The fastening boss 270 of the grille plate 200 is inserted into the fastening boss mounting protrusion 464 to be screwed together.

That is, the shroud fixing part 460 is formed in each of the four corners on the rear side of the shroud 410, and through mounting and screwing by the fastening boss 270 of the grille plate 200, the shroud 410 may be firmly fixed to the portion where the vent part 210 is formed on the rear side of the grille plate 200.

The front separation prevention rib 468 is formed inside the shroud 410. The front separation prevention rib 468 is made of a square plate, and is formed to protrude upward or downward from the four front corners of the grille fan installation part 412.

When the grille fan member 450 is mounted inside the grille fan installation part 412, the four corners of the grille fan member 450 are lock fixed, and at this time, the front separation prevention rib 468 may prevent the grille fan member 450 from being separated toward the front side of the grille fan installation part 412.

A locking end 470 is formed on the lower left side of the rear end of the grille fan installation part 412. The locking end 470 is made of a rectangular plate, and is formed to protrude by a predetermined length from the left to the right of the rear end of the grille fan installation part 412 (see FIG. 31).

When the grille fan member 450 is installed inside the grille fan installation part 412, the locking end 470 is lock fixed to the lower left side of the rear end of the grille fan member 450, and serves to lock fix the grille fan member 450 inside the grille fan installation part 412.

In addition, in a state in which the locking end 470 is lock fixed to the grille fan member 450, a fixing screw (not shown) may be fastened to the front separation prevention rib 468 located in a diagonal direction from the locking end 470 and a corner of the grille fan member 450 to firmly fix the grille fan member 450 to the shroud 410.

Figure 32:
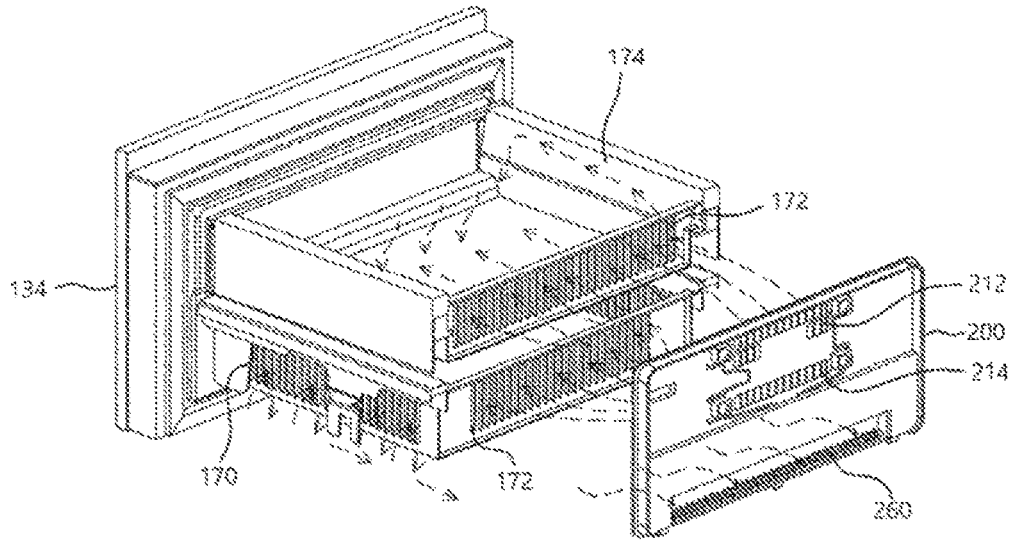
FIG. 32 is a rear perspective view showing the arrangement of an auxiliary drawer part, the first drawer part, and the grille plate installed inside the first inner casing constituting the embodiment of the present disclosure.
Figure 33:
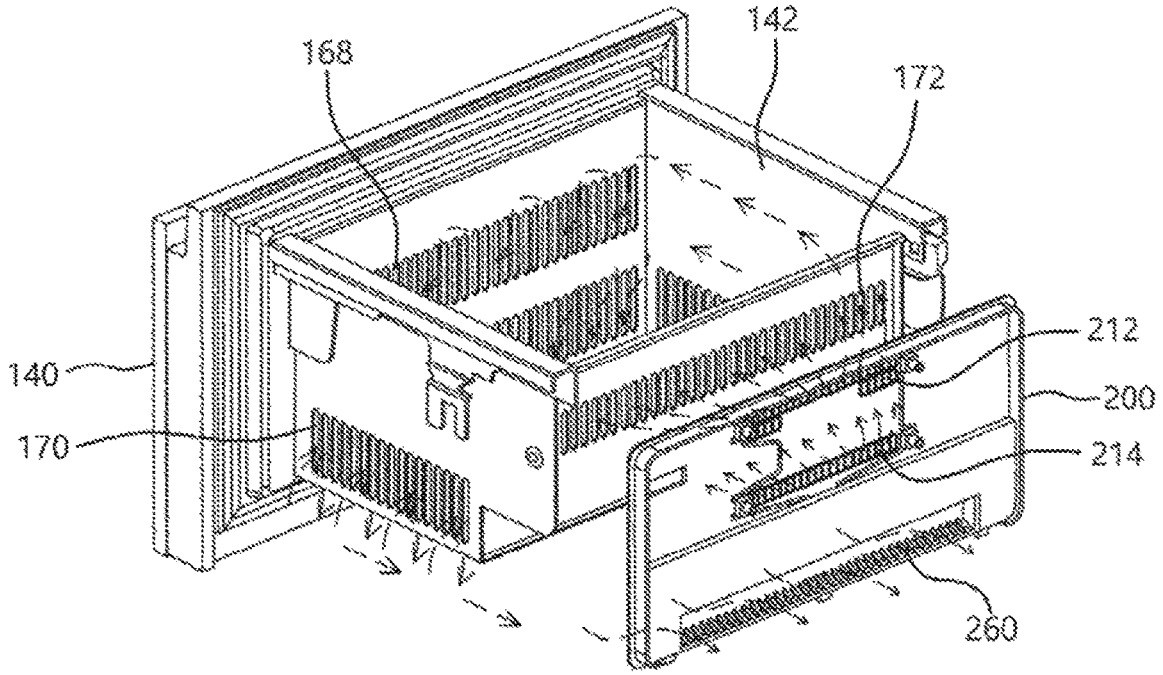
FIG. 33 is a rear perspective view showing the arrangement of the second drawer part and the grille plate installed inside the second inner casing constituting the embodiment of the present disclosure.
Figure 34:
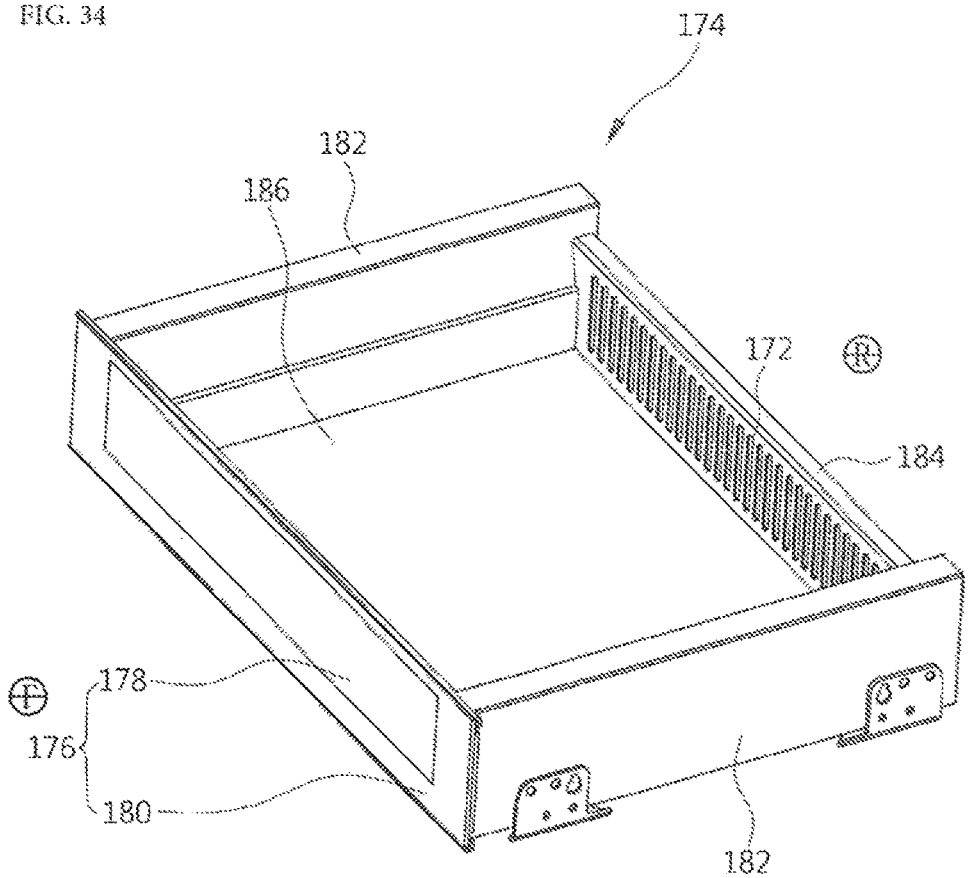
FIG. 34 is a front perspective view showing the configuration of the auxiliary drawer part constituting the embodiment of the present disclosure.
Figure 35:
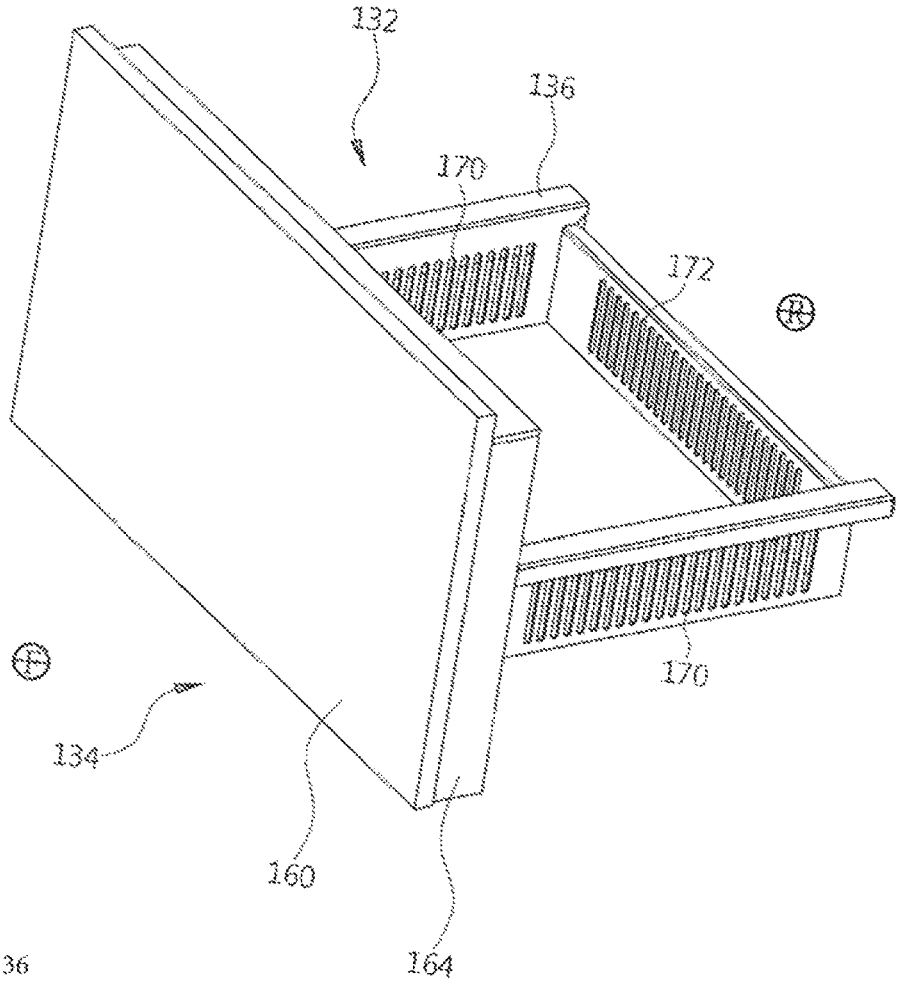
FIG. 35 is a front perspective view showing the configuration of the first drawer part constituting the embodiment of the present disclosure.
Figure 36:
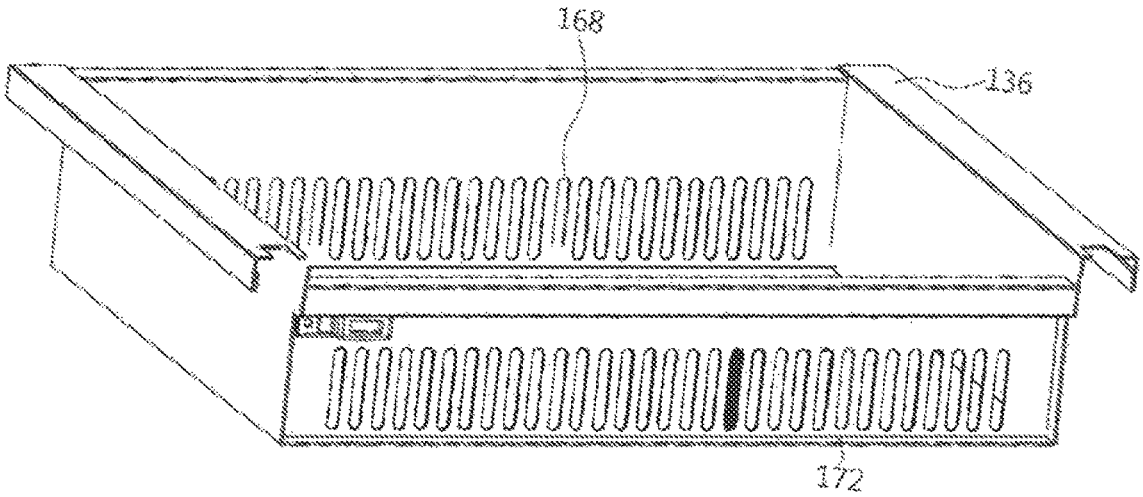
FIG. 36 is a rear perspective view showing the configuration of a first drawer body constituting the embodiment of the present disclosure.
Figure 37:
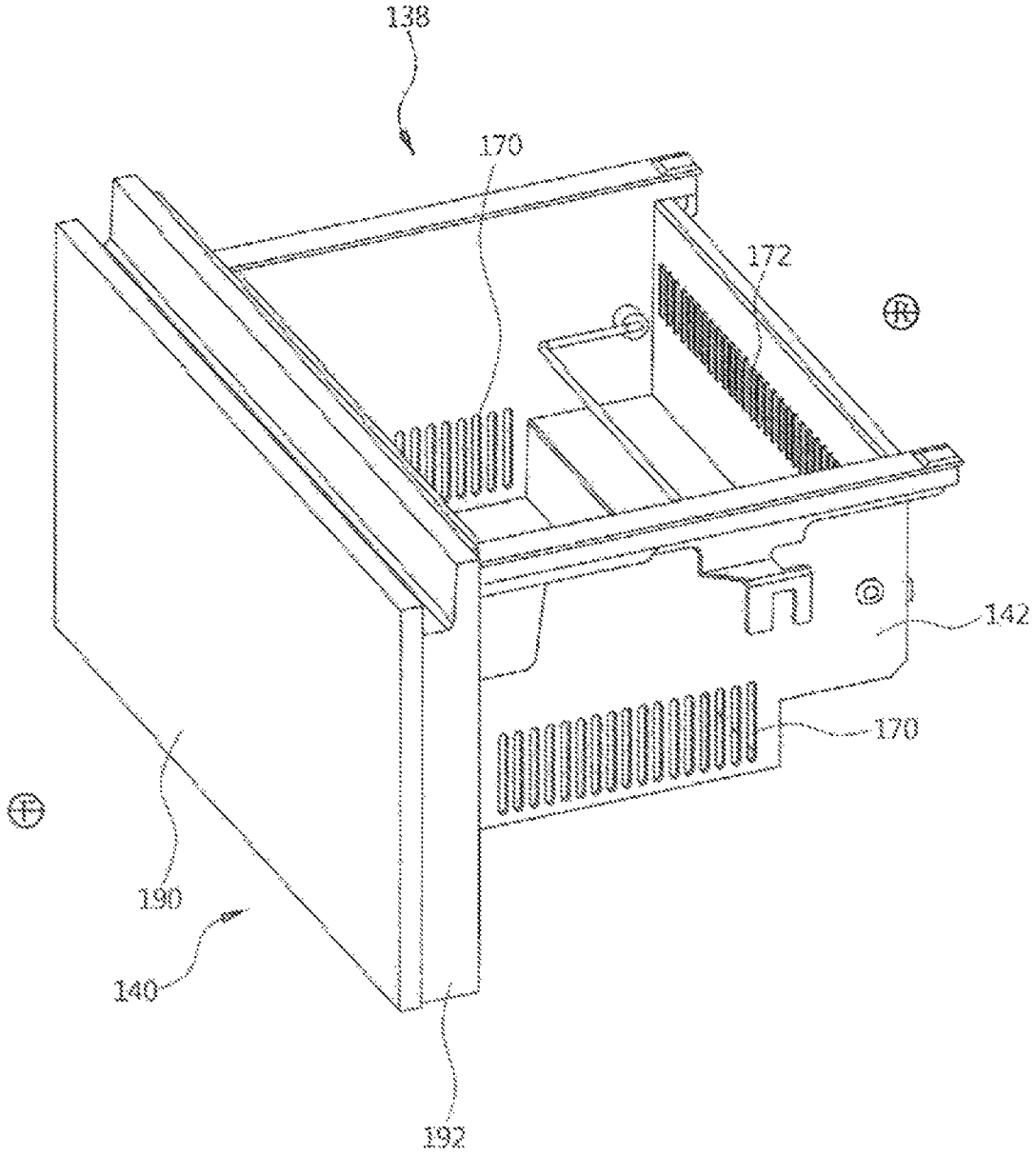
FIG. 37 is a front perspective view showing the configuration of the second drawer part constituting the embodiment of the present disclosure.

FIG. 32 is a rear perspective view showing the arrangement of an auxiliary drawer part, the first drawer part, and the grille plate installed inside the first inner casing constituting the embodiment of the present disclosure; FIG. 33 is a rear perspective view showing the arrangement of the second drawer part and the grille plate installed inside the second inner casing constituting the embodiment of the present disclosure; FIG. 34 is a front perspective view showing the configuration of the auxiliary drawer part constituting the embodiment of the present disclosure; FIG. 35 is a front perspective view showing the configuration of the first drawer part constituting the embodiment of the present disclosure; FIG. 36 is a rear perspective view showing the configuration of a first drawer body constituting the embodiment of the present disclosure; FIG. 37 is a front perspective view showing the configuration of the second drawer part constituting the embodiment of the present disclosure.

Next, with reference to FIGS. 32 to 37, the first drawer part 132, the auxiliary drawer part 174, and the second drawer part 138 installed inside the first and second inner casings 114 and 116 of the refrigerator according to the embodiment of the present disclosure will be described in detail.

The first drawer part 132 is installed inside the first inner casing 114. The first drawer part 132 includes a first door 134 and a first drawer body 136.

The first door 134 includes a first front panel 160 that forms a front exterior, and a first door panel 164 installed on the rear surface of the first front panel 160 and filled with an insulating material.

The first front panel 160 is made of a plate having a predetermined thickness, and is installed on the front side of the first inner casing 114. Various materials may be applied to the first front panel 160, but here, a stainless steel is applied for a sleek exterior of the refrigerator as the first front panel 160 forms the exterior of the refrigerator.

The first front panel 160 is disposed on the front side of the first inner casing 114 to form the exterior of the refrigerator.

In addition, when combined with the first door panel 164 to be described later, the upper surface of the first front panel 160 is positioned higher than the upper surface of the first door panel 164 to be described later.

That is, the upper end of the first front panel 160 is installed to protrude upward from the upper end of the first door panel 164 to be described later.

Accordingly, a handle space 162 in which a user's hand may be held is formed on the upper rear side of the first front panel 160, and thus, when the first door 134 is opened, the opening and closing operations of the first door 134 are performed by holding the upper end of the first front panel 160 while the user's finger is inserted into the handle space 162 side.

The first door panel 164 is installed on the rear side of the first front panel 160. The first door panel 164 is foiled in a plate shape with a hollow inside, and is formed long left and right. The first door panel 164 is manufactured through a sheet metal process in which a steel plate is bent multiple times.

The first door panel 164 is installed on the rear side of the first front panel 160 and serves to close the front opening of the first inner casing 114 according to a user's operation.

The first drawer body 136 is installed on the rear surface of the first door 134. The first drawer body 136 has a box shape with an open top, and is fixedly installed on the rear surface of the first door 134. Food or food containers are stored and kept in the first drawer body 136. The first drawer body 136 is drawn out of the first inner casing 114 when the first door 134 is opened, and is drawn into the first inner casing 114 when the first door 134 is closed.

An upper cool air circulation hole is formed on each of the front, rear, left, and right sides of the first drawer body 136. The upper cool air circulation hole is made in the shape of a long hole, and is formed long vertically.

The upper cool air circulation hole includes: a first cool air circulation hole 168 formed in the front surface of the first drawer body 136; a second cool air circulation hole 170 formed on the side surface of the first drawer body 136; and a third cool air circulation hole 172 formed on the rear surface of the first drawer body 136.

A plurality of upper cool air circulation holes are formed through the front and rear side surfaces and left and right side surfaces of the first drawer body 136 at regular intervals, respectively, to serve as a circulation passage for cool air circulating inside the first storage part 118.

Figure 38:
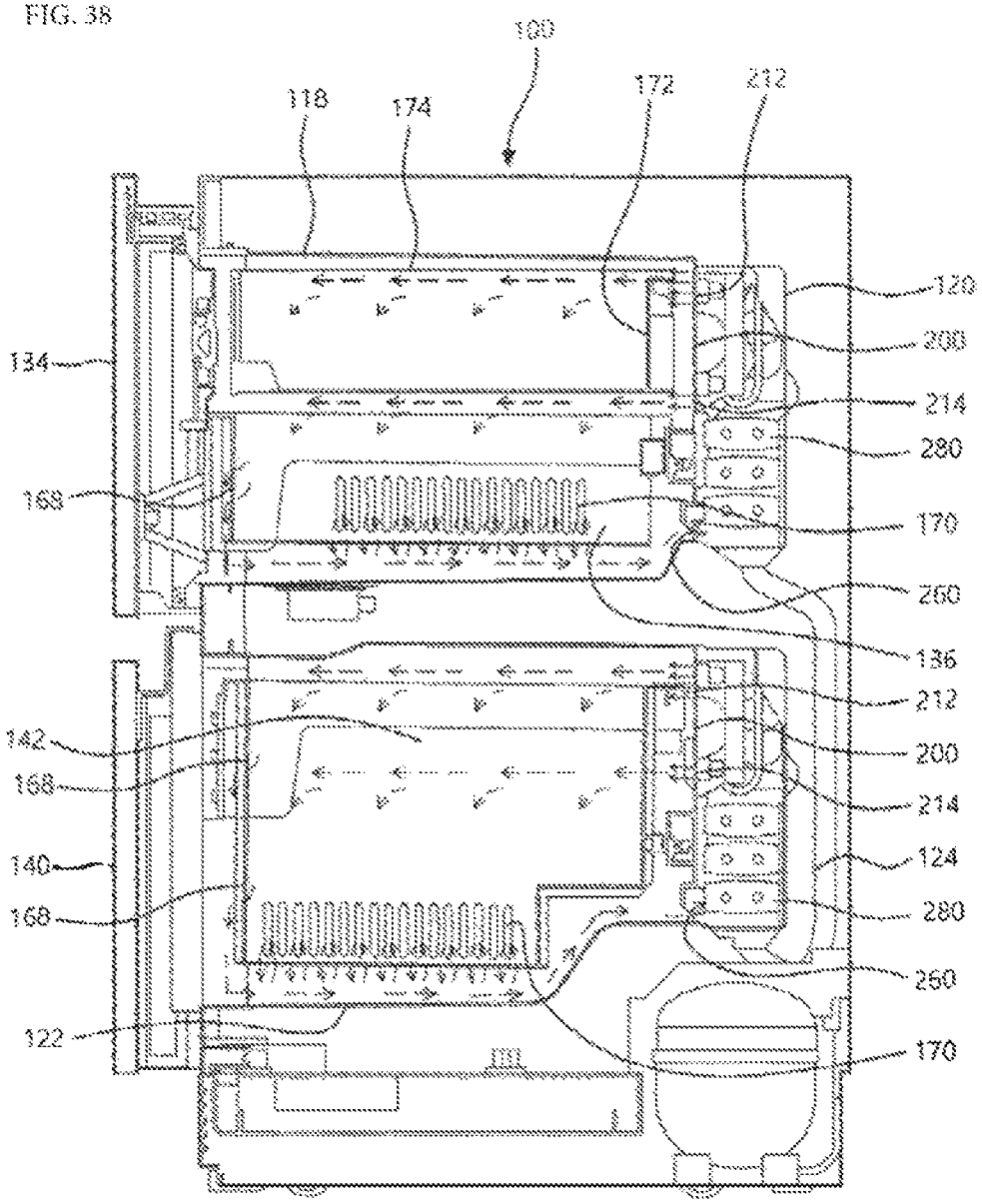
FIG. 38 is a cross-sectional view showing cool air circulation paths through which cool air is circulated inside the first and second inner casings constituting the embodiment of the present disclosure.
Figure 39:
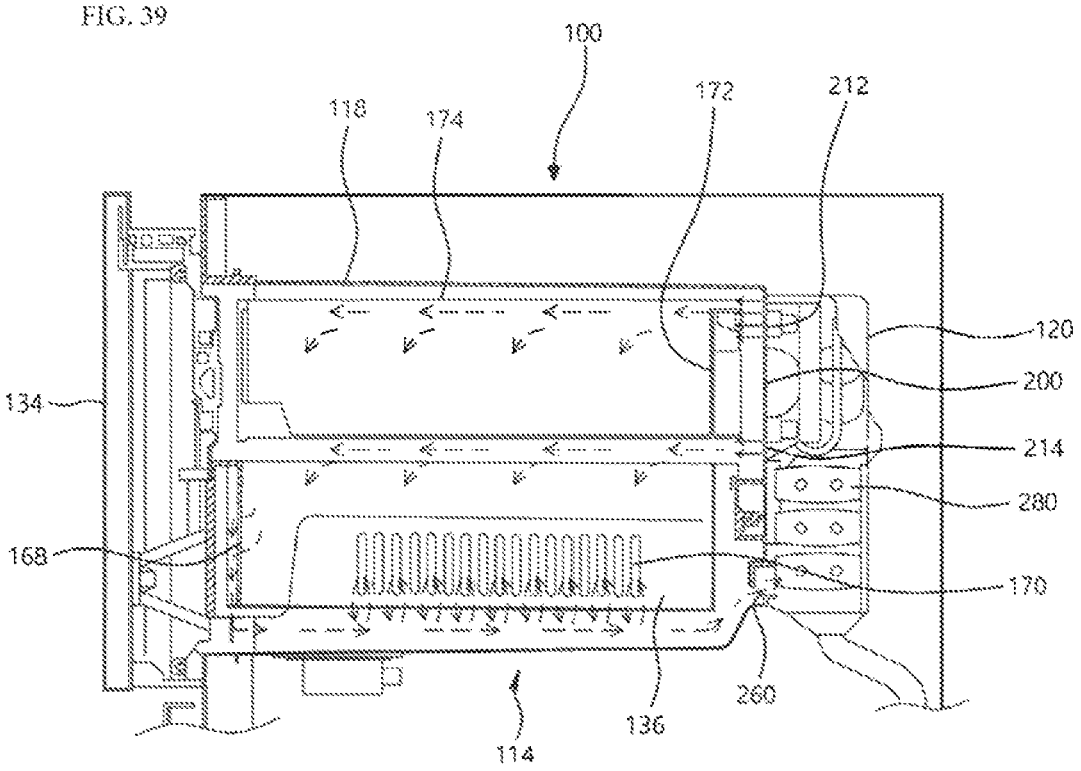
FIG. 39 is an enlarged cross-sectional view showing a cool air circulation path through which cool air is circulated inside the first inner casing constituting the embodiment of the present disclosure.
Figure 40:
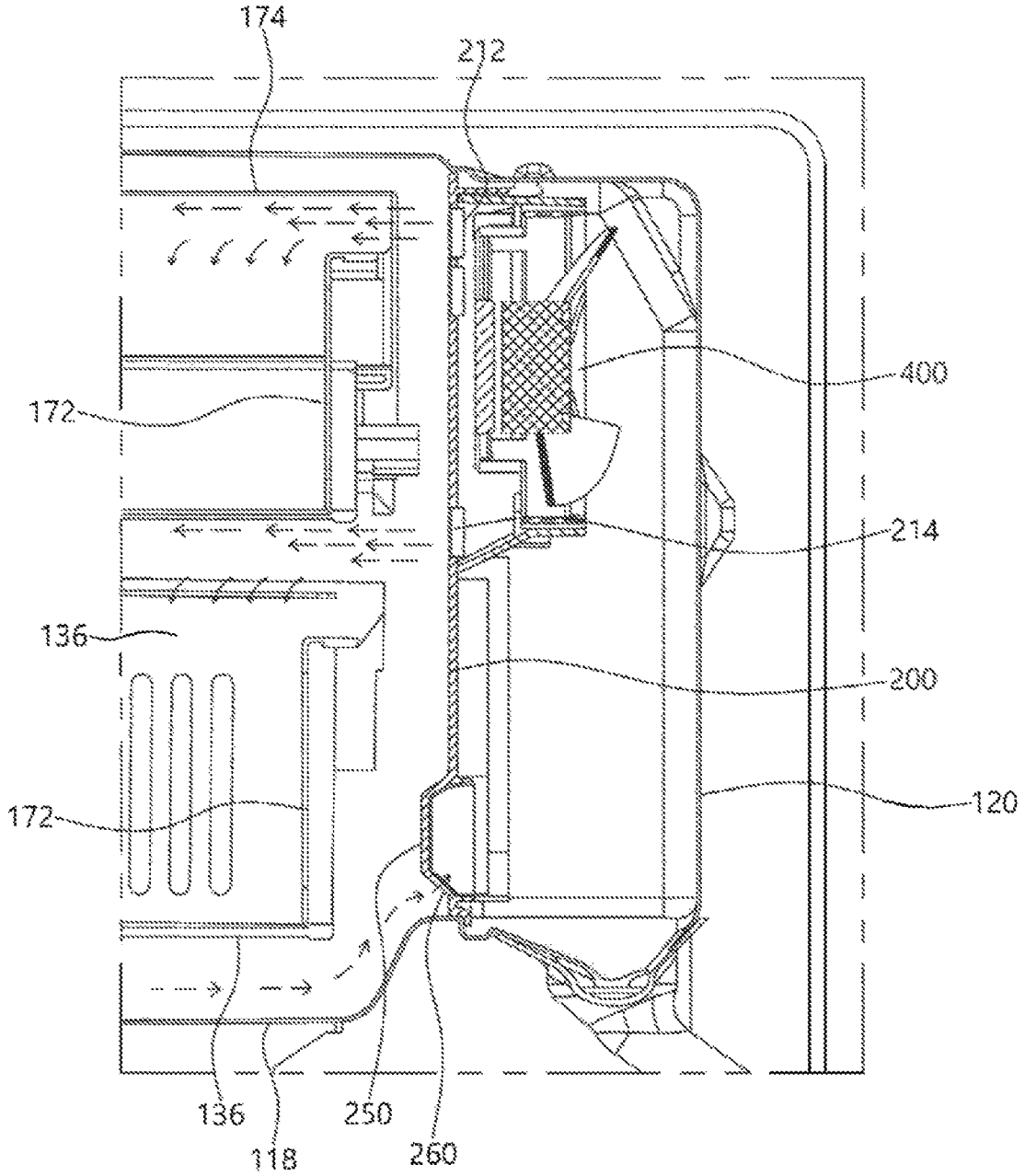
FIG. 40 is an enlarged cross-sectional view showing a cool air circulation path through which cool air is vented and discharged toward the storage part by the grille plate and grille fan member installed in the first inner casing constituting the embodiment of the present disclosure.

The auxiliary drawer part 174 is installed above the first drawer part 132. The auxiliary drawer part 174 is installed in the upper side space of the first storage part 118 (see FIG. 38). The auxiliary drawer part 174 consists of a tempered glass panel 176, a side frame 182, a rear frame 184, and a bottom frame 186.

The tempered glass panel 176 is composed of a tempered glass 178 and a fixed panel 180, etc. The tempered glass 178 is a typical tempered glass and a detailed description thereof will be omitted. The tempered glass 178 is made of a rectangular plate material and is formed long left and right. The tempered glass 178 is made of a transparent material and is installed on the front side of the first storage part 118, so when the first door 134 is opened, food and food containers stored in the auxiliary drawer part 174 may be visually checked from the outside.

A fixing panel 180 is installed on the circumferential surface of the tempered glass 178. The fixing panel 180 may be made of a plastic or metal material, and is installed to surround the circumferential surface of the tempered glass 178. The fixing panel 180 is installed on the circumferential surface of the tempered glass 178 to support the tempered glass 178.

A side frame 182 is installed on each side of the rear surface of the tempered glass panel 176. The side frame 182 is made of a rectangular plate with a hollow inside, and is formed long front and back. The side frame 182 is installed on both sides of the rear surface of the tempered glass panel 176, and closes both sides of the rear surface of the tempered glass panel 176.

A rear frame 184 is installed at the end of the side frame 182. The rear frame 184 is made of a plate made of a plastic material or a metal material, and is formed long left and right. Opposite ends of the rear frame 184 are fixed to different side frames 182, respectively, and form the rear wall of the auxiliary drawer part 174.

The rear frame 184 is installed to close the rear side of the auxiliary drawer part 174, and prevents food or food containers stored in the auxiliary drawer part 174 from being separated through the rear side of the auxiliary drawer part 174.

The third cool air circulation hole 172 is formed on the rear surface of the rear frame 184. The third cool air circulation hole 172 has a long hole shape and is formed long vertically.

In addition, the third cool air circulation hole 172 serves to guide the cool air circulated inside the first storage part 118 to the food or food containers stored in the auxiliary drawer part 174.

The bottom frame 186 is installed at the lower of the rear frame 184. The bottom frame 186 is formed in the form of a flat plate, and is installed at the lower end of the tempered glass panel 176, the side frame 182, and the rear frame 184.

The bottom frame 186 forms a bottom surface of the auxiliary drawer part 174, and is a portion on which food and food containers stored therein are seated.

A drawer rail (not shown) is installed on each side of the auxiliary drawer part 174. The drawer rail (not shown) is a typical draw rail, and detailed description thereof will be omitted. The auxiliary drawer part 174 may be pulled in and pulled out by using the drawer rail.

As the auxiliary drawer part 174 is additionally installed in the space above the first drawer part 132, the unused space of the first storage part 114 may be minimized, and storage efficiency of the refrigerator is improved by expanding the storage space.

Hereinafter, with reference to FIG. 32, the cool air vent circulation passage according to the arrangement of the first drawer part 132, the auxiliary drawer part 174, and the grille plate 200 installed inside the first storage compartment 118 will be explained.

The cool air generated by the first cool air generation part 120 is vented toward the first storage part 118 through the vent part 210 of the grille plate 200.

As the vent part 210 is composed of the first vent part 212 and the second vent part 214, cool air is vented to the upper side of the auxiliary drawer part 174 through the first vent part 212.

In addition, the first vent part 212 consists of the first row vent part 218 and the second row vent part 220, and the first row vent part 218 vents cool air to the front, left, and right sides of the space between the inner upper surface of the first storage part 118 and the upper side of the auxiliary drawer part 174.

The second row vent part 220 is formed under the first row vent part 218 to vent cool air in the left and right directions of the upper portion of the first storage part 118.

The second vent part 214 is disposed on the central part of the grille plate 200, and vents cool air into a space between the first drawer part 132 and the auxiliary drawer part 174.

The second vent part 214 is disposed in the center of the grille plate 200, and vents cool air discharged through the grille plate 200 to the front, left, and right sides of the space between the first drawer part 132 and the auxiliary drawer part 174.

The cool air vented by the first vent part 212 is vented into the upper space of the first storage part 118, and cool air is circulated inside the auxiliary drawer part 174 through the upper opening of the auxiliary drawer part 174 and the third cool air circulation hole 172 on the rear side.

In addition, cool air vented by the second vent part 214 is circulated inside the first drawer part 132 through the upper opening of the first drawer part 132 and the cool air circulation holes formed in the front, rear, left, and right surfaces of the first drawer part 132.

The cool air circulated inside the first storage part 118 is guided toward the cool air generation part 120 in which the evaporator 280 is installed through the suction part 260 formed in the lower front surface of the grille plate 200.

As the vent part 210 for venting cool air to the inside of the first storage part 118 as described above is formed in the front upper portion and the central portion of the grille plate 200, and directly vents cool air through the upper opening of the auxiliary drawer part 174 and the upper opening of the first drawer part 132, cool air is directly transferred to the food and food containers stored in the auxiliary drawer part 174 and the first drawer part 132, so that the cooling time may be shortened and the cooling efficiency may be improved.

In addition, as the vent part 210 vents cool air in the front and left and right directions simultaneously, cool air may be vented to the entire region of the first storage part 118 in a short time, and thus, rapid transfer of cool air inside the first storage part 118 may be achieved.

The second drawer part 138 is installed inside the second storage part 122. The second drawer part 138 includes a second door 140 and a second drawer body 142.

The second door 140 is composed of a second front panel 190 forming the front exterior, and a second door panel 192 installed on the rear surface of the second front panel 190 and filled with an insulating material.

The second front panel 190 is made of a plate having a predetermined thickness, and is installed on the front side of the second storage part 122. Various materials may be applied to the second front panel 190, but here, a stainless steel is applied for a sleek exterior of the refrigerator as the second front panel 190 forms the exterior of the refrigerator.

The second front panel 190 is disposed on the front side of the second storage part 122 to form the exterior of the refrigerator.

A second door panel 192 is installed on the rear side of the second front panel 190. The second door panel 192 is formed in a plate shape with a hollow inside, and is formed long left and right.

The second door panel 192 is manufactured through a sheet metal process in which a steel plate is bent multiple times.

The second door panel 192 is installed on the rear side of the second front panel 190 and serves to close the front opening of the second storage part 122 according to a user's operation.

In addition, a handle groove 194 is formed in the upper surface of the second door panel 192. The handle groove 194 is formed to be depressed in a downward direction, elongated horizontally along the front side of the upper surface of the second door panel 192. The lower surface of the handle groove 194 is recessed so as to be located further lower than the upper surface of the second front panel 190.

A user's fingers may be accommodated inside the handle groove 194, and the second drawer part 138 may be drawn in and out as the upper end of the second door panel 192 is gripped by the user.

The second drawer body 142 is installed on the rear surface of the second door 140. The second drawer body 142 has a box shape with an open top, and is fixedly installed on the rear surface of the second door 140. Food or food containers are stored and kept inside the second drawer body 142. The second drawer body 142 is drawn out of the second storage part 122 when the second door 140 is opened, and is drawn into the second storage part 122 when the second door 140 is closed.

A lower cool air circulation hole is formed on each of the front, rear, left, and right sides of the second drawer body 142. The lower cool air circulation hole is made in the shape of a long hole, and is formed long vertically.

The lower cool air circulation hole includes: a first cool air circulation hole 168 formed in the front surface of the second drawer body 142; a second cool air circulation hole 170 formed on the side surface of the second drawer body 142; and a third cool air circulation hole 172 formed on the rear surface of the second drawer body 142.

The first cool air circulation hole 168 is formed is formed in the front portion of the second drawer body 142. The first cool air circulation hole 168 passes through the front upper and lower sides of the second drawer body 142 back and forth, and a plurality of the first cool air circulation holes 168 are formed through the front surface of the second drawer body 142 at regular intervals.

The first cool air circulation hole 168 is formed through the front upper and lower sides of the second drawer body 142, so that cool air may be circulated through the front surface of the second drawer body 142.

The second cool air circulation hole 170 is formed on the lower left and right sides of the second drawer body 142. Preferably, the second cool air circulation hole 170 is not formed on the upper left and right sides of the second drawer body 142, so that the cool air flowing into the second drawer body 142 may stay inside the second drawer body 142 for a longer time.

In addition, the second cool air circulation hole 170 formed in the side surface of the second drawer body 142 is preferably formed in the lower side surface of the second drawer body 142 since the food or food containers stored in the second drawer body 142 is stored from the bottom surface of the second drawer body 142.

The third cool air circulation hole 172 is formed on the rear surface of the second drawer body 142. The third cool air circulation hole 172 is formed at a position corresponding to the second vent part 214 of the grille plate 200. The third cool air circulation hole 172 serves as a passage for guiding the cool air vented in the front and left and right directions through the second vent part 214 to the inside of the second drawer body 142.

As the lower cool air circulation hole of the second drawer body 142 is formed on the front, back, left, right, and rear sides of the second drawer body 142, cool air flowing in and out of the second storage part 122 may be circulated smoothly.

Hereinafter, a cool air vent circulation passage according to the arrangement of the second drawer part 138 installed inside the second storage part 122 and the grille plate 200 will be described with reference to FIG. 33.

The cool air generated by the second cool air generation part 124 is vented toward the second storage part 122 through the vent part 210 of the grille plate 200.

As the vent part 210 is composed of the first vent part 212 and the second vent part 214, cool air is vented to the upper side of the second drawer part 138 through the first vent part 212.

In addition, the first vent part 212 consists of the first row vent part 218 and the second row vent part 220, and the first row vent part 218 vents cool air to the front, left, and right sides of the space between the inner upper surface of the second storage part 122 and the upper side of the second drawer part 138.

The second row vent part 220 is formed under the first row vent part 218 to vent cool air in the left and right directions of the upper portion of the second storage part 122.

The second vent part 214 is disposed on the central part of the grille plate 200, and vents cool air to the second drawer part 138 and the third cool air circulation hole 172.

The second vent part 214 is disposed in the center of the grille plate 200, and vents cool air discharged through the grille plate 200 to the front, left, and right side directions of the third cool air circulation hole 172 of the second drawer part 138.

The cool air vented by the first vent part 212 is vented to the upper space of the second storage part 122, and the cool air is introduced into the second drawer part 138 through the upper opening of the second drawer part 138.

In addition, the cool air vented by the second vent part 214 is directly introduced into the second drawer part 138 through the third cool air circulation hole 172 of the second drawer part 138.

The cool air circulated inside the second storage part 122 is guided toward the cool air generation part 124 in which the evaporator 280 is installed through the suction part 260 formed in the lower front surface of the grille plate 200.

As the vent part 210 for venting cool air to the inside of the second storage part 122 as described above is formed in the upper front portion and the central portion of the grille plate 200 and directly vents cool air through the upper opening of the second drawer part 138 and the third cool air circulation hole 172 of the second drawer part 138, cool air is directly transferred to the food and food containers stored in the second drawer part 138, thereby reducing cooling time and improving cooling efficiency.

Figure 41:
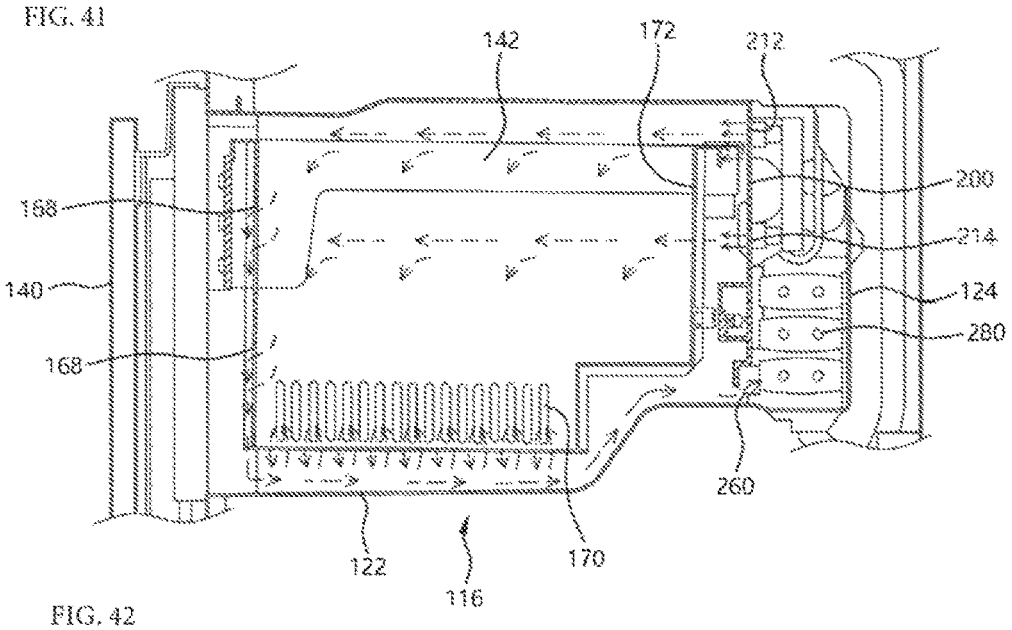
FIG. 41 is an enlarged cross-sectional view showing a cool air circulation path through which cool air is circulated inside the second inner casing constituting the embodiment of the present disclosure.
Figure 42:
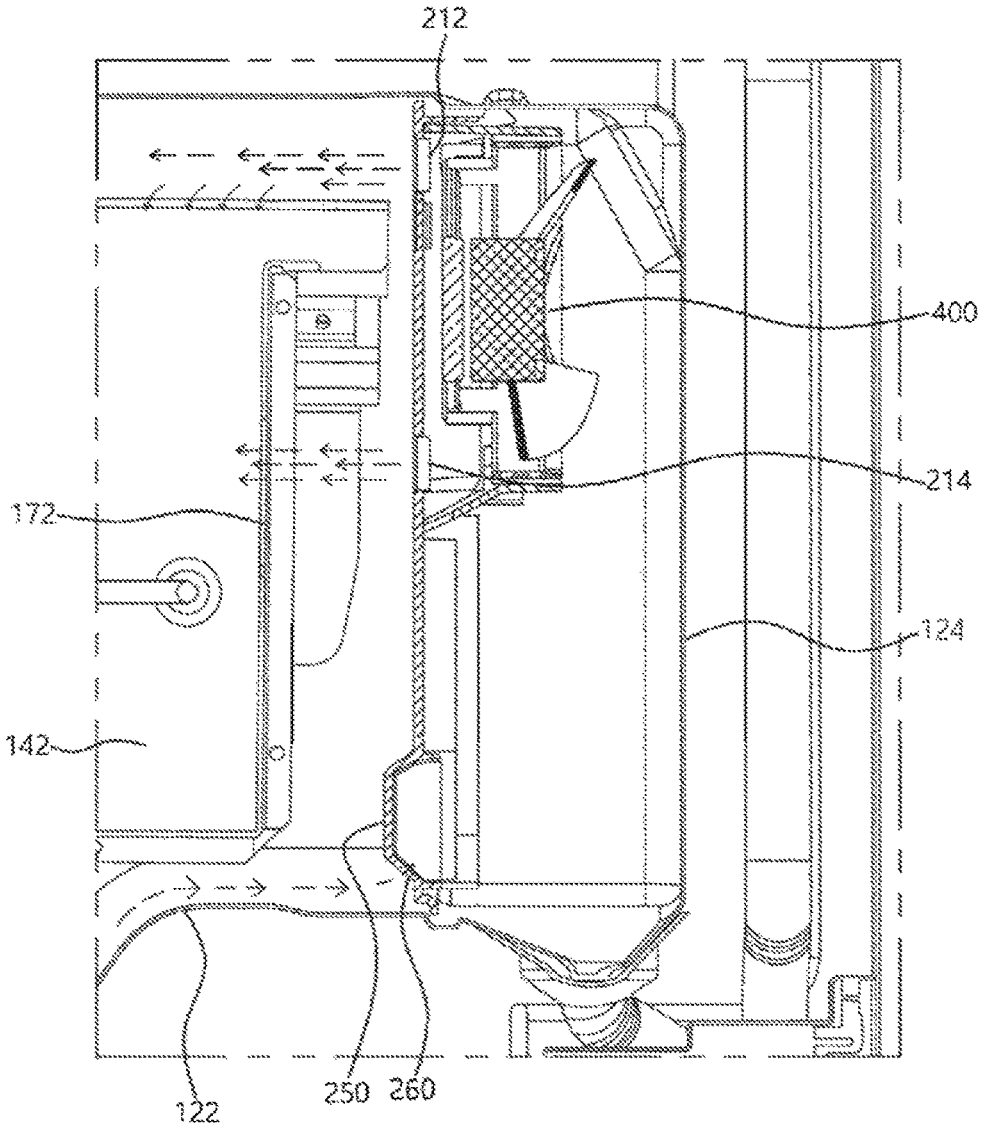
FIG. 42 is an enlarged cross-sectional view showing a cool air circulation path through which cool air is vented and discharged toward the storage part by the grille plate and grille fan member installed in the second inner casing constituting the embodiment of the present disclosure.
Figure 43:
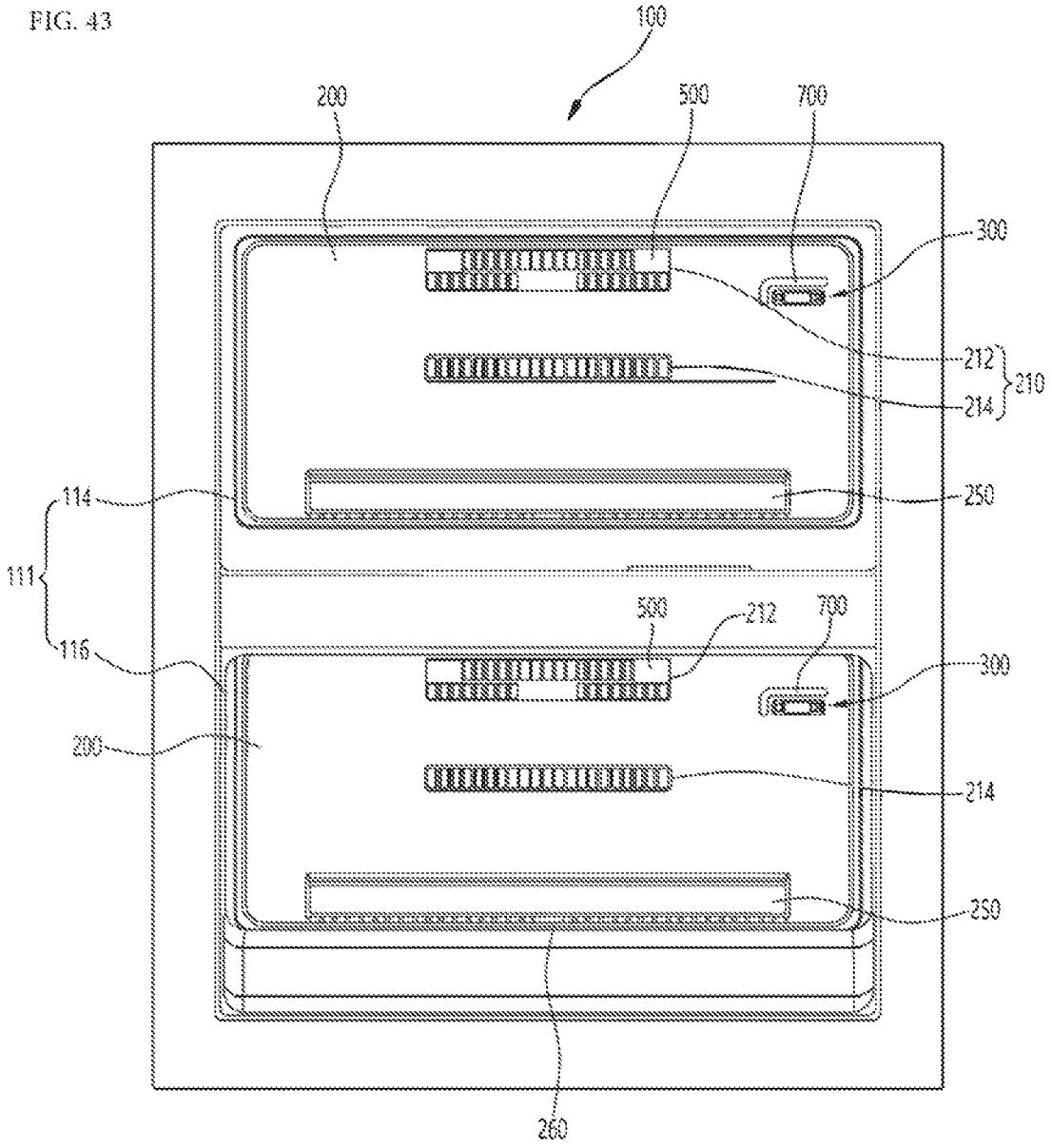
FIG. 43 is a front view showing a state in which a grille plate constituting another embodiment of the present disclosure is installed in first and second inner casings.

Hereinafter, the structures of the evaporator and the grille fan module installed in the first and second cool air generation parts will be described in detail with reference to FIGS. 10 and 41.

The evaporator 280 and the grille fan module 400 are installed inside the first and second cool air generation parts 120 and 124. The evaporator 280 and the grille fan module 400 are installed side by side in the same line in the inside of the cool air generation parts 120 and 124.

In addition, the grille fan module 400 may be disposed on the upper side of the first and second cool air generation parts 120 and 124, and the evaporator 280 may be disposed on the lower side of the first and second cool air generation parts 120 and 124.

As described above, since the evaporator 280 for generating cool air of the first and second cool air generation parts 120 and 124 and the grille fan module 400 for spraying cool air are arranged side by side in a line on the upper and lower sides of the first and second cool air generation parts 120 and 124, the installation area of the first and second cool air generation parts 120 and 124 may be minimized, and space utilization is improved, so that a compact design of a refrigerator may be possible.

In addition, as the grille fan module 400 is installed directly on the grille plate 200 on which the vent part 210 is formed, cool air is directly sprayed to the vent part 210 of the grille plate 200 by the grille fan module 400 to shorten the flow distance for spraying of cool air, and as a result, cooling efficiency may be improved, and the space efficiency of the cool air generation parts may be improved.

Next, a vent guide of a grille plate of a refrigerator constituting another embodiment of the present disclosure will be described in detail with reference to FIGS. 43 to 50.

The grille plate 200 includes a pair of vent guides 500, each of which is formed on each side of the first row vent part 218.

The vent guide 500 includes: a rear surface penetrating through the front and rear of the grille plate 200; an upper surface 504 and a lower surface 506 protruding forward from the front of the grille plate 200; a front surface 508 that connects the upper surface 504 and the lower surface 506 and blocks cool air from being directly sprayed to the front; and a side surface having an opening 502.

The vent guide 500 is configured to include the opening 502 on one side so that cool air may flow on both sides based on the front surface of the grille plate 200. The opening 502 guides the cool air blown by the grille fan module 400 to be vented to both sides of the grille plate 200. Accordingly, the opening 502 may guide the cool air vented to both sides of the grille plate 200 to flow in both directions of the first and second storage parts 118 and 122.

Figure 44:
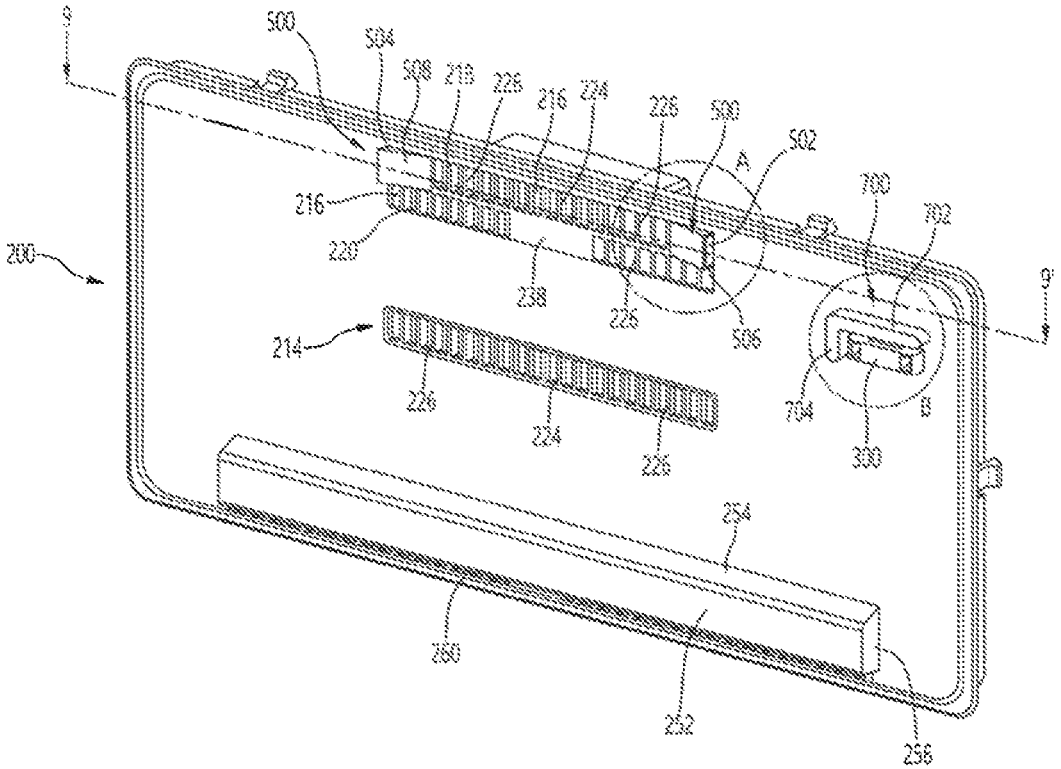
FIG. 44 is a front perspective view showing the grille plate constituting another embodiment of the present disclosure.
Figure 45:
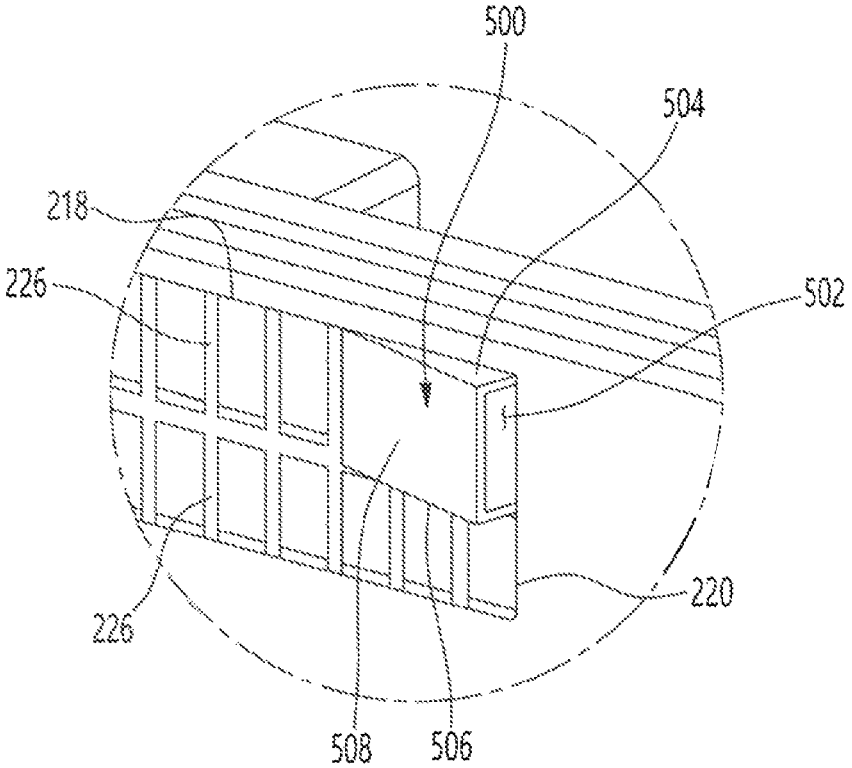
FIG. 45 is an enlarged view of part A of FIG. 44.

As shown in FIGS. 44 and 45, the vent guide 500 may be formed through the front and rear of the grille plate 200 while facing the grille fan module 400. The front surface 508 of the vent guide is formed to extend in both directions from each side of the first row vent part 218, and has a structure inclined forward toward the outside (a direction away from the center of the first row vent part 218).

The upper surface 504 and the lower surface 506 forming the vent guide 500 have a shape in which the length in the front-rear direction increases toward each side (a direction away from the center of the first row vent part) of the first row vent part.

Figure 50:
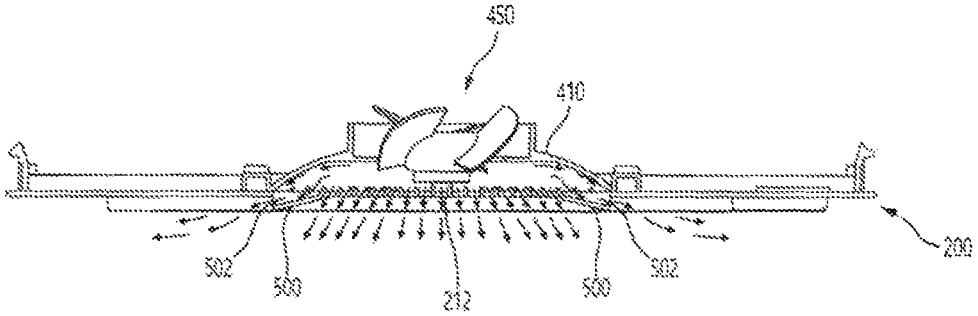
FIG. 50 is a cross-sectional view of the grille plate constituting another embodiment of the present disclosure.

In addition, the opening 502 for guiding the cool air blown by the grille fan module 400 to the first and second storage parts 118 and 122 is formed on one side of the vent guide 500. The opening 502 serves to intensively spray cool air to both sides of the front surface of the grille plate 200 as shown in FIG. 50.

It is difficult to make the cool air blown by the grille fan module 400 flow to both ends of the first and second storage parts 118 and 122 only with the configuration of the vent guide ribs 215 included in the first row vent part 218. Since the vent guide 500 has a shape in which the front is shielded and only one side is opened, cool air may be effectively moved to both sides of the first and second storage parts 118 and 122, preferably to both ends.

A suction part 260 is formed on the lower rear surface of the grille plate. The suction part 260 includes a plurality of discharge holes 262 vertically penetrating through the inside of the water droplet blocking part 250.

The suction part 260 is formed inside the water droplet blocking part 250, and guides the cool air circulated in the first and second storage parts 118 and 122 to move to the lower portion of the first and second storage parts 118 and 122 and to flow toward the first and second cool air generation parts 120 and 124 through the suction part 260.

A blocking plate 266 may be formed in the center of the suction part 260. The blocking plate 266 may be formed to have the same inclination as that of the discharge guide rib 264.

The blocking plate 266 is a portion in which the vent hole is not formed, and serves to block a portion of the vented cool air.

In addition, an inclined part 268 is formed on the lower rear surface of the grille plate 200. The upper end of the inclined part 268 may be connected to the lower end of the suction part 260, and the lower end of the inclined part 268 may be connected to the lower bottom of the rear surface of the grille plate 200.

The inclined part 268 is formed to be inclined to the rear side along the lower end of the suction part 260, so that the water droplets generated on the rear surface of the water droplet blocking part 250 and in the suction part 260 do not stagnate inside the water droplet blocking part 250 but fall downward.

In addition, even when the water droplets introduced into the suction part 260 fall in the downward direction, they do not stagnate on the lower surface of the water droplet blocking part 250 but fall downward according to the direction in which the inclined part 268 guides.

An internal sensor module 300 is installed on the front of the grille plate 200. Since the internal sensor module 300 has the same structure as the internal sensor module of the embodiment, a detailed description thereof will be omitted.

The front surface of the grille plate 200 includes a blocking rib 700 for preventing the temperature sensor 328 from being affected by the cool air guided from the vent guide 500.

Figure 46:
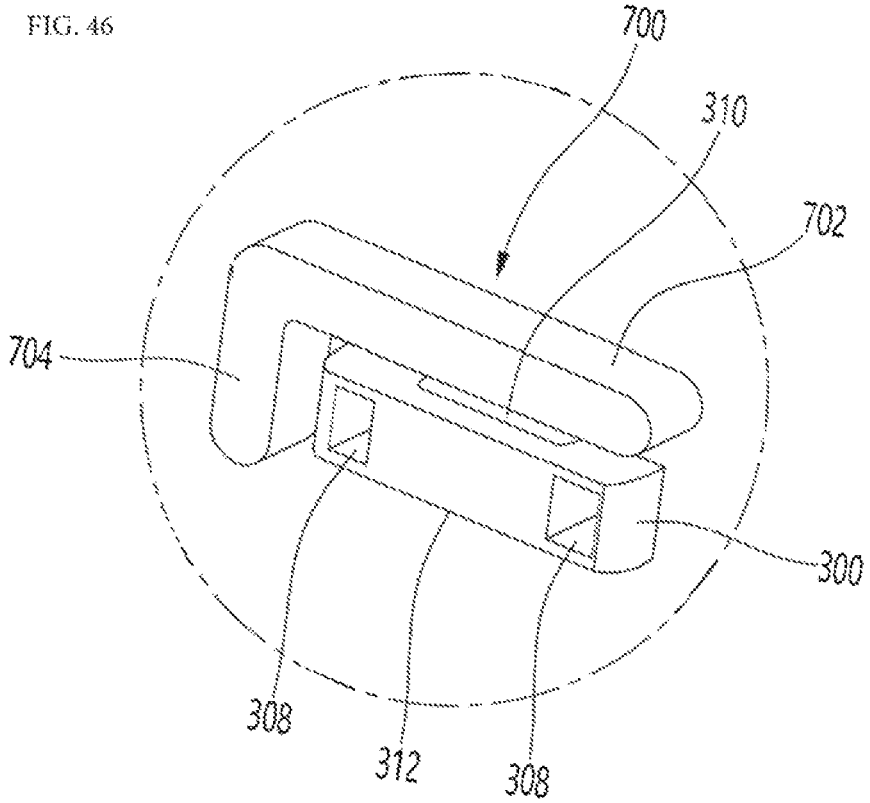
FIG. 46 is an enlarged view of part B of FIG. 44.
Figure 47:
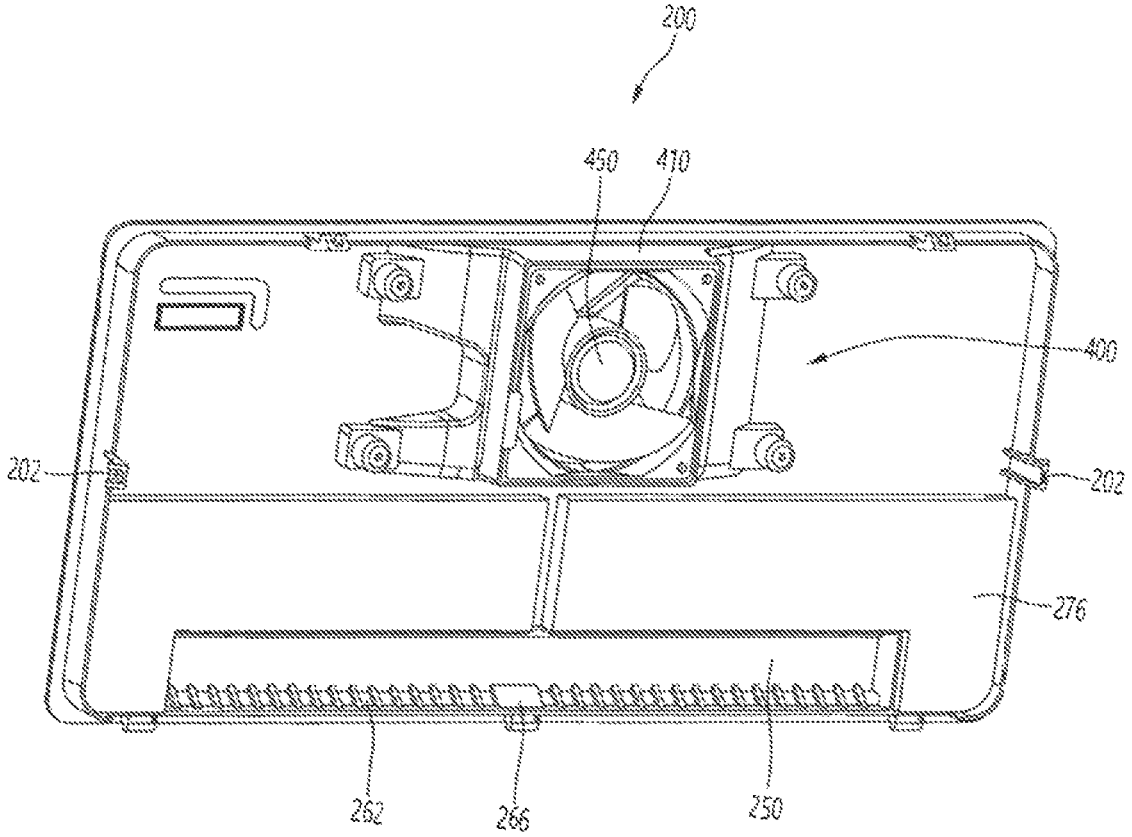
FIG. 47 is a rear perspective view showing a state in which a grille fan module is installed on the rear portion of the grille plate constituting another embodiment of the present disclosure.

The blocking rib 700 is formed to protrude forward from the front of the grille plate 200, as shown in FIG. 46, and includes a horizontal rib 702 formed on the upper side of the sensor mounting part 302 in the horizontal direction with respect to the lower end of the grille plate 200, and a vertical rib 704 formed in the vertical direction with respect to the lower end of the grille plate 200 on one side of the sensor mounting part.

The horizontal rib 702 blocks the cool air from the vent guide 500 to the sensor mounting part 302 from moving toward the temperature sensor 328 through the temperature sensing hole 306. To be specific, the horizontal rib 702 may be spaced upward from the upper temperature sensing hole 310 and formed along the upper surface of the sensor mounting part 302.

In addition, it is preferable that the upper end of the horizontal rib 702 is positioned on the same line as the lower end of the vent guide 500 or positioned further down.

The vertical rib 704 blocks the cool air flowing from the vent guide 500 toward the sensor mounting part 302 from moving inside the temperature sensing hole 306. To be specific, the vertical rib 704 may be formed to be spaced apart from one side adjacent to the vent guide 500 among both side surfaces of the sensor mounting part 302.

In addition, the vertical rib 704 may be spaced apart from the front temperature sensing hole 308 to one side, and may be formed along a side surface of the sensor mounting part 302.

The horizontal rib 702 and the vertical rib 704 may be formed by being connected to each other. That is, one end of the horizontal rib 702 may be connected to an upper end of the vertical rib 704. In this case, the horizontal rib 702 and the vertical rib 704 may be connected in a round shape.

When the cool air guided from the vent guide 500 directly flows toward the sensor mounting part 302, the direct cool air affects the temperature sensor 328, and it may be difficult to accurately measure the temperature in the first and second storage parts 118 and 122. Accordingly, by providing the blocking rib 700 to block the direct cool air coming through the vent guide 500, the temperature sensor 328 may accurately measure the temperature of the cool air in the first and second storage parts 118 and 122.

That is, the temperature sensor 328 is able to measure the temperature resulting from conduction inside the first and second storage parts 118 and 122 without being affected by the temperature resulting from convection of the cool air vented from the vent guide 500, so that temperature deviation of the temperature sensor 328 may be minimized.

Figure 48:
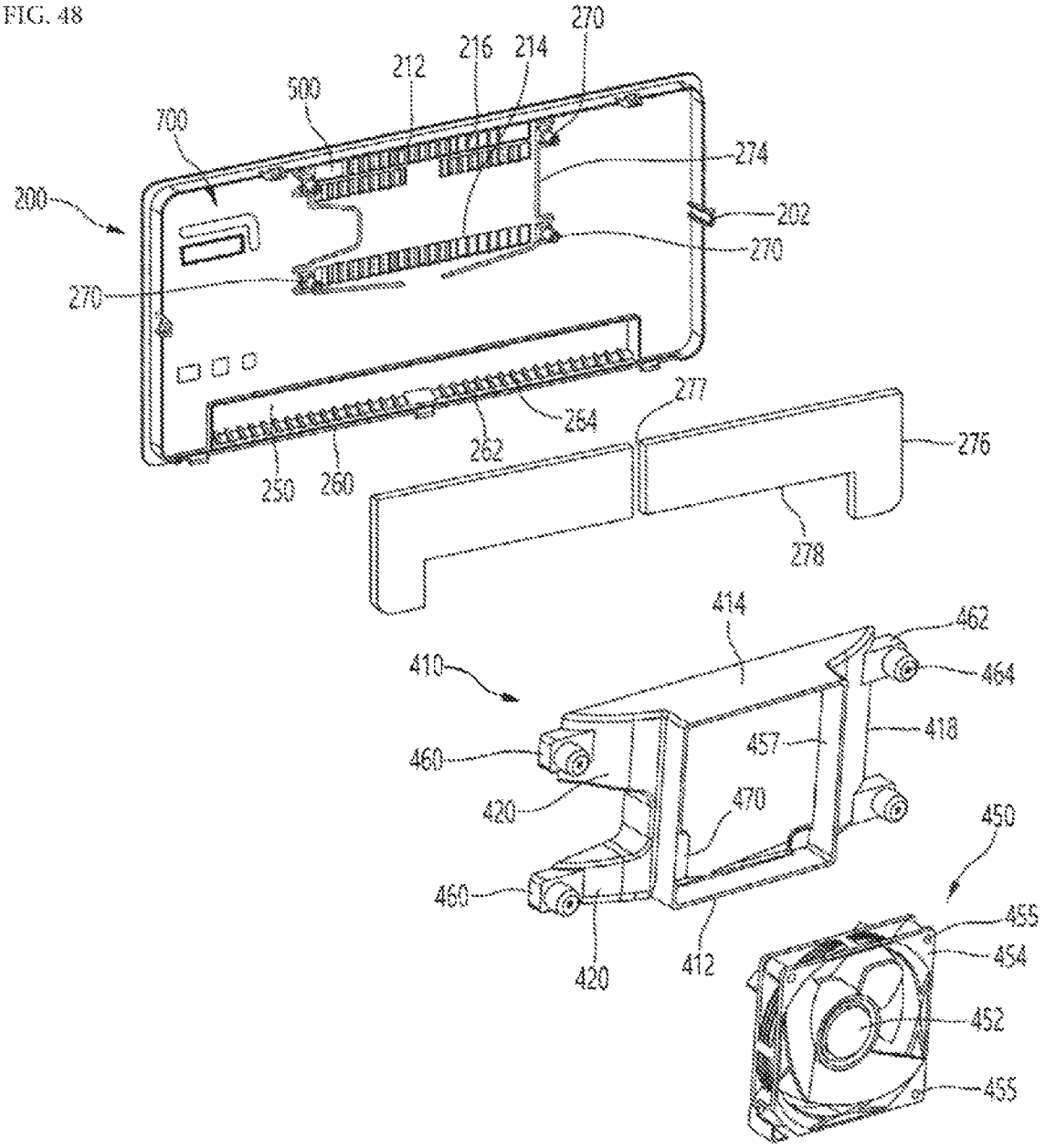
FIG. 48 is an exploded view showing a state in which the grille fan module and a heat insulation member are separated from the grille plate constituting another embodiment of the present disclosure.
Figure 49:
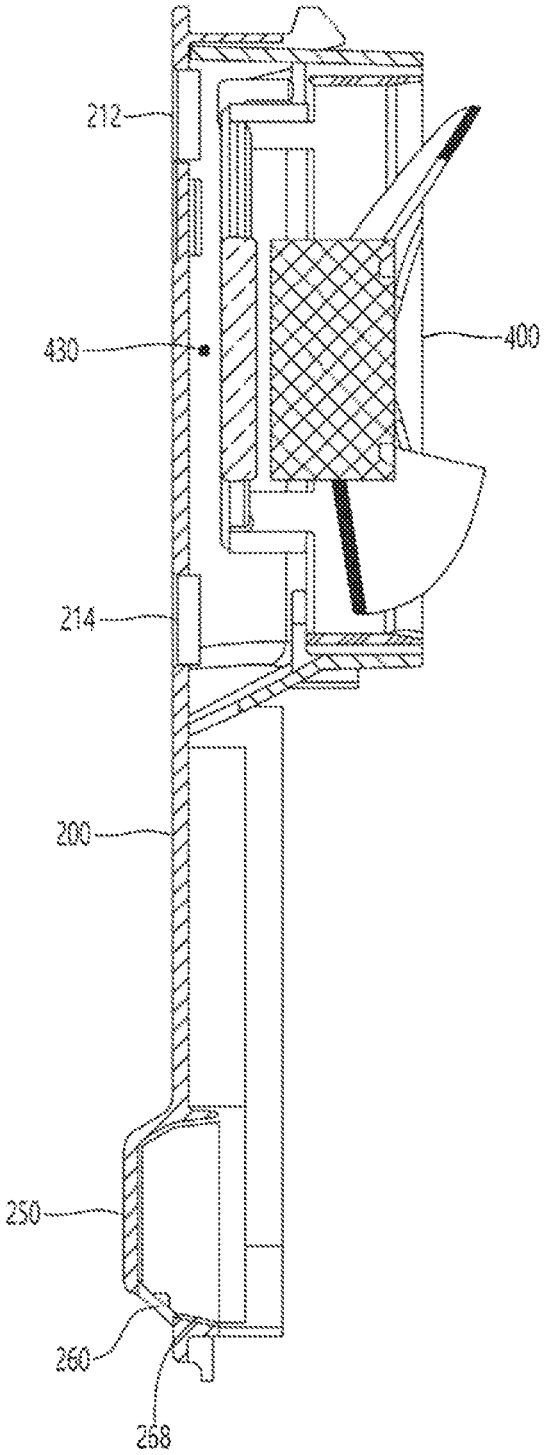
FIG. 49 is a longitudinal cross-sectional view of the grille plate constituting another embodiment of the present disclosure.

A thermal insulation foam 276 is attached to the rear surface of the grille plate 200. The thermal insulation foam 276 is formed of a rectangular plate material having a predetermined thickness, made of a PU foam material, as shown in FIG. 48. The thermal insulation foam 276 is attached to the lower rear surface of the grille plate 200 to prevent the cool air of the evaporator 280 to be described later from being directly transferred to the grille plate 200.

A discharge guide groove 278 is formed in the lower portion of the thermal insulation foam 276. The discharge guide groove 278 is a portion that is long cut left and right along the lower back of the thermal insulation foam 276. When the thermal insulation foam 276 is attached to the lower rear surface of the grille plate 200, the discharge guide groove 278 guides the cool air flowing into the cool air generation parts 120, 124 through the suction part 260 toward the evaporator 280.

In addition, a central groove 277 may be formed in the center of the thermal insulation foam 276. The central groove 277 is a vertically long cut along the center of the rear surface of the thermal insulation foam 276. When the thermal insulation foam 276 is attached to the rear surface of the grille plate 200, the central groove 277 guides the cool air flowing into the cool air generating space through the suction part 260 toward the evaporator 280 (see FIG. 48).

An evaporator 280 is installed on the rear surface of the thermal insulating foam 276. The evaporator 280 is a typical evaporator (EVA) and a detailed description thereof will be omitted. The evaporator 280 serves to cool the temperature of the cool air flowing into the cool air generation parts 120 and 124.

The scope of the present disclosure is not limited to the embodiments illustrated above, and many other modifications based on the present disclosure will be possible for those skilled in the art within the above technical scope.

The invention claimed is:

1. A refrigerator, comprising:

an outer casing;

an inner casing that is disposed in the outer casing and defines an inner space;

a door configured to open and close at least a portion of the inner space;

a grille plate that is disposed inside the inner casing and divides the inner space into a storage space and a cool air generation space;

an evaporator disposed in the cool air generation space and configured to generate cool air; and a grille fan module disposed in the cool air generation space and configured to supply the cool air to the storage space, wherein the grille plate defines a vent configured to discharge the cool air to the storage space, wherein the grille fan module comprises:

a shroud that is disposed at the grille plate and surrounds the vent, the shroud defining a venting chamber that is open in a front-rear direction and is configured to guide the cool air toward the vent, and a grille fan member disposed at the shroud, the grille fan member comprising a blowing fan that is configured to rotate to move the cool air from the cool air generation space into the shroud and to spray the cool air to the vent, wherein the venting chamber of the shroud comprises:

a first venting space defined at a first side of an inside of the shroud and configured to discharge the cool air toward a first portion of the vent, the inside of the shroud facing the grille plate, and a second venting space defined at a second side of the inside of the shroud and configured to discharge the cool air toward a second portion of the vent, and wherein a volume of the first venting space is greater than a volume of the second venting space.

2. The refrigerator of claim 1, wherein the grille fan module is disposed at an upper portion of the cool air generation space, and wherein the evaporator is disposed at a lower portion of the cool air generation space.

3. The refrigerator of claim 1, wherein the second venting space comprises:

an upper venting space defined at an upper right side of the inside of the shroud and configured to discharge the cool air from the inside of the shroud toward an upper right side of the vent; and a lower venting space defined at a lower right side of the inside of the shroud and configured to discharge the cool air from the inside of the shroud toward a lower right side of the vent.

4. The refrigerator of claim 3, wherein the shroud defines a grille fan installation space that receives the grille fan member therein and has a hollow box shape open in the front-rear direction, and wherein the shroud comprises:

a first guide wall that extends along a upper side of the grille fan installation space and covers the upper side of the grille fan installation space, the first guide wall extending in a left-right direction;

a second guide wall that extends along a lower side of the grille fan installation space and covers the lower side of the grille fan installation space, the second guide wall extending in the left-right direction;

a third guide wall that extends along a left side of the grille fan installation space, the third guide wall having a curved surface that protrudes in a left direction relative to the blowing fan and extends toward the grille plate; and a fourth guide wall that is disposed at a right side of the grille fan installation space, the fourth guide wall having a curved surface that protrudes in a right direction relative to the blowing fan and extends toward the grille plate.

5. The refrigerator of claim 4, wherein the fourth guide wall comprises a blocking wall disposed between the upper venting space and the lower venting space and configured to block discharge of the cool air from a space between the upper venting space and the lower venting space, and wherein the blocking wall comprises:

an upper first blocking wall that protrudes toward the grille plate and extends along an upper portion of the fourth guide wall and covers a lower end of the upper venting space;

a lower first blocking wall that protrudes toward the grille plate and extends along a lower portion of the fourth guide wall and covers an upper end of the lower venting space; and a second blocking wall that connects between the upper first blocking wall and the lower first blocking wall, the second blocking wall protruding toward the blowing fan to thereby partition the second venting space into the upper venting space and the lower venting space.

6. The refrigerator of claim 1, wherein the grille plate comprises a fastening boss that protrudes rearward from a rear surface of the grille plate and is disposed at a position adjacent to the vent.

7. The refrigerator of claim 6, wherein the grille fan module defines a shroud fixing groove that has an open front side and receives the fastening boss of the grille plate, the shroud fixing groove being defined at a side of the grille fan module and coupled to the fastening boss to thereby fix the grille fan module to the grille plate.

8. The refrigerator of claim 1, wherein the vent comprises:

a first vent defined at an upper portion of the grille plate; and a second vent defined at a center area of the grille plate below the first vent.

9. The refrigerator of claim 1, wherein the vent comprises a plurality of vent holes that are arranged along a plurality of rows.

10. The refrigerator of claim 9, wherein the grille plate comprises a blocking region that is disposed between the plurality of vent holes arranged along a least one of plurality of rows, the blocking region being configured to block a portion of the cool air from discharging to the storage space.

11. The refrigerator of claim 1, wherein the grille plate defines a suction opening at a lower portion of the grille plate, the suction opening being configured to receive air from the storage space to the cool air generation space.

12. The refrigerator of claim 1, wherein the grille plate comprises a vent guide rib that defines a plurality of vent holes at the vent and is configured to guide a venting direction of the cool air passing through the plurality of vent holes.

13. The refrigerator of claim 12, wherein the vent guide rib comprises:

a first guide rib disposed at a center portion of the plurality of vent holes and configured to guide the cool air in a forward direction toward the storage space; and a second guide rib disposed at a side portion of the plurality of vent holes and configured to guide the cool air in a left direction or a right direction.

14. The refrigerator of claim 1, wherein the grille plate comprises a vent guide disposed at a front surface of the grille plate facing the storage space, the vent guide defining an opening at a side of the vent and being configured to guide the cool air blown from the grille fan module to a side of the storage space.

15. The refrigerator of claim 1, further comprising an internal sensor module disposed at a front surface of the grille plate facing the storage space, the internal sensor module comprising a temperature sensor and a sensor mount that protrudes forward from the front surface of the grille plate and accommodates the temperature sensor.

16. The refrigerator of claim 15, wherein the sensor mount defines a temperature sensing hole that passes through a surface of the sensor mount and is configured to guide air from the storage space to the temperature sensor.

17. The refrigerator of claim 15, further comprising a blocking rib that protrudes forward from the front surface of the grille plate and extends along an upper end or a side end of the sensor mount, the blocking rib being configured to block the cool air discharged through the vent from being introduced to the internal sensor module.

18. A refrigerator, comprising:

an outer casing;

an inner casing that is disposed in the outer casing and defines an inner space;

a door configured to open and close at least a portion of the inner space;

a grille plate that is disposed inside the inner casing and divides the inner space into a storage space and a cool air generation space;

an evaporator disposed in the cool air generation space and configured to generate cool air; and a grille fan module disposed in the cool air generation space and configured to supply the cool air to the storage space, wherein the grille plate defines a vent configured to discharge the cool air to the storage space, wherein the refrigerator further comprises:

an internal sensor module disposed at a front surface of the grille plate facing the storage space, the internal sensor module comprising a temperature sensor and a sensor mount that protrudes forward from the front surface of the grille plate and accommodates the temperature sensor, and a blocking rib that protrudes forward from the front surface of the grille plate and extends along an upper end or a side end of the sensor mount, the blocking rib being configured to block the cool air discharged through the vent from being introduced to the internal sensor module.

* * * * *